US012781573B2

(12) United States Patent
Miess et al.

(10) Patent No.: US 12,781,573 B2
(45) Date of Patent: Nov. 3, 2026

(54) DRILL BIT CUTTERS WITH STEPPED SURFACES

(71) Applicant: Suzhou Superior Industrial Technology Co. Ltd, Suzhou (CN)

(72) Inventors: David P. Miess, Magnolia, TX (US); Yuming Jiang, Sunnyvale, CA (US); Samer Alkhalaileh, Dublin, OH (US)

(73) Assignee: Suzhou Superior Industrial Technology Co. Ltd. (CN)

( * ) Notice: Subject to any disclaimer, the term of this patent is extended or adjusted under 35 U.S.C. 154(b) by 601 days.

(21) Appl. No.: 17/843,428

(22) Filed: Jun. 17, 2022

(65) Prior Publication Data

US 2022/0403706 A1 Dec. 22, 2022

Related U.S. Application Data

(60) Provisional application No. 63/212,425, filed on Jun. 18, 2021.

(51) Int. Cl.
*E21B 10/567* (2006.01)

(52) U.S. Cl.
CPC ..... *E21B 10/5673* (2013.01); *E21B 10/5671* (2020.05)

(58) Field of Classification Search
CPC ..... E21B 10/5673; E21B 10/5676; E21B 10/5671
See application file for complete search history.

(56) References Cited

U.S. PATENT DOCUMENTS 5,119,892 A * 6/1992 Clegg ..... E21B 10/54 175/425
6,003,623 A 12/1999 Miess
6,447,560 B2 9/2002 Jensen et al.
6,883,624 B2 * 4/2005 McDonough ..... E21B 10/52 175/335
7,762,359 B1 * 7/2010 Miess ..... E21B 10/633 175/426
7,942,218 B2 5/2011 Cooley et al.
8,074,748 B1 12/2011 Miess et al.
8,168,115 B2 5/2012 Qian et al.
8,236,074 B1 8/2012 Bertagnolli et al.
8,361,429 B2 1/2013 Vail et al.
8,448,727 B1 5/2013 Miess
8,528,670 B1 9/2013 Cooley et al.
8,616,306 B2 12/2013 Bertagnolli et al.
8,739,904 B2 * 6/2014 Patel ..... E21B 10/5673 175/428
8,764,864 B1 7/2014 Miess et al.
8,790,430 B1 7/2014 Miess et al.
(Continued)

*Primary Examiner* — Kipp C Wallace
(74) *Attorney, Agent, or Firm* — Michael S. McCoy; Amatong McCoy LLC

(57) ABSTRACT

A cutting element for use on a drill bit is disclosed. The cutting element includes a polycrystalline diamond table having a multi-tiered surface. The polycrystalline diamond table has at least a first cutting surface and a second cutting surface. The polycrystalline diamond table has a step between the first and second cutting surfaces. The step is transitional surface feature between the first and second cutting surfaces, which are positioned at different elevations in the polycrystalline diamond table.

20 Claims, 38 Drawing Sheets

(56) References Cited

U.S. PATENT DOCUMENTS

| | | | | |
|---|---|---|---|---|
| 8,950,519 | B2 * | 2/2015 | Gonzalez | E21B 23/0419 175/430 |
| 9,017,438 | B1 | 4/2015 | Miess et al. | |
| 9,027,675 | B1 | 5/2015 | Jones et al. | |
| 9,297,411 | B2 | 3/2016 | Peterson et al. | |
| 9,334,694 | B2 | 5/2016 | Gonzalez et al. | |
| 9,352,447 | B2 | 5/2016 | Miess et al. | |
| 9,381,620 | B1 | 7/2016 | Miess et al. | |
| 9,533,398 | B2 | 1/2017 | Miess | |
| 9,623,542 | B1 | 4/2017 | Miess et al. | |
| 9,759,015 | B2 | 9/2017 | Miess | |
| 9,770,807 | B1 | 9/2017 | Miess et al. | |
| 9,909,366 | B1 | 3/2018 | Cooley et al. | |
| 10,022,840 | B1 | 7/2018 | Miess | |
| 10,060,192 | B1 | 8/2018 | Miess et al. | |
| 10,155,301 | B1 | 12/2018 | Jones et al. | |
| 10,214,967 | B2 | 2/2019 | Alkhalaileh et al. | |
| 10,293,467 | B2 | 5/2019 | Miess | |
| 10,322,495 | B2 | 6/2019 | Alkhalaileh et al. | |
| 10,364,615 | B2 | 7/2019 | Alkhalaileh et al. | |
| 10,450,808 | B1 | 10/2019 | Miess et al. | |
| 10,807,913 | B1 | 10/2020 | Hawks et al. | |
| 10,864,614 | B1 | 12/2020 | Miess | |
| 11,060,356 | B2 | 7/2021 | Maindreville et al. | |
| 11,180,961 | B1 | 11/2021 | Miess et al. | |
| 11,365,589 | B2 * | 6/2022 | Cheng | E21B 10/5673 |
| 11,873,684 | B2 * | 1/2024 | Zhao | E21B 10/5673 |
| 12,123,262 | B2 * | 10/2024 | Zhang | E21B 10/55 |
| 12,134,938 | B2 * | 11/2024 | Duffy | E21B 10/5735 |
| 2007/0278017 | A1 * | 12/2007 | Shen | E21B 10/573 175/426 |
| 2020/0032589 | A1 * | 1/2020 | Izbinski | E21B 10/5735 |
| 2020/0224500 | A1 * | 7/2020 | Dubose | E21B 10/5673 |
| 2020/0340303 | A1 * | 10/2020 | Cheng | E21B 10/42 |
| 2020/0347680 | A1 * | 11/2020 | Tian | E21B 10/5673 |
| 2021/0277722 | A1 * | 9/2021 | Liu | E21B 10/5673 |

* cited by examiner

DRILL BIT CUTTERS WITH STEPPED SURFACES

CROSS-REFERENCE TO RELATED APPLICATIONS

The present application claims the benefit of U.S. Provisional Patent Application No. 63/212,425, filed on Jun. 18, 2021, and entitled "Trough Cutter and PDC Product and Process," the entirety of which is incorporated herein by reference.

FIELD

The present disclosure relates to drill bit cutters having stepped surfaces, to systems including the same, to methods of making the same, and to methods of using the same.

BACKGROUND

Polycrystalline diamond compact (PDC) inserts (also referred to as PDC cutters and PDC cutting elements) are used on drill bits to shear rock during the drilling of wells, such as oil and gas wells. PDC inserts can be in the form of disks of synthetic diamond.

FIG. 1 depicts an example of a traditional PDC drill bit 101. PDC drill bit 101 includes bit body 100 with a plurality of outwardly extending blades 110 thereon. A front or leading edge 120 of each blade 110 carries a plurality of cutting elements 130 that are traditional cylinder PDC cutter inserts. The cutting elements 130 are arranged such that, in use, rotation of the drill bit 101 about its axis, with an axially directed weight-on bit loading applied to the drill bit 101, causes the cutting elements 130 to engage with and against a formation resulting in the gouging, scraping, abrading or otherwise removing of material from the formation, such that a borehole being drilled is extended.

FIG. 2 depicts a traditional PDC cutter insert, cutting element 200, which may be identical or substantially similar to cutting element 130 shown in FIG. 1. Cutting element 200 includes substrate 210 integrally bonded with table 220. Table 220 is typically a superhard material, such as polycrystalline diamond, and substrate 210 is typically a material that is softer than table 220, such as tungsten carbide. In use, such traditional cylinder PDC cutters make contact with the rock at a single edge that is used to shear the rock. For example, FIG. 3 illustrates the use of a traditional PDC insert to shear a rock formation. Cutting element 300 is positioned on blade 305 of body 303. Cutting element 300 may be identical or substantially similar to cutting element 130 and/or cutting element 200 as shown in FIGS. 1 and 2, respectively. Cutting element 300 may be a standard PDC cutting element. The cutting element 300 is generally mounted on blade 305 with a negative back rake angle, providing good load distribution for both axial and torsional loading of cutting element 300. The type of rock formation 315 influences how the cutting element 300 removes the formation 315. In the case of a softer rock under confining pressures, the cutting element 300 will be more likely to have a deep depth of cut with the cuttings 310 shearing off in the form of a stringer, ribbon, or chip. In the case of hard rock, the cutting element 300 will more likely have a shallow depth of cut and tend to grind, fracture and point load the rock. FIG. 3 shows fracture 320 in formation 315. Such point loading makes the cutting element 300 more vulnerable to damage from momentary load spikes in torque, weight on bit (WOB), vibration, heat concentrations at the cutting tip and encountering unexpected stringers.

More recently, points, scribe tips, and axe-type cutters have been used to promote fracturing of the rock by splitting and point loading, followed by a secondary cylinder cutter used to shear the rock. However, scribe tips can be relatively weak when exposed to impacts, such as when exposed to a side impact or lateral load. Also, conical tips and axe-type cutters are less efficient in comparison to a pure shearing edge of a cylinder cutter. FIG. 4 depicts a traditional PDC insert used in conjunction with a leading scribe or pick to shear or pre-fracture rock formation. Scribes have a geometric shape that is generally pointed, square, or rounded, and are used to score, scratch, create a groove, or fracture a material such as a rock formation. Picks are generally pointed and/or conical shaped geometric objects used to point load and fracture a formation. As shown in FIG. 4, a conical pick 400 is used to pre-fracture hard rock formation 415 by either scoring or point loading to form fractures 419. As shown by directional lines 423, the conical pick 400 moves across the formation 415 in front of the traditional PDC cutting element 410, which follows behind the conical pick 400 to shear and remove the already fractured and weakened formation 415. Cutting element 410 may be identical to or substantially similar to element 130, 200, and/or 300 as shown in FIGS. 1-3, respectively. A disadvantage to this method is that, in soft formations, conical picks have an inefficient shape, which reduces drilling efficiency, both through torque loading and by acting as a potential depth of cut limiter. In some applications, such as when drilling hard rock, the use of cutting element 410 can require a high weight on bit (WOB), which increases bit breakages and spall risk, and results in low depth of cut (DOC) making it difficult to shear. In some applications, such as when drilling soft rock, shearing is relatively easier than in hard rock and the bit can have a higher DOC creating a large volume of cuttings.

The diamond tables of traditional cylinder cutters are often flat planar surfaces that are subjected to relatively uncontrollable, unpredictable, or catastrophic fracturing. Also, when traditional cutters, in particular those with relatively thick diamond tables, are significantly worn, the wear can be in the form of a large ovoid surface in the diamond table that can act as a bearing surface thus making it more difficult for the cutter to engage or "bite" the formation.

BRIEF SUMMARY

Some embodiments of the present disclosure include a cutting element for use on a drill bit. The cutting element includes a polycrystalline diamond table. The polycrystalline diamond table has a first cutting surface and a second cutting surface. The polycrystalline diamond table includes a step between the first and second cutting surfaces, such that the first cutting surface is positioned at a first elevation in the polycrystalline diamond table and the second cutting surface is positioned at a second elevation in the polycrystalline diamond table. The second elevation is different than the first elevation.

Some embodiments of the present disclosure include a cutting element for use on a drill bit. The cutting element includes a polycrystalline diamond table having a first cutting surface and a second cutting surface. The polycrystalline diamond table includes a first step adjacent the first cutting surface, and the first step has a first sidewall. The polycrystalline diamond table includes a second step adjacent the second cutting surface, and the second step has a second sidewall. The first sidewall and the second sidewall adjoin between the first and second cutting surfaces such that the steps form a trough between the first and second cutting surfaces. The trough is positioned at a lower elevation than the first and second cutting surfaces.

Some embodiments of the present disclosure include a method of making a polycrystalline diamond cutting element for use on a drill bit. The method includes forming a polycrystalline diamond table having a multi-tiered cutting surface. The forming includes providing a step in the polycrystalline diamond table such that the polycrystalline diamond table includes a first cutting surface and a second cutting surface. The step is between the first and second cutting surface. The first and second cutting surfaces are positioned at different elevations in the polycrystalline diamond table.

Some embodiments of the present disclosure include a method of drilling. The method includes providing a drill string including a drill bit. A plurality of cutting elements are positioned on the drill bit. At least some of the plurality of cutting elements include a stepped polycrystalline diamond table hawing a first cutting surface, a second cutting surface, and a step between the first and second cutting surfaces. The first cutting surface is positioned at a first elevation in the stepped polycrystalline diamond table and the second cutting surface is positioned at a second elevation in the stepped polycrystalline diamond table. The second elevation is different than the first elevation. The method includes drilling a borehole into a formation with the drill bit.

Some embodiments of the present disclosure include a drill bit. The drill bit includes a body, blades, and a plurality of cutting elements positioned on the blades. At least some of the plurality of cutting elements include a stepped polycrystalline diamond table having a first cutting surface, a second cutting surface, and a step between the first and second cutting surfaces. The first cutting surface is positioned at a first elevation in the stepped polycrystalline diamond table and the second cutting surface is positioned at a second elevation in the stepped polycrystalline diamond table. The second elevation is different than the first elevation.

Some embodiments of the present disclosure include a drill string. The drill string includes a drill bit. A plurality of cutting elements are positioned on the drill bit. At least some of the plurality of cutting elements include a stepped polycrystalline diamond table having a first cutting surface, a second cutting surface, and a step between the first and second cutting surfaces. The first cutting surface is positioned at a first elevation in the stepped polycrystalline diamond table and the second cutting surface is positioned at a second elevation in the stepped polycrystalline diamond table. The second elevation is different than the first elevation.

BRIEF DESCRIPTION OF THE DRAWINGS

So that the manner in which the features and advantages of the systems, apparatus, and/or methods of the present disclosure may be understood in more detail, a more particular description briefly summarized above may be had by reference to the embodiments thereof which are illustrated in the appended drawings that form a part of this specification. It is to be noted, however, that the drawings illustrate only various exemplary embodiments and are therefore not to be considered limiting of the disclosed concepts as it may include other effective embodiments as well.

DETAILED DESCRIPTION

Certain embodiments of the present disclosure include PDC cutting elements for use in drill bits. The PDC cutting elements (also referred to a cutters) disclosed herein have diamond tables that include at least one step in the diamond table, such that the diamond table has at least two surfaces that are positioned at different elevations on the cutting element. As used herein, a "step" in a diamond table is a transition in elevation between two surfaces on the diamond table. For example, in a diamond table that includes an upper surface (i.e., a surface at a relatively higher elevation) and a lower surface (i.e., a surface at a relatively lower elevation), a step is a surface feature in the diamond table that defines the transition in the diamond table from the upper surface to the lower surface. In such an embodiment, the step may include a top edge, a sidewall, and a root or bottom edge, with the top edge being the boundary between the sidewall and the upper surface, the root or bottom edge being the boundary between the sidewall and the lower surface, and the sidewall being a surface extending between the upper surface and the lower surface. The provision of one or more steps in the diamond table provides a multi-tiered diamond table having multiple surfaces at different elevations within the cutting element. The diamond tables disclosed herein have a three-dimension topography, as opposed to having only a single, flat planar surface without any steps.

In some embodiments, multiple steps in a diamond table are arranged relative to one another to form a trough between the steps. A trough includes a surface of a diamond table that is lower in elevation than at least two adjacent surfaces of the diamond table (e.g., surface 506*c* is lower in elevation than surfaces 506*a* and 506*b*, as described below).

Figure 5A:
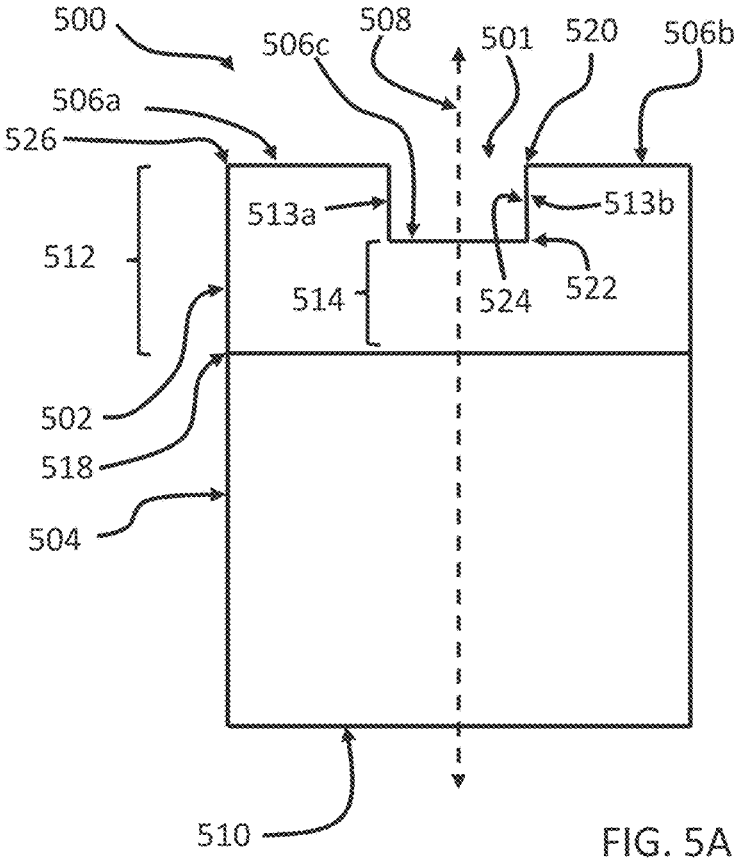
FIG. 5A is a side of a PDC cutting element having multiple steps.
Figure 5B:
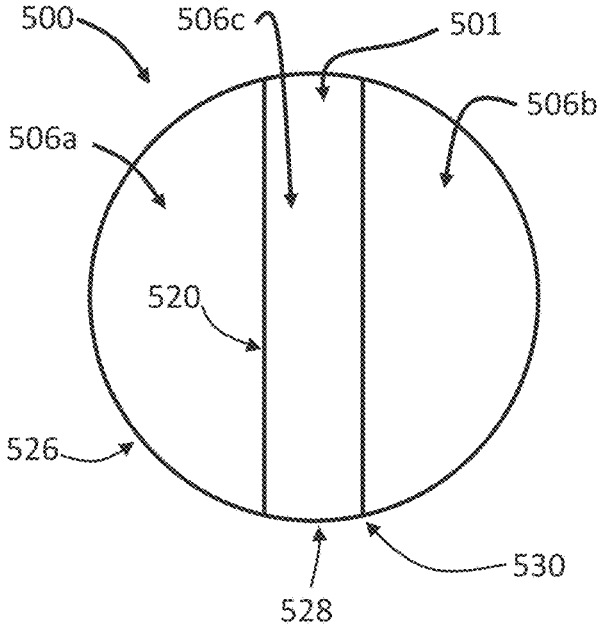
FIG. 5B is a top view of a PDC cutting element having multiple steps.

The multiple surfaces of the diamond table provide the cutting element with multiple, different cutting faces positioned at different elevations or heights along a longitudinal center line of the cutting element. With reference to FIGS. 5A and 5B, simplified schematics of a PDC cutting element 500 are depicted. Cutting element 500 includes diamond table 502 supported on support 504. Support 504 may be, for example and without limitation, a tungsten carbide support. In some embodiments, the support 504 is or includes cemented tungsten carbide with a cobalt substrate. Diamond table 502 may include polycrystalline diamond (e.g., PCD). Cutting element 500 includes interface 518. The interface 518 is the common boundary or geometric plane between the polycrystalline diamond material, diamond table 502, and the support 504.

Opposite support 504, diamond table 502 includes multiple cutting surfaces (also referred to as cutting faces), including cutting surfaces 506*a*, 506*b*, and 506*c*. Diamond table 502 also includes peripheral edge (perimeter) 526. The cutting surfaces 506*a*-506*c* are positioned to engage with formation during drilling operations to break up and remove the formation material. Cutting element 500 has an imaginary longitudinal centerline 508 extending through a center of cutting element 500. Cutting faces 506*a* and 506*b* are both positioned at a first height 512 from interface 518, and are coplanar. The extension of the first height 512 is parallel to the extension of the longitudinal centerline 508. Cutting surface 506*c* is positioned at a second height 514 from interface 518. Second height 514 is less than the first height 512. Thus, the cutting surface 506*c* is not coplanar with the cutting surfaces 506*a* and 506*b*. While the heights 512 and 514 shown and described in FIG. 5A are defined relative to the interface 518, the relative heights of the cutting surfaces 506*a*-506*c* can be determined relative to other components or portions of the cutting element 500, such as a bottom 510 of the support 504, the upper most surface of the diamond table 502, or an imaginary plane. In some embodiments, the cutting surface that has the greatest height is the primary cutting face of the cutting element. The cutting surfaces may each be within the perimeter (e.g., peripheral edge 526) of the top of the diamond table. In some embodiments, the cutting surfaces are coplanar. In some embodiments, the cutting surfaces are not coplanar, but extend in planes that are parallel to one another. In some embodiments, the cutting surfaces are not coplanar and extend in planes that are at an angle to one another, such as an angle of less than 90°, or less than 80°, or less than 70°, or less than 60°, or less than 50°, or less than 45', or less than 40°, or less than 30°, or less than 20°, or less than 10°, or from 1° to less than 90° or any range or discrete value therebetween.

The cutting element 500 includes two steps, including step 513*a* and step 513*b*. Step 513*a* is a surface feature that defines the transition from surface 506*a* to surface 506*c*. Step 513*b* is a surface feature that defines the transition from surface 506*c* to surface 506*b*. Thus, the diamond table 502 has a "stepped surface."

In the embodiment shown in FIG. 5A, the steps 513*a* and 513*b* are arranged relative to one another to form a trough 501 (or channel) in the diamond table 502, with the lower cutting surface 506*c* forming the bottom surface of the trough 501. The trough 501 has a depth that is equal to the differential in elevation between the upper cutting surfaces 506*a* and 506*b* and the lower cutting surface 506*c* (i.e., the differential between first height 512 and second height 514). Each step has a top edge 520, a bottom edge 522 (forming a root of the step), and a sidewall 524. The sidewalls 524 are shown as perpendicular to surfaces 506*a*-506*c*. However, the sidewalls disclosed herein may be at other angles relative to the cutting surfaces of the diamond table. Trough 501 also includes peripheral edge 528 and peripheral corners 530, as shown in FIG. 5B.

The height of the steps and/or the depth of the troughs disclosed herein can be from 5% to 95% of a total thickness of the diamond table (e.g., from 5% to 95% of the first height 512). For example, if the first height 512 is 4 millimeters, then the depth 513 may be from 0.2 millimeters to 3.8 millimeters. In some embodiments, the height of the steps and/or the depth of the troughs disclosed herein are from 5% to 95%, or from 10% to 90%, or from 15% to 85%, or from 20% to 80%, or from 25% to 75%, or from 30% to 70%, or from 35% to 65%, or from 40% to 60%, or from 45% to 55% of the total thickness of the diamond table, or any range or discrete value therebetween. The trough 501 also has a width that is equivalent to the distance between the two bottom edges 522 of the trough 501. The width of the troughs disclosed herein may be varied depending on the application, formation type, back rake and depth of cut.

In some embodiments, the cutting elements disclosed herein have at least two cutting faces that are positioned at different heights, along the longitudinal centerline of the cutting element, than one another. In some embodiments, the cutting elements disclosed herein have at least two cutting faces that are not coplanar with one another. The provision of cutting faces on the cutting element that are at different heights, along the longitudinal centerline of the cutting element, than one another; and/or that are not coplanar with one another may be achieved by various methods of making and/or modifying the surface of the diamond table, as described in more detail below. For example, troughs may be formed in the surface of the diamond table.

The PDC cutting elements disclosed herein may be in the form of a cylinder cutting element having a shearing edge that is split (e.g., via the presence of a trough) or is stepped. The split or step in the top surface of the diamond table can be positioned at an area or point of contact area where the cutting element is expected to contact rock or other formation material during drilling with the cutting element. The split or step in the surface of the diamond table can be positioned at the cutting face of the cutting element, such that the cutting element has multiple cutting faces positioned to engage with the formation. The different heights of the cutting faces provide the cutting element with the ability to simultaneously fracture formation material and shear formation material. The formation material can be terrestrial material, such as rock.

In some embodiments, the troughs are aligned to engage (e.g., directly engage) with formation rock. During drilling, the peripheral edge (e.g., edge 526) of the diamond table and the bottom or peripheral edge (e.g., edge 528) of a step or trough can act as a shearing edge for removal of a relatively high-volume rock. During drilling, the peripheral top corners of the trough (e.g., corners 530) can act as scoring tips or corner points that facilitate the fracturing of rock during drilling operations.

During drilling, the steps, edges, and corners create stress risers to fracture the formation rock, while the cutting faces (e.g., surfaces 506*a*-506*c*) provide shearing planes to remove high volumes of the formation rock. These and other features will become more readily apparent with reference to FIGS. 6-46.

Diamond Tables with Step Features

Figure 6A:
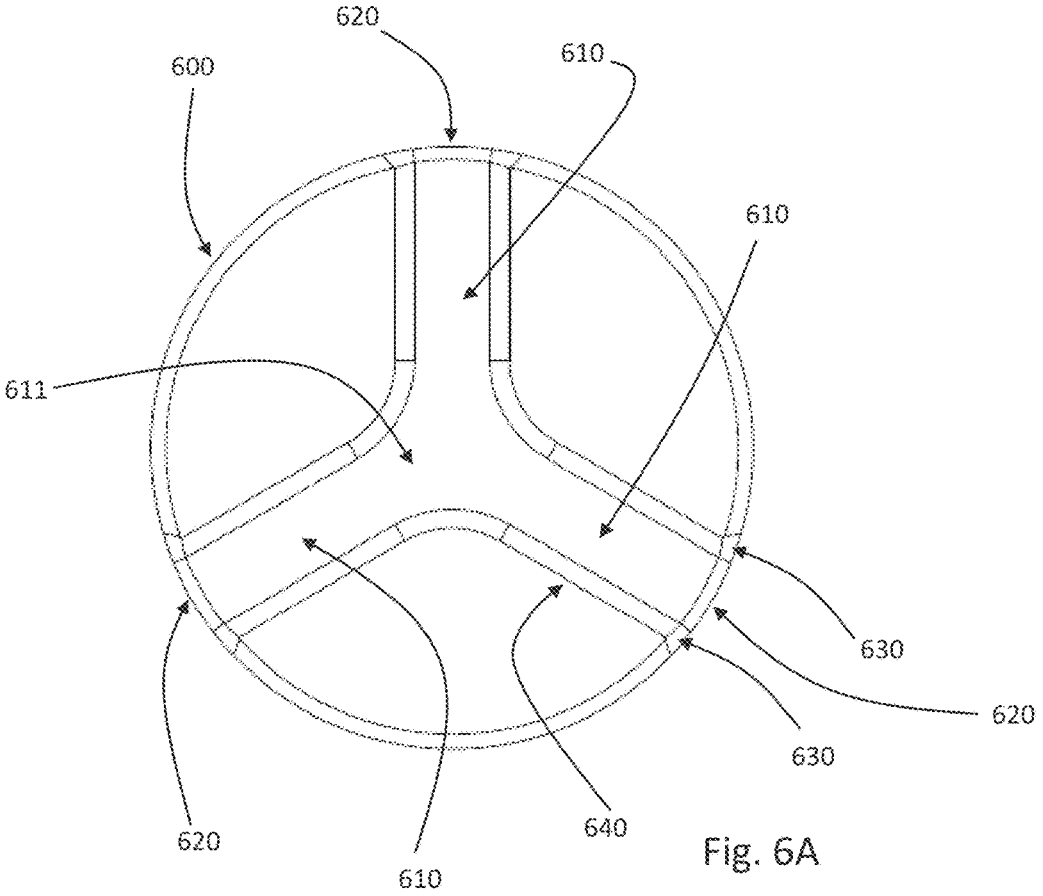
FIG. 6A is a top view of a PDC insert cutting element in accordance with an embodiment of the present disclosure, including a trough with angled trough walls.
Figure 6B:
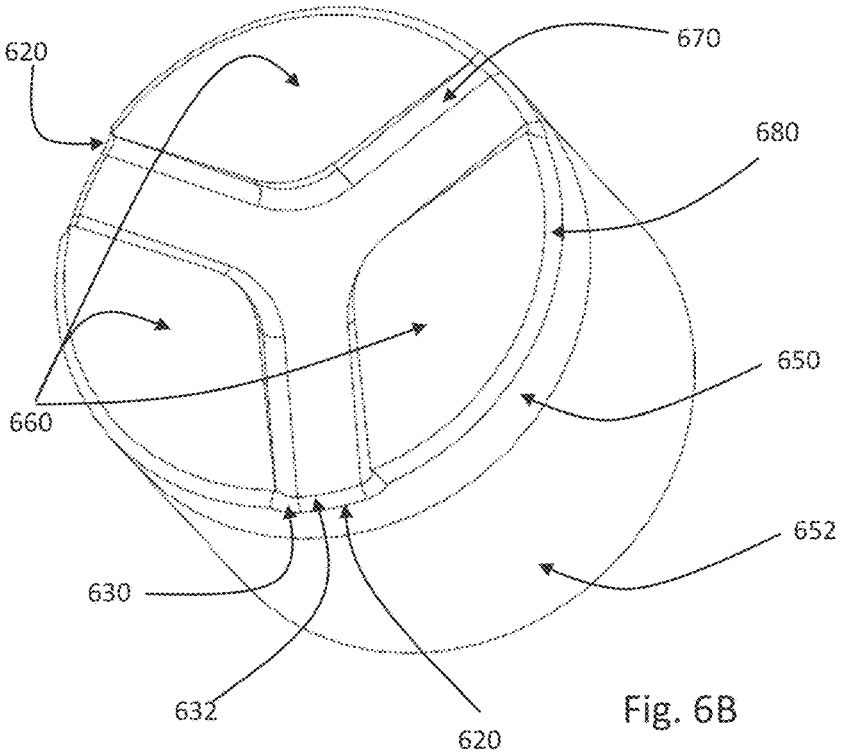
FIG. 6B is an isometric view of the PDC insert cutting element of FIG. 6A.

With reference to FIGS. 6A and 6B, PDC insert cutting element 600 is depicted. Cutting element 600 is generally cylindrical about a central or longitudinal axis thereof. Cutting element 600 includes diamond table 650 supported on support 652.

Cutting element 600 includes upper cutting faces 660, and lower cutting face 610. The three upper cutting faces 660 are coplanar, and the lower cutting face 610 is positioned at a lower elevation than the upper cutting faces 660. Thus, lower cutting face 610 is positioned closer to support 652.

Lower cutting face 610 is a bottom surface of a symmetrically patterned trough 611 that is formed into the surface of the polycrystalline diamond table 650. The layout of the trough 611 can be designed and adjusted at the designer's discretion. While the trough 611 is shown as having a symmetrical layout, the troughs disclosed herein may also have asymmetrical layouts.

The trough 611 includes angled trough sidewalls 670, top edges 640, corners 630, peripheral edges 632, and trough exits 620. The sidewalls 670 extend from the cutting face 610 up to the cutting faces 660 at the top edge 640. The diamond table 650 includes peripheral edge 680.

The exits 620 are positioned at a perimeter of the diamond table 650. Exits 620 may serve as discrete locations or cutter positions for direct contact with rock formations during drilling with cutting element 600 when positioned on a drill bit. While shown as having three trough exits 620, the cutting elements disclosed herein are not limited to having three trough exits, and may include more or less than three trough exits. In some embodiments, the cutting elements disclosed herein do not include any exits. In some embodiments, the cutting elements disclosed herein include at least one trough exit at the perimeter of the diamond table, and may include a plurality of trough exits.

During drilling, the trough 611 can be radially aligned in a cutter pocket such that the peripheral edges 632 at the exits 620 act as primary shearing edges, while the trough corners 630 act as shearing corners to prescore or fracture rock formation.

Various parameters or drilling factors will determine when the shearing corners 630 engage the rock including back rake angle of the cutting element 600, width of the trough 611, and depth of cut of the cutting element 600 into the formation. Additionally, the cutter side rake angle facilitates the engagement of one of the trough corners 630 to further increase fracturing potential.

Figure 7:
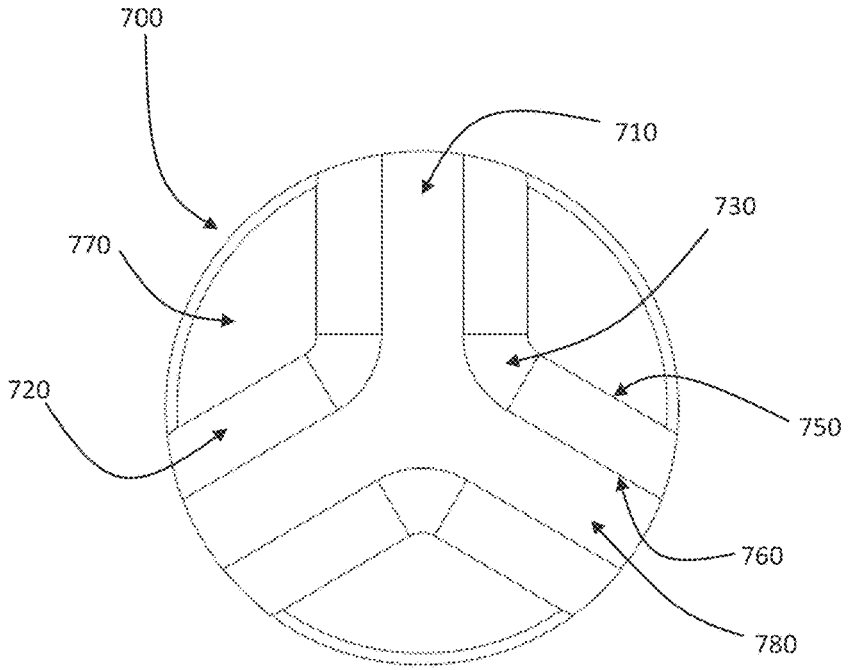
FIG. 7 is a top view of a PDC insert cutting element in accordance with an embodiment of the present disclosure, including a trough with radius trough walls.
Figure 8:
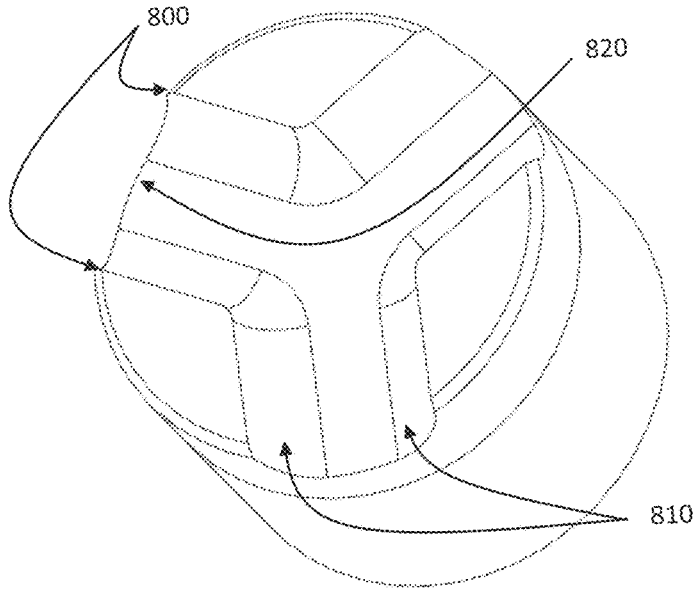
FIG. 8 is an isometric view of the PDC insert cutting element of FIG. 7.

FIGS. 7 and 8 depict another embodiment of a PDC cutting element insert having a trough design. The cutting element 700 includes a trough 710 that is similar to, but wider than, the trough shown in FIGS. 6A and 6B. The trough 710 is symmetrically patterned with a relatively large radius sidewall 720. The edges 750 and 760 of the trough 710 are not beveled. Cutting element 700 includes upper cutting surfaces 770 and lower cutting surface 780 (i.e., the bottom surface of the trough 710).

During drilling, the cutting element 700 is aligned such that the trough 710 makes primary contact with rock formation. The relatively large radius of sidewalls 720 provide for increased lateral chip breaking capability. The wider through design with the curved sidewalk 720 also provides for multiple modes of contact at the periphery of the cutting element 700 for more efficient rock removal. In particular, the trough tips 800 provide sharp shearing points to score and/or fracture the rock. Also, the curved periphery edges 810 of the trough 710 provide a curved shearing surface that adjusts according to the cutter depth of cut. That is, during drilling, the shearing edge 820 (i.e., the periphery edge of the trough 710) changes attack angle on the sides of the trough 710 as the cutting element 700 penetrates deeper into the rock formation. This change in attack angle protects the cutting element 700 from over engagement and torque spikes. Additionally, rock may be fractured more easily and efficiently as the shearing action dynamically transitions from between perpendicular and parallel attack angles as a function of both axial and torsional forces imposed on the drill bit.

A wide trough, such as trough 710, may be particularly suitable for use in relatively softer formations where more shearing is desired and in applications where a relatively deep depth cut is desired. Whereas, a narrower trough, such as trough 611 shown in FIG. 6A, may be particularly suitable for use in relatively harder rock formations promoting scoring and fracturing of the hard rock by the leading-edge trough corners 800 and shoulders.

During drilling, the curved, contoured sidewalls 720 of the trough 710 provide favorable counter forces that provide a stabilizing effect and minimize lateral drill bit vibrations. That is, balancing counterforces are created by utilizing prominent and opposing curved trough sidewalls 720 that minimize lateral bit vibration during bit rotation. The cutting element 700 can be used to provide such counterforce stabilization without requiring the use multiple different bits and the associated stock of an additional inventory of bits. Also, during drilling, the cutting element 700 can create a track locking effect in the rock such that the drill bit is maintained centered.

Cutting element 700 also includes chip breaker features 730. The chip breaker features 730 are positioned near a center of the cutting element 700. The chip breaker features 730 are curved surfaces positioned at bend in the pathway of the trough 710, and form corners between adjacent sidewalk 720.

Figure 9:
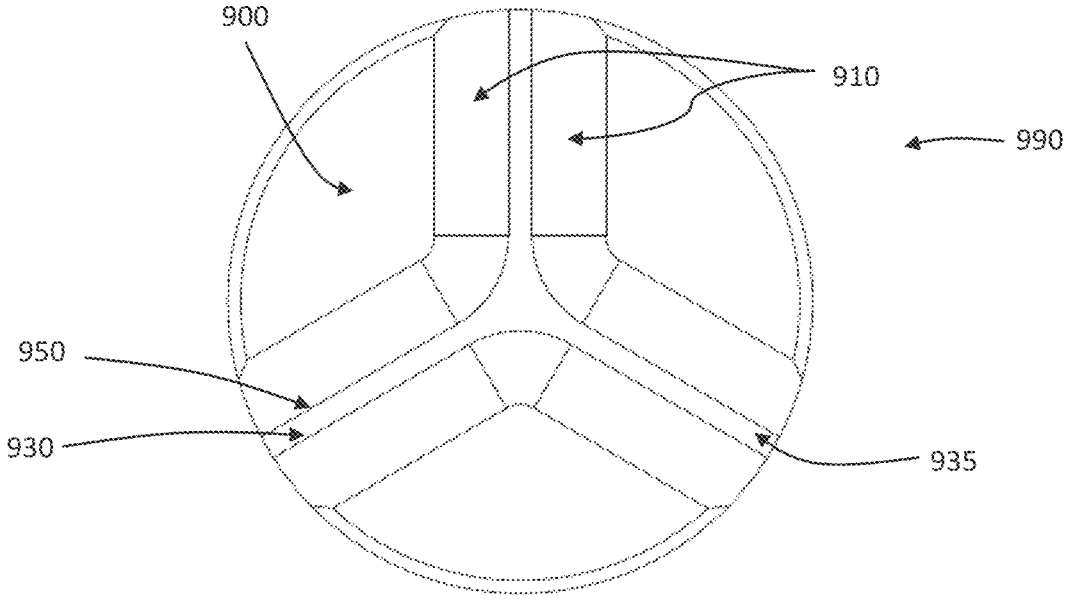
FIG. 9 is a top view of a PDC insert cutting element in accordance with an embodiment of the present disclosure, including a "V" trough design with angled trough walls.
Figure 10:
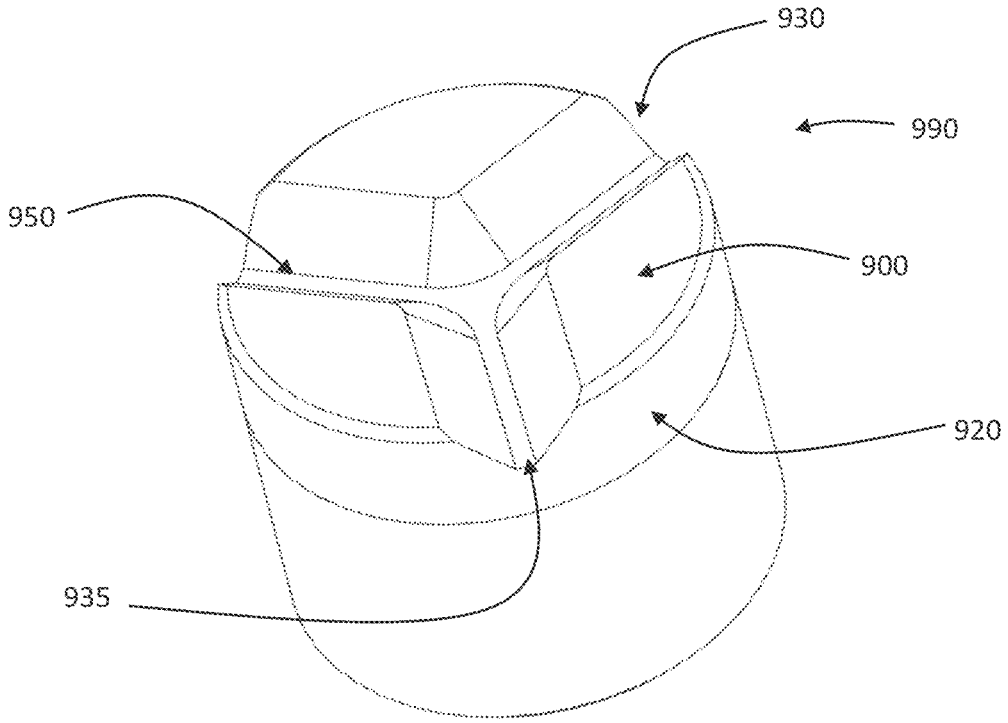
FIG. 10 is an isometric view of the PDC insert cutting element of FIG. 9.

FIGS. 9 and 10 depict a PDC cutting element insert having an angular "V" trough design. In the embodiment in FIGS. 9 and 10, the cutting element 990 has an angular trough 930 that is formed into the diamond table 920, extending below the coplanar cutting faces 900. Trough 930 includes a lower cutting surface 935, which is below each of the upper cutting surfaces 900.

Trough 930 has angled trough sidewalk 910. The sidewalls 910 have a negative rake, such that the sidewalls 910 are contoured at an angle that is less than 90 degrees, as referenced from the upper cutting faces 900. The negative rake of the sidewalls 910 provides additional strength reinforcement to the polycrystalline diamond trough edges 950 for increased cutter durability, such as for use in high cutting force applications. Whereas, an angled trough sidewall having a positive rake (i.e., an angle greater than 90 degrees as referenced from the upper cutting face) would provide for maximum fracturing potential for certain drilling applications and types of rock formation. A trough sidewall with a neutral rake (i.e., perpendicular trough sidewalls) would provide a balance of durability and rock fracture potential for the cutting element. While the trough sidewalls 910 shown in FIG. 9 have the same angle as one another, in other the cutting elements disclosed herein include trough sidewalk with different angles. For example, trough sidewalls on opposing sides of a trough bottom surface may have different angles.

Trough base or bottom surface 935 is depicted as being a planar surface that, while not coplanar with upper cutting surfaces 900, extends in a parallel plane as cutting surfaces 900. However, in other embodiments, the lower cutting surface of the troughs disclosed herein are angled or curved surfaces that do not extend in a parallel plane with the upper cutting surfaces of the diamond table.

During drilling, the trough 930 acts as a self-stabilizing feature. The angled faces of the opposing sidewalls 910 provide counterforces that minimize lateral vibrations of the drill bit without requiring side positioning of the cutting elements on the drill bit. The angled faces of the sidewalls 910 adjust aggressiveness as a function of depth of cut into the rock and back rank angle. The cutting element 990 has the flexibility to engage rock directly on the through 930 or between portions of the through.

The angles of the sidewalk 910 of the trough 930, the depth of the trough 930, the width of the trough 930, the edge geometries of the trough 930, the symmetry of the trough 930, and/or the size of the trough 930 can be adjusted based on the drilling application and formation conditions.

Figure 11:
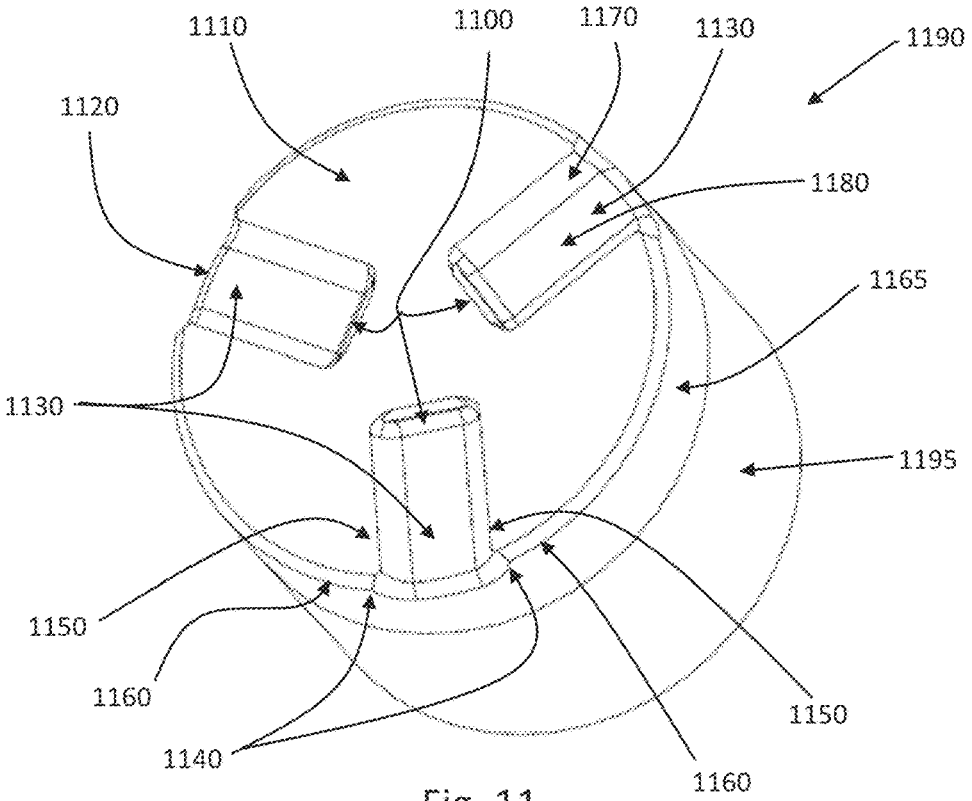
FIG. 11 is an isometric view of a PDC insert cutting element in accordance with an embodiment of the present disclosure, including a trough design that does not extend through the center of the element.

FIG. 11 depicts a PDC insert cutting element 1190, including diamond table 1165 on support 1195. Diamond table 1165 includes discrete troughs 1130. Troughs 1130 are radially symmetric about the center of the diamond table 1165, but do not extend through the center. The troughs 1130 extend from a secondary edge 1120 of the diamond table 1165 toward the center and have angled trough sidewalls 1170. The bottoms of troughs 1130 include secondary, lower cutting surface 1180. In some embodiments, the lower cutting surfaces 1180 are aligned to make direct contact with the rock formation during drilling operations.

The troughs 1130 include corner points 1140 positioned to create point loaded stress risers to initiate scoring and fracturing of formations during drilling operations.

The troughs 1130 include through top edges 1150. During drilling, with increased depth of cut, the trough top edges 1150 create a shearing stress riser edge to fracture the rock. Additionally, and optionally at the same time, the periphery edges 1120 of the troughs 1130 and the periphery edges 1160 of the diamond table 1165 function as shearing edges on the periphery of the cutting element 1190 and follow through to remove pre-fractured fragments and cuttings of the formation.

At the end of the troughs 1130, opposite the edges 1120, diamond table 1165 includes chip breaking features 1100. In this embodiment, the chip breaking features 1100 are sidewalls and edges between the primary upper cutting surface 1110 and the lower cutting surface 1180. During drilling operations, chip breaking features 1100 break up soft rock ribbon formations such that the soft rock is more easily disposed via the well bore annulus to the surface.

Figure 12:
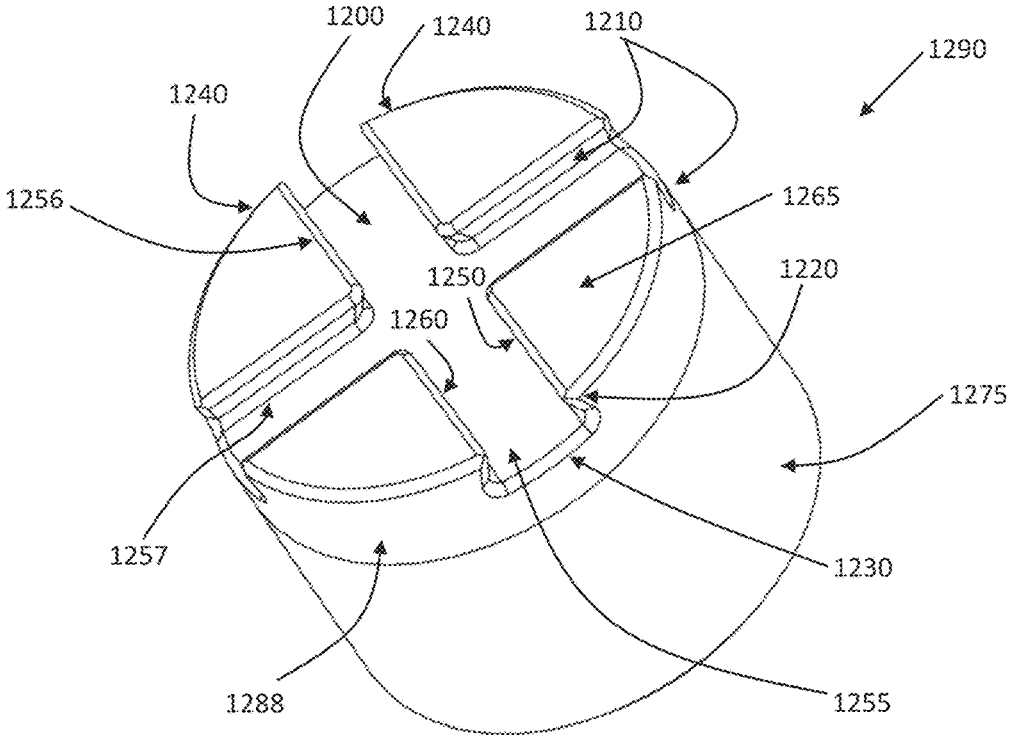
FIG. 12 is an isometric view of a PDC insert cutting element in accordance with the present disclosure, including a trough design with a positive rake.
Figure 13:
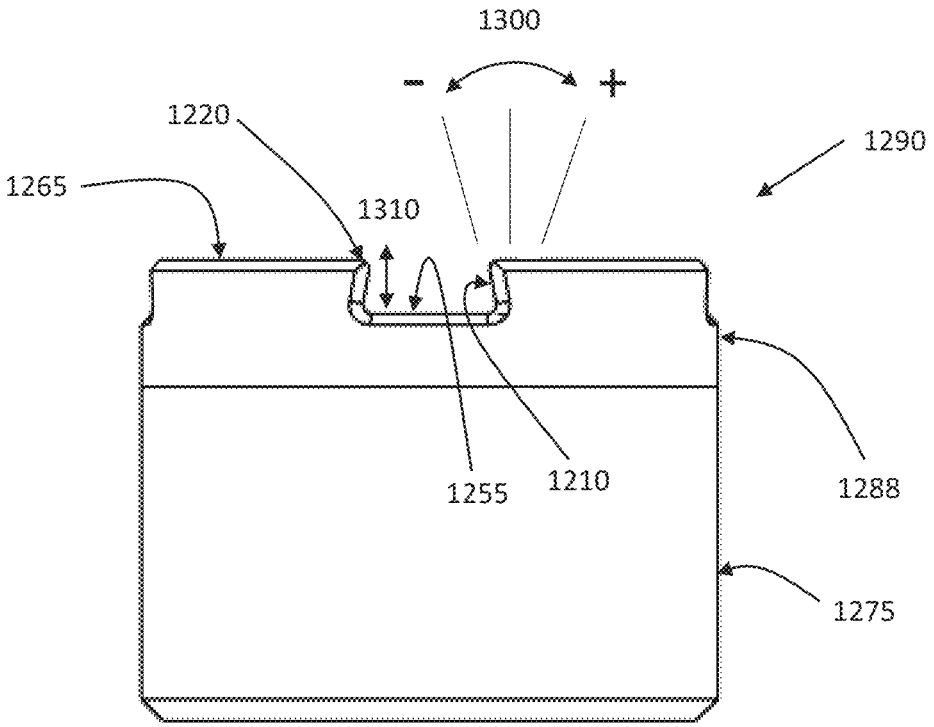
FIG. 13 is a side view of the PDC insert cutting element of FIG. 12 showing the positive rake side walls.
Figure 14:
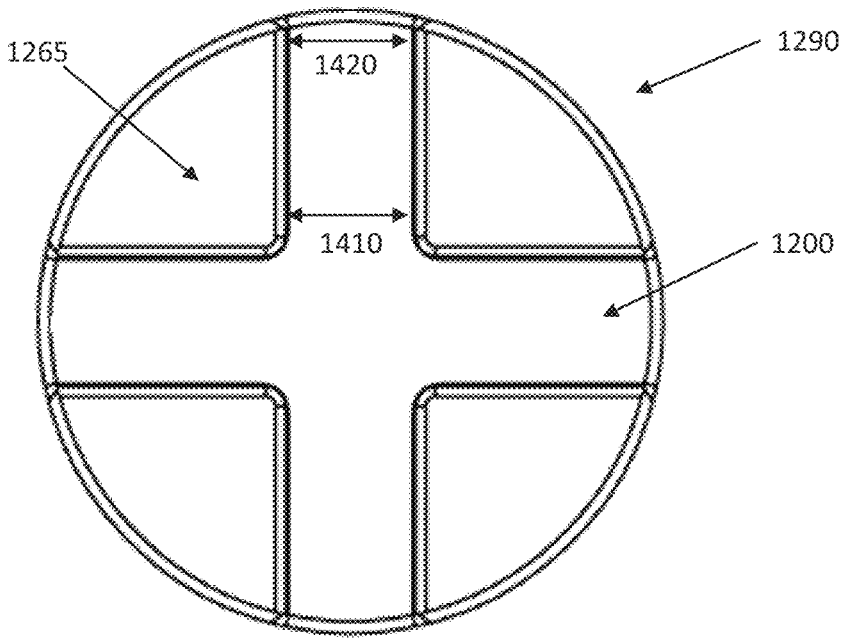
FIG. 14 is a top view of the PDC insert cutting element of FIG. 12.

FIG. 12 depicts a PDC insert cutting element 1290 with a trough 1200 designed to have trough sidewalk 1210 having a geometry with a positive angle (i.e., positive rake side walls). FIG. 13 depicts a side view of the cutting element 1290 of FIG. 12, and FIG. 14 depicts a top view of the cutting element 1290 of FIG. 12. With reference to FIGS. 12-14, cutting element 1290 includes diamond table 1288 supported on support 1275. Diamond table 1288 includes upper cutting surfaces 1265 with periphery edges 1240.

Trough 1200 is formed into the diamond table 1288, and includes sidewalls 1210, top edges 1256, bottom corner 1257, periphery edges 1230, and lower cutting surface 1255. The sidewalk 1210 are angled such that corners 1220 are formed at the top of the sidewalls 1210.

The angle 1300 of the sidewalls 1210 is indicated in FIG. 13 as a positive edge. Also shown in FIG. 13 is the depth 1310 of the trough 1200. While FIG. 13 shows the trough 1200 having a positive angle sidewall, the angles of the sidewalk of the troughs disclosed herein are not limited to being positive, and may be negative or neutral in other embodiments. As a non-limiting example, the angle 1300 may range from 45 degrees (positive) to 45 degrees (negative) from vertical. In some embodiments, the angle of the trough sidewalls varies as a function of radial position relative to the and periphery center of the cutting element diamond table. In some embodiments, opposing sidewalls in a trough have the same angle. In other embodiments, opposing sidewalk in a trough do not having the same angle. For example, the sidewalk 1250 and 1260 are opposing sidewalk of trough 1200 shown in FIG. 12. In some embodiments, one sidewall has an angle that creates a positive rake edge, and the opposing sidewall has an angle to creates a negative rake edge. In other embodiments, one sidewall has an angle that creates a positive or negative edge rake, and the opposing sidewall has an angle that creates a neutral rake edge. The trough depth 1310 may be the same over the entire diamond table 1288, or may vary (e.g., with radial distance relative to the center and periphery of the diamond table).

As shown in FIG. 14, trough 1200 has the shape or pattern of a cross. Trough 1200 has widths 1410 and 1420. The widths 1410 and 1420 of the trough 1200 may be the same throughout the trough 1200 or may vary. For example, the widths 1410 and 1420 may vary as a function of radial position or distance from the center of the diamond table 1288 or periphery 1240 of the diamond table 1288.

Figure 15:
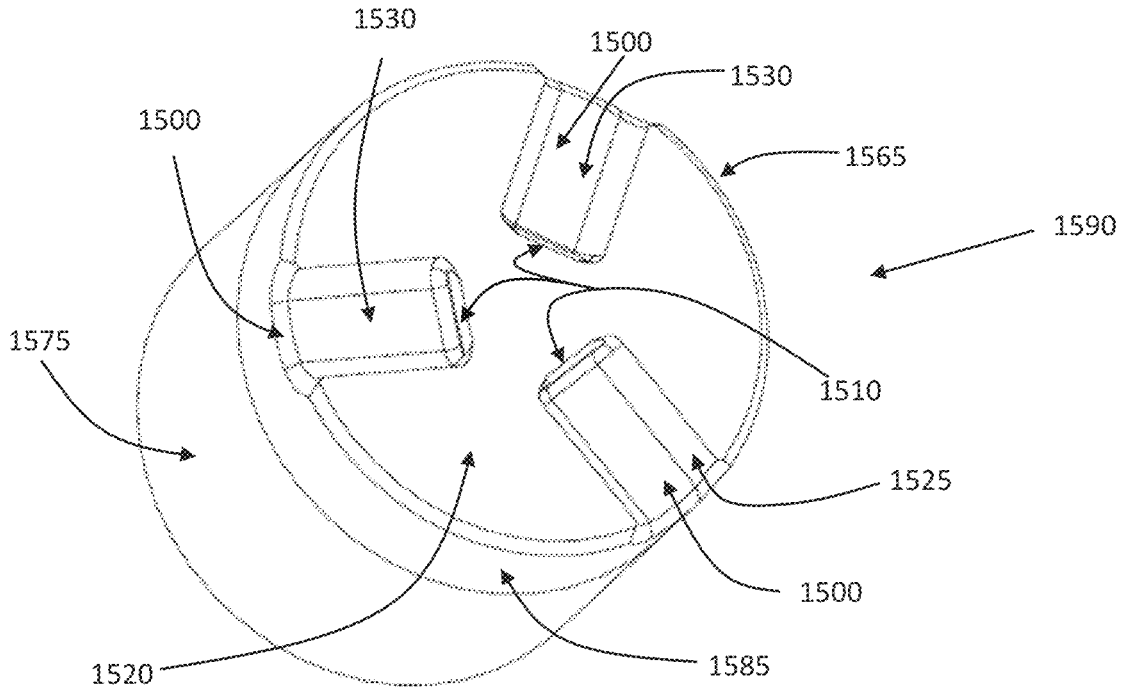
FIG. 15 is an isometric view of a PDC insert cutting element in accordance with the present disclosure, including a plurality of symmetrically distributed troughs having negative rake side walls, side walls with a radius form, and troughs that do not extend completely through the diamond table.

FIG. 15 depicts another exemplary PDC insert cutting element 1590. Cutting element 1590 includes diamond table 1585 supported on substrate 1575. Diamond table 1585 has upper cutting surface 1520. A plurality of symmetrically distributed troughs 1500 are formed into the diamond table 1585. The troughs 1500 do not extend completely through the center of the diamond table 1585. At the distal end of each trough 1500, opposite the periphery 1565 of the diamond table 1585, toward the center, cutting element 1590 includes chip breaker features 1510 that facilitates breaking of ribbon-like cuttings from formations, such as soft rock in confining conditions.

In some embodiments, the upper cutting surfaces 1520, lower cutting surfaces 1530 of troughs 1500, or combinations thereof are polished (e.g., mirror polished). The polishing of the lower cutting surfaces 1530 may facilitate the prevention of drill cuttings from sticking to the surfaces 1530. In some embodiments, the cutting surfaces 1530 are polished or textured (e.g., roughened) to facilitate turbulent fluid flow over the cutting element 1590 such that drill cuttings flush away more easily.

The troughs 1500 have negative rake sidewalls 1525 with a radius form. While the cutting element 1590 is shown as having three troughs, the cutting elements disclosed herein may have less than or more than three troughs. For example, the cutting elements may have at least one trough or a plurality of troughs depending on the particular application and the number of troughs that can fit in the diamond table.

Figure 16:
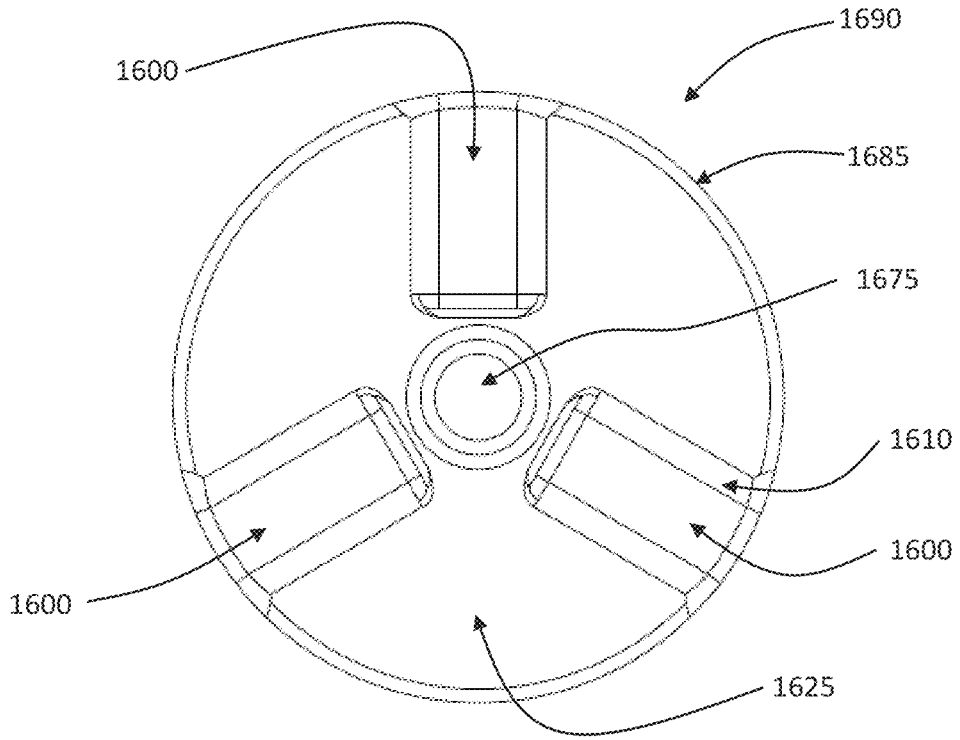
FIG. 16 is a top view of a PDC insert cutting element in accordance with the present disclosure, including a plurality of symmetrically distributed troughs, with negative rake, radius formed side walls, troughs that do not extend completely through the diamond, table, and with the diamond table having a concave center portion to reduce overall stiffness of the diamond table to improve residual stress state.

FIG. 16 depicts a PDC insert cutting element 1690 having a plurality of symmetrically distributed troughs 1600 below the upper cutting surface 1625 of the diamond table 1685. The troughs 1600 have negative rake sidewalls 1610 with a radius form, and do not extend through the center of the diamond table 1685. The diamond table 1685 has a concavity 1675 at the center of the diamond table 1685. The concavity 1675 (concave center portion) reduces overall stiffness of the diamond table 1685, improving residual stress state of the diamond table 1685. The concavities disclosed herein are not limited to being circular in shape, such as concavity 1675, and can have other shapes that reduce the bulk stiffness of the diamond table 1685 to promote increased cutter durability. The concavity 1675 may also facilitate increased penetration of acid into the diamond table 1685 if the diamond table 1685 is leached to improve thermal performance. In other embodiments, instead of a concavity positioned at the center of the diamond table, the diamond table includes a convexity at the center, such as a protuberance or raised section. In some such embodiments, the convexity functions as a pick feature. Cutting element 1690 can be positioned on a bit by rotationally aligning or mounting the element 1690 for maximum rock formation contact on a trough feature. More specifically, after extended wear of the cutter edge, the resultant wear flat will generally align with or be on a trough feature.

Figure 17:
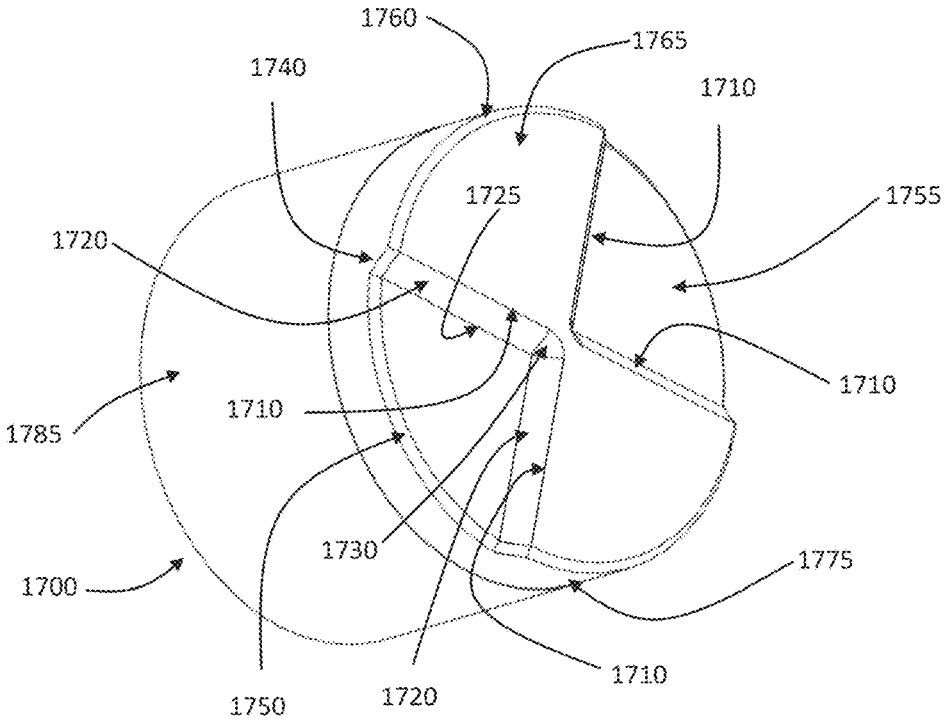
FIG. 17 is an isometric view of a PDC insert cutting element in accordance with the present disclosure, including a step feature and negative rake transition between diamond table planes.

FIG. 17 depicts a PDC insert cutting element have a step-feature and negative rake transition between planes/surfaces of the diamond table. Cutting element 1700 includes support 1785 and diamond table 1775. Diamond table 1775 has a plurality of step features including sidewalls 1720, top edges 1710, bottom edges 1725, and corners 1730. The step features of FIG. 17 are radially positioned round the face of the diamond table 1775. While shown as including a four step features, other embodiments include less than four step features, such as one step feature, or more than four step features. While the step features are positioned symmetrically about the center of the diamond table 1775, in other embodiments the step features are not positioned symmetrically about the diamond table. The step features disclosed herein may vary in shape and surface contour.

The sidewalls 1720 extend between one of the upper cutting surfaces 1765 and one of lower cutting surfaces 1755 of the diamond table 1775. The sidewalls 1720 may be angled relative to the face of the adjacent top surface 1765. The step feature side walls 1720 can be at an acute angle, a 90-degree angle, or an obtuse angle relative to the plane of the adjacent surface 1765. The angles of the sidewall 1720 may be constant or may vary between proximal end 1740 and the distal end (at inner corner feature 1730). Additionally, the sidewalls 1720 may have straight, curved, stepped, or any combination of surface contours between surfaces 1765 and 1755.

The inner corner feature 1730 functions as a transition point between two adjacent sidewalls 1720 to minimize corner stress riser potential. Inner corner feature 1730 can be shaped to function as a chip breaker or to promote fluid flow and cuttings removal to minimize debris buildup during drilling operations.

The cutting element 1700 can be positioned on a bit by rotationally aligning or mounting the cutting element 1700 to achieve maximum rock formation contact on one or more of the step features 1710. After extended wear of the cutting edge, the resultant wear flat will generally align with or be on one or more of the step features 1710.

Polycrystalline diamond is typically stronger in compression loading than in tensile loading. In some embodiments, the step features disclosed herein provide for increased strength for both diamond table face loading (e.g., loading on surfaces 1765 and 1755) and lateral side loading (e.g., loading on sidewalls 1720) in comparison to a diamond table having a positive relief protuberance (i.e., a protuberance that is raised above the surrounding portions of the diamond table and is less supported by the surrounding bulk mass of polycrystalline diamond). Additionally, a positive relief protuberance is more vulnerable to lateral forces than the step features disclosed herein due to the potential for localized corner tensile stresses generally near the root or corner of the protuberance. Lateral movement of a cutting element and/or drill bit can be induced by drilling vibrations, whirling, side rake angles, drilling action changes between slide and rotate mode drilling, and rotary steerable push-the-bit steering influences. Embodiment of the diamond tables disclosed herein, having a step feature, are less vulnerable to breakage because the step feature does not stand raised above relative to the overall topmost diamond table surface (e.g., surface 1765). The step features disclosed herein are less exposed to direct lateral forces than positive relief protuberances, and the step features are better supported by the surrounding bulk diamond table.

The step features induce a load stress differential at the step edge as the face of the cutting element 1700 makes contact with rock formation. The step features promote rock fracturing while also allowing the entire radial sector area represented by the depth of cut to shear and remove cuttings.

In embodiments where the step features have sidewalk with an obtuse angle (i.e., a negative rake), the step features are more durable for the hard or impact prone conditions. In embodiments where the step features have sidewalls with an acute angle (i.e., a positive rake), the step features are more aggressive for fracturing certain kinds of rock. In embodiments where the step feature sidewalls are straight (i.e., 90 degrees, or neutral rake), the step features perform in a middle range between high durability and fracturing ability. In some embodiments, cutting soft rock with a step feature having sidewalls with a neutral rake generally have no deleterious effect such that the cutting element drills at least as efficiently as a standard round cutting element with no step features. In some embodiments, cutting hard rock with a step feature having sidewalks with a neutral rake provides enhanced fracturing of rock in addition to the ability to remove volumes of rock.

In some embodiments the proximal end 1740 of the step features are aligned to make primary contact with the rock formation while drilling. The edge geometry of the proximal ends 1740 can be sharp, rounded or beveled. The edge geometry of the periphery edges 1750 and 1760 of the diamond table 1775 can also be sharp, rounded, or beveled.

Figure 18:
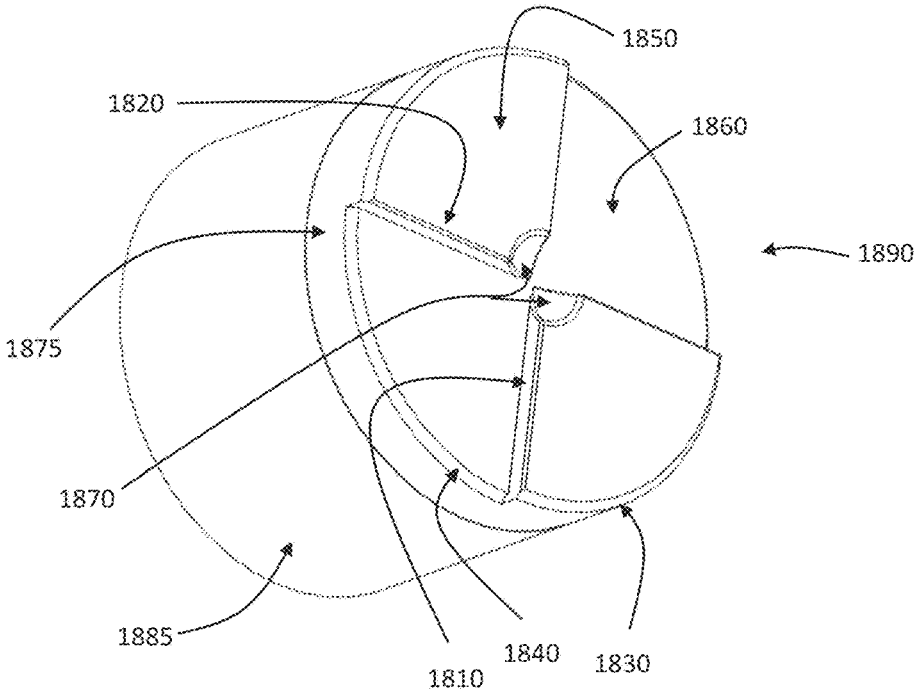
FIG. 18 is an isometric view of a PDC insert cutting element in accordance with the present disclosure, including a step feature and a neutral rake transition between diamond table planes and center region removed to create chip breaking feature.

FIG. 18 depicts a PDC insert cutting element having a step feature and neutral rake transition between diamond table planes and a center region removed to create chip breaking feature. Cutting element 1890 includes support 1885 and diamond table 1875. Diamond table 1875 includes upper cutting surfaces 1850 and lower cutting surfaces 1860. Step features sidewalk 1810 extend between the surfaces 1850 and 1860, and have a neutral rake. The top edges 1820 of the step features have an edge geometry that is at least partially touched off (e.g., via grinding to remove micro artifacts). In other embodiments, the edge geometry of the step features is sharp, rounded, brush honed, or otherwise prepared to minimize stress risers or fracture initiation points. The periphery edges 1830 of upper cutting surfaces

1850 and the periphery edges 1840 of the lower cutting surfaces 1860 can each have an edge geometry that is beveled. In other embodiments, the edges 1830 and 1840 can be sharp, touched off, rounded, or brush honed. Each of the surface 1850 and 1860 can be polished, roughened, or textured.

Cutting element 1890 includes transition surface features 1870, which serve as transition surfaces between surfaces 1850 and surfaces 1860. During drilling operations, transition surface features 1870 function as separators that allow open communication of fluid between the surfaces 1850 and 1860. The transition surface features 1870 minimize the potential balling or collecting of mud in the center of the diamond table 1875. Additionally, the transition surface features 1870 minimize the potential for erosion or cavitation by the cuttings or mud fluid. The transition surface features 1870 disclosed herein are not limited to the particular shape, contour, or symmetry shown in FIG. 18.

Figure 19:
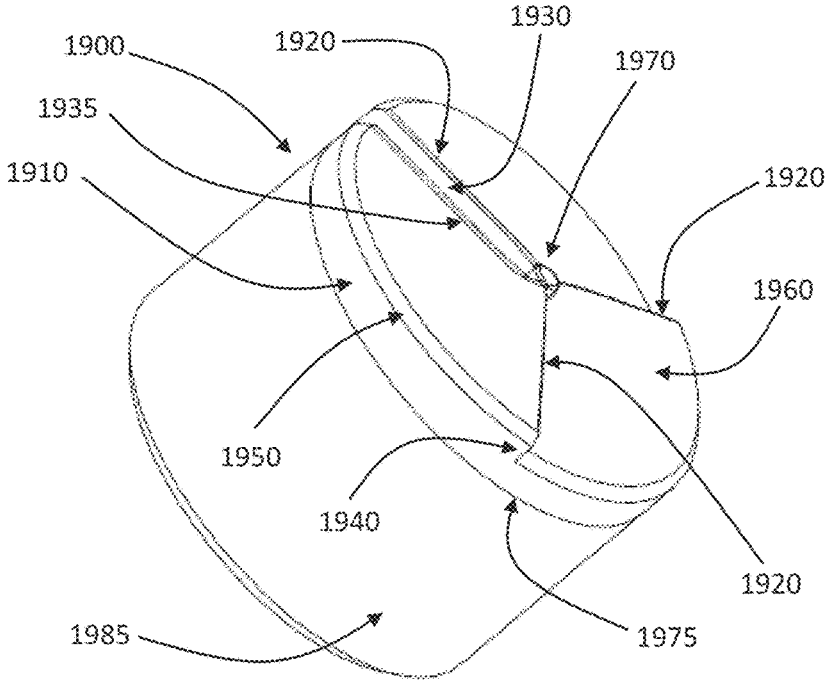
FIG. 19 is an isometric view of a PDC insert cutting element in accordance with the present disclosure, including a step feature and radially contoured surfaces.

FIG. 19 depicts a PDC insert cutting element having a step feature with radially contoured surfaces. Cutting element 1900 includes diamond table 1910 on support 1985 at interface 1975. The step features include a top edge 1920, sidewall 1930, and bottom edge 1935. The step features are formed into the diamond table 1910 and have a neutral rake transition between the planes of upper cutting surfaces 1960 of the diamond table 1910. The diamond table 1910 includes a plurality of the upper cutting surfaces 1960, which are contoured surfaces including the step features therebetween. While shown as including three step features, the cutting elements disclosed herein may include more or less step features the same as or similar to those shown in FIG. 19.

The sidewalk 1930 of the step features may have an acute angle (i.e., less than 90 degrees), a neutral angle (i.e., 90 degrees), or an obtuse angle (i.e., greater than 90 degrees). The step features may be distributed radially about the center of the cutting element 1900 in a symmetric pattern (as shown in FIG. 19) or in an asymmetric pattern. The sidewalls of the step features may all have the same angle (as shown in FIG. 19) or may have different angles. The sidewalls may all have the same height (as shown in FIG. 19) or may have different heights.

In embodiments of use of the cutting element 1900, an outer step edge 1940 of the step features is aligned in the same location as where the wear flat is expected to be formed after an extended period of cutting. In such embodiments, the step feature promotes fracturing of harder rock formations and the larger shearing edge regions on each side of the step feature shears rock. The angled taper provides two directions of rock shearing. In an alternative embodiment of use of the cutting element 1900, the cutting element is aligned to generate wear flats in a non-step area, such as a periphery edge 1950 of an upper cutting surface 1960, thus taking advantage of alternative cutting properties and/or increasing the number of re-uses of the cutting element for maximum usage efficiency by re-brazing rotations.

The tapered cutting surfaces 1960 may taper in a radial direction from the periphery 1950 to the center of the cutting element 1900, taper in a circumferential direction about the center of the cutting element, or combinations thereof. In embodiments in which the tapered cutting surfaces 1960 taper in both radial and circumferential directions, step sidewalls 1930 differ in height as a function of radial position between the periphery 1950 and center of the cutting element 1900.

The slope of tapered cutting surfaces may be directed clockwise or counterclockwise in the radial distribution of such surfaces. In some embodiments, the direction (clockwise and counterclockwise) and/or angle of the slopes of such tapered surfaces alternates and is different at different radial positions on the cutting element.

When deployed, a plurality of the cutting elements 1900 may be positioned on a bit to create different cutting effects. For example, a pair of the cutting elements having radially tapered surfaces that taper in opposite directions (clockwise and counterclockwise) may be positioned in close proximity to each other on a bit or bit blade, such that a lateral counteracting force or self-cancelling counterforce is induced, stabilizing the bit. Such a stabilizing effect may be achieved without the need to design the bit with side angled pockets or in other words cutters positioned or attached to the bit with a side rake angle.

In some embodiments of a bit, an entire row of cutting elements on a first blade have radially tapered surfaces directed in a clockwise direction, and an opposing second blade has an entire row of cutting elements that have radially tapered surfaces directed in a counterclockwise direction. Such an arrangement of cutting elements on blades of a bit provide an aggregate counterforce effect between the two opposing blades without requiring a bit to be designed to have cutter pockets containing a side rake. Cutting elements having radially directed, angled steps on the diamond surface can provide enhanced rotating capability for rotating cutter designs, such as the commercially available Enduro 360 rolling cutting element offered by Schlumberger, without requiring a side rake for the cutter to rotate.

Cutting element 1900 includes center feature 1970. Center feature 1970 is a flat surface. In some embodiments, the center feature may be in the form of a cylinder or dome. The center feature 1970 is a surface configured to provide a common boundary between adjacent non-planar surfaces. For example, center feature 1970 may blend, merge, or smooth out potential sharp edges of the surfaces 1960 and walls 1930 that might induce a stress riser.

Figure 20:
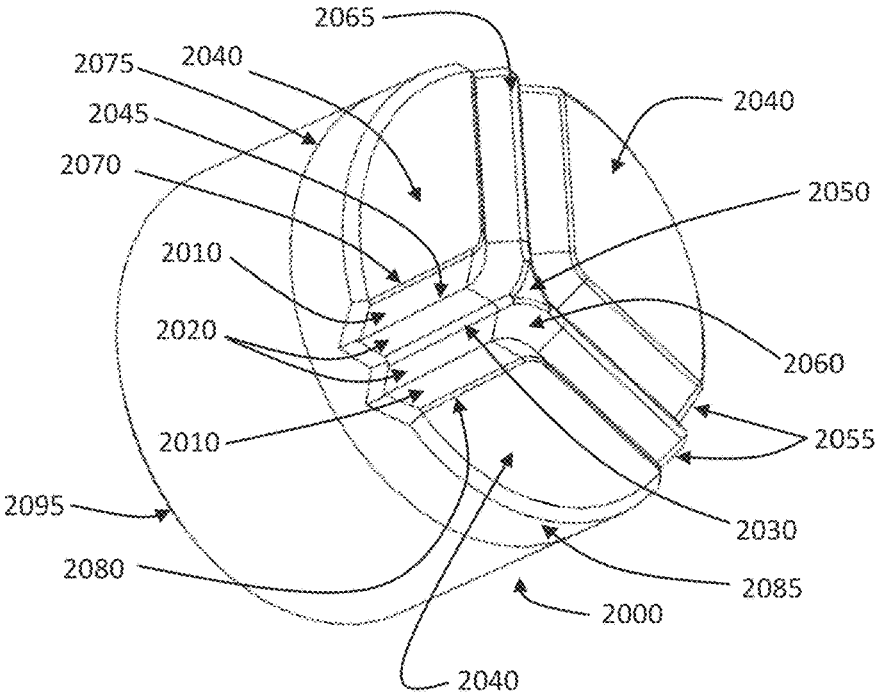
FIG. 20 is an isometric view of a PDC insert cutting element in accordance with the present disclosure, including multiple grouped step features with negative rake angle side walls symmetrically positioned on the cutter face.

FIG. 20 depicts a PDC insert cutting element having multiple, grouped step features with negative rake angle sidewalls that are symmetrically positioned on the face of the cutting element. Cutting element 2000 includes support 2095 and diamond table 2085.

Diamond table 2085 includes upper cutting surfaces 2040. The diamond table 2085 has a plurality of step features formed therein, including inner step sidewalls 2010 and outer step sidewalls 2020 that, together, form troughs 2055. The step sidewalls 2010 and 2020 may extend at angles that are obtuse, acute, or at ninety degrees relative to the surfaces 2040 and/or the interface 2075.

Diamond table 2085 includes ridges between adjacent sidewalls 2020. Each ridge includes a ridge upper surface 2030 that is at a higher elevation than a trough base 2045. Ridge upper surfaces 2030 may vary in width. For example, ridge upper surfaces 2030 may have a width of from about 0.010 inches to about 0.150 inches. In some embodiments, ridge upper surfaces 2030 are flush with primary upper cutting surfaces 2040. In other embodiments, ridge upper surfaces 2030 are not flush with upper cutting surfaces 2040. For example, ridge upper top surfaces 2030 may be positioned lower than upper cutting surfaces 2040. In some embodiments, the ridge upper top surfaces 2030 may be parallel or coplanar with the 2040 plane surface. In other embodiments, ridge upper surfaces 2030 extend in a plane that is at an angle of up to 45 degrees relative to the surfaces 2040.

Each of the corners and edges (e.g., edges 2065, 2070, and 2080) of the step surfaces 2010 and 2020 may be sharp, chamfered beveled, rounded, or brush honed to minimize stress risers. In some embodiments of use during drilling, the center point between edge 2070 and edge 2080 is aligned, or at least approximately aligned, in the center position of where the cutter wear flat is expected to form.

Cutting element 2000 includes central top surface 2050 and central corner surface 2060. Central surface 2050 may have a shape configured such that central surface 2050 functions as a transition surface between the multiple troughs 2055. Central corner surface 2060 forms a corner between two adjacent step sidewalk 2020. Central corner surface 2060 forms a radius to act as a chip breaking feature of cutting element 2000 to promote efficient removal of soft rock formation and to minimize potential for the accumulation of rock cuttings in geometric pockets or corners located generally in the center of the diamond table 2085.

Figure 21:
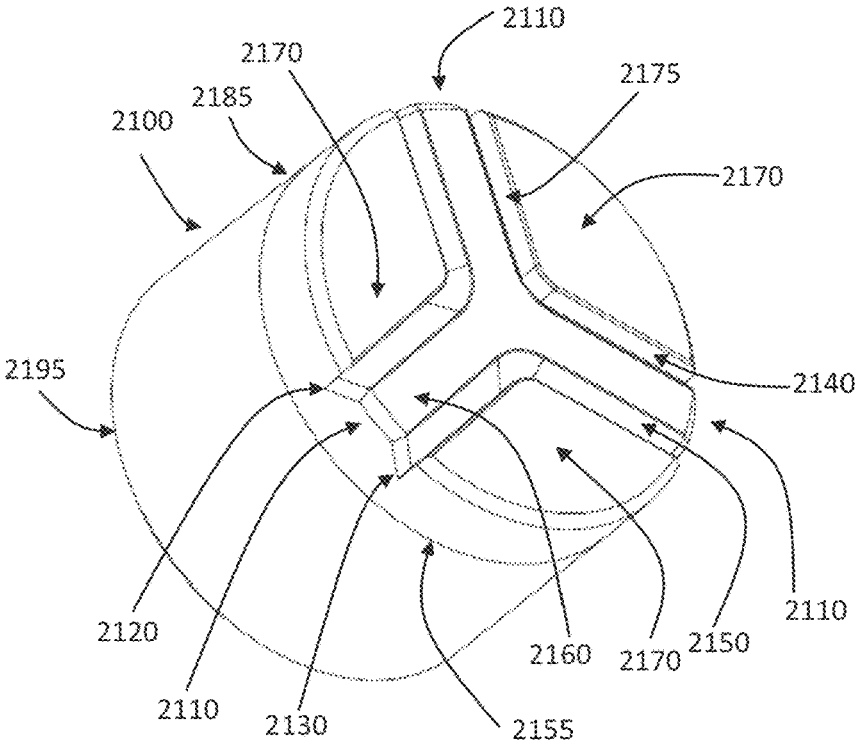
FIG. 21 an isometric view of a PDC insert cutting element in accordance with the present disclosure, including multiple grouped step features having both neutral and negative rake side walls, with groups symmetrically positioned on the cutter face.

FIG. 21 depicts a PDC insert cutting element having multiple grouped step surfaces having both neutral and negative rake sidewalls, with the surfaces symmetrically positioned on the face of the cutting element. Cutting element 2100 includes support 2195 and diamond table 2185.

Diamond table 2185 includes upper cutting surfaces 2170 and upper ridge surface 2160. Troughs 2175 are positioned between the upper ridge surface 2160 and each of the upper cutting surfaces 2170. The troughs 2175 are defined, at least in part, by sidewalls 2140 and 2150. Sidewalls 2140 and 2150 joint at bottom edges of trough, indicated at 2120 and 2130. Between the troughs 2175 is the ridge 2110, which extends above the troughs 2175 and includes upper ridge surface 2160. The ridge 2110 extends from the center of the cutting element 2100 to the circumferential edge (periphery) of the cutting element 2100. The ridge 2110 is, at least partially, defined by the two troughs 2175 on either side of the ridge 2110.

In some embodiments, the surface 2160 is configured to have a width of from about 0.010 inches to about 0.200 inches. The surface 2160 may be configured to have a height that is coplanar with the surfaces 2170, or the surface 2160 may be recessed to a lower height than the surfaces 2170. The surface 2160 may also vary in height in the radial direction from the periphery to the center of the diamond table 2185, in the circumferential direction about the center of the diamond table 2185, or combinations thereof.

As shown, the pattern of troughs 2175 and ridge 2110 is symmetrical. However, the troughs and ridges disclosed herein may have unsymmetrical patterns. Also, while shown as having a single ridge, the cutting elements disclosed herein may have more than one ridge.

In the depicted embodiment, sidewall 2140 is at a 90-degree angle relative to the plane defined by interface 2155, and sidewall 2150 is at 45-degree angle relative to the plane of interface 2155. However, the sidewalls of the troughs and ridges disclosed herein may have other combinations of angles (e.g., obtuse, acute and/or 90-degree angles) configured to create the desired shearing differentials in the diamond table and diamond table edges.

Each edge on the diamond table 2185 of the cutting element 2100 may be sharp, rounded, honed, chamfered, or otherwise prepared to remove potential stress risers.

In some embodiments, during drilling, the center point between edges 2120 and 2130 is aligned approximately in the center of the expected location of cutter wear flat.

Figure 22:
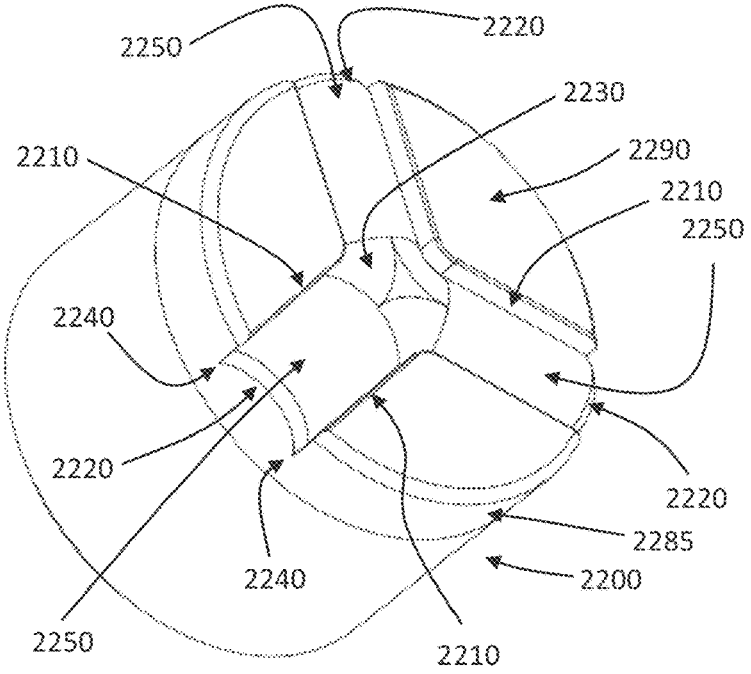
FIG. 22 is an isometric view of a PDC insert cutting element in accordance with the present disclosure, including both neutral rake side walls and radius center feature with groups symmetrically positioned on the cutter face.

FIG. 22 depicts a PDC cutting element having both neutral rake sidewalls and radius center features symmetrically positioned on the face of the cutting element. Cutting element 2200 includes diamond table 2285 supported on support 2295. Diamond table 2285 includes upper cutting surfaces 2290. Sidewalls 2210 form step features in the diamond table 2285. Positioned between the sidewalls 2210, and at least partially below the surfaces 2290, is raised surface feature 2220. Similar to ridge 2110 shown in FIG. 21, raised surface feature 2220 rises above edge (or root) 2240 of sidewalls 2210. However, raised surface feature 2220 has a radiused top surface that peaks at apex 2250.

The size and shape of the raised surface feature 2220 may be varied depending on the particular application. For example, a raised surface feature having a small radius may be used to create a more concentrated or higher point loading condition in harder rock formations to promote rock fracturing. Alternatively, a raised surface feature having a larger radius may be used to create a less concentrated or reduced point loading condition for softer rock formations to promote higher volume shearing. In some embodiments, the radiused top surface of raised surface feature 2220 is more durable than a scribe tip, upright diamond ridge, or a diamond point. In some embodiments, the raised surface feature 2220 is convex, or a transition between convex and concave. For example, the raised surface may transition between convex and concave as a function of circumferential position on the cutting element 2200, as a function of the drilling application, or combinations thereof.

Center surface 2230 functions as a transition surface having a geometry configured to merge the pattern of raised surface feature 2220 with the central axis of the cutting element 2200 to minimize sharp corners. In some embodiments, center surface 2230 functions as a chip breaker feature. During drilling, apex 2250 of the curved radius, raised surface feature 2220, which is positioned between both edges 2210, is aligned approximately in the center of where the cutting element 2200 is expected to have a wear flat after an extended period of drilling or rock cutting. Embodiments of the raised surface feature 2220 having a relatively smaller radius exhibit more aggressive fracturing of hard rock due to point loading, while embodiments of the raised surface feature 2220 having a relatively larger radius provides the cutting element 2200 with greater durability.

In some embodiments, the curvature of the raised surface feature 2220 enhances the ability of the cutting element to withstand compressive load in the diamond table 2285 and face loading threes generated by the drill bit rotation. Additionally, in drilling applications where excessive torque forces or impact loads are encountered by the cutting element 2200, the shape of the diamond table 2285 is configured to direct any fractures that form in the diamond table 2285 to propagate along the roots 2240 in a controlled manner. Thus, the shape of the diamond table 2285 is configured to avoid, or at least reduce, relatively uncontrollable, unpredictable, or catastrophic fracturing of the entire diamond table 2285.

As depicted, the raised surface feature 2220 is a radially curved surface that has a symmetrical shape and pattern, and that extends to the circumferential edge of the element 2200. However, the raised surface features disclosed herein are not limited to this particular shape and pattern.

Figure 23:
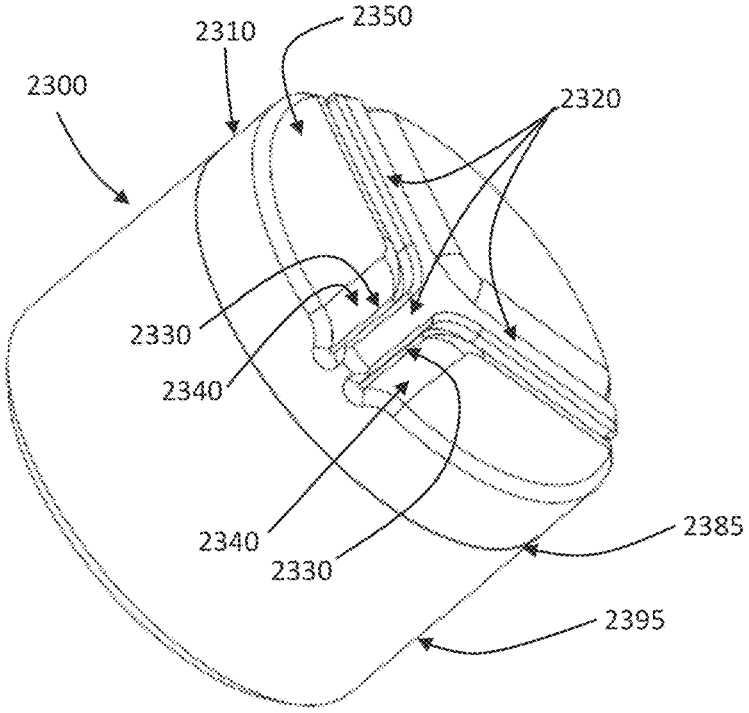
FIG. 23 is an isometric view of a PDC insert cutting element in accordance with the present disclosure, including negative rake and radiused outer side walls, and straight, neutral rake inner step walls grouped symmetrically on the cutter face.

FIG. 23 depicts a cutting element 2300. Cutting element 2300 is similar to cutting element 2100 shown in FIG. 21 but has troughs with radiused outer side walls and straight, neutral rake inner step walls that are grouped symmetrically on the cutter face. Cutting element 2300 includes integrated diamond table 2310 supported on support 2395.

Diamond table 2310 has a symmetric trough patterned surface with predominant diamond table surfaces 2350 and scribe features 2320. The scribe features 2320 have scribe side walls 2330 and 2340 that are at a 90-degrees in reference to the predominant interface plane 2385. In other embodiments, the outer side walls may be non-radius surfaces or generally planar surfaces.

The top surface of the scribe feature 2320 may be generally planar with the predominant diamond table surface, upper cutting surfaces 2350, or may be recessed to a lower level (i.e., closer to plane 2385) than the surfaces 2350. The scribe feature 2320 extends contiguously through the center of the diamond table 2310. However, the diamond tables disclosed herein may include scribe features that do not extend contiguously through the center thereof. One or more of the edges and corners of the diamond table 2310 may be beveled.

During use in drilling, one of the scribe features 2320 is aligned or approximately aligned in the center of the location where the cutting element is expected wear flat after an extended period of drilling or rock cutting. The symmetry of the surface pattern of the diamond table 2310, including the number of scribe features 2320 distributed on the face of the diamond table 2310, may function as a position guide for the number of rotations or reuses of the cutting element.

Figure 24:
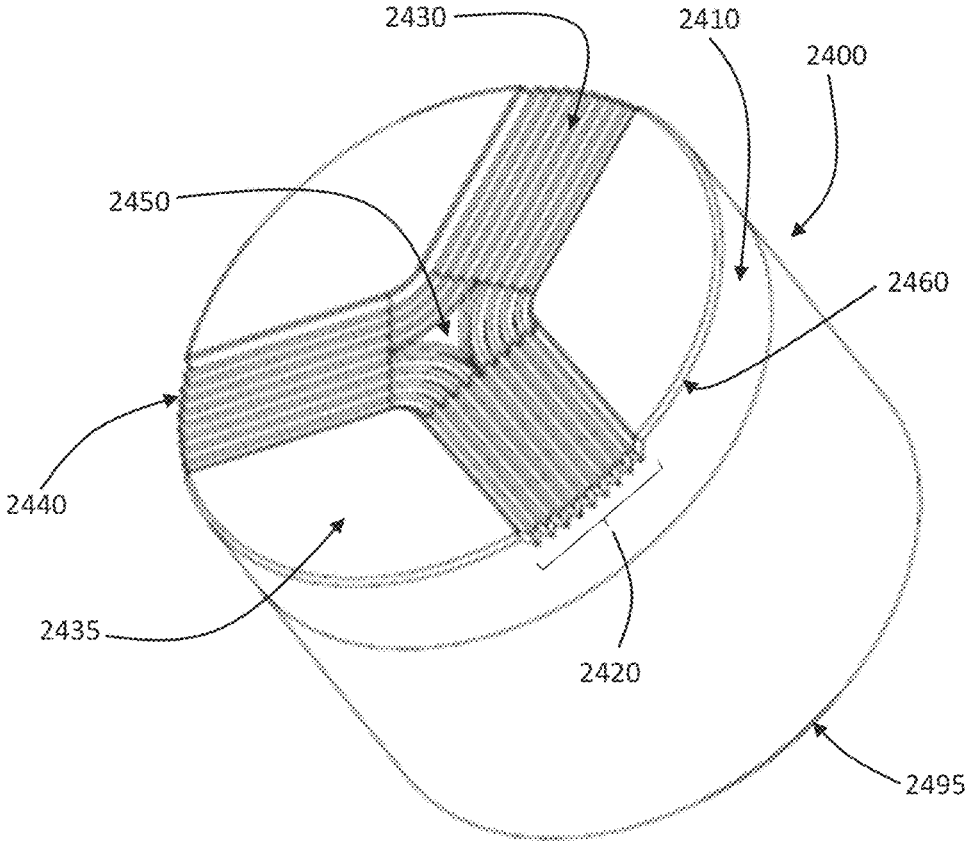
FIG. 24 is an isometric view of a PDC insert cutting element in accordance with the present disclosure, including sharp edged, small longitudinal step features patterned symmetrically on the diamond table face.

FIG. 24 depicts PDC cutting element 2400, including an integrated diamond table 2410 supported on support 2495. The diamond table 2410 includes upper cutting surfaces 2435 and a pattern 2430 of a plurality of symmetrically arranged surface radial spoke features 2440. Each of the plurality of spoke features 2440 of the pattern 2430 forms a sharp-edged, small longitudinal step in the surface of the diamond table 2410. Each spoke feature 2440 extends proximate a center 2450 of the diamond table 2410 out to a circumferential edge 2460 of the diamond table 2410. While shown as having a plurality of the radial spoke features 2440, the diamond tables disclosed herein may include only one radial spoke feature. The patterns of spoke features may include a plurality of longitudinal surface variations that are generally in the thrift of a sawtooth pattern, sinewave pattern, half-sine wave pattern, square wave pattern, staircase pattern, or combinations thereof. In the embodiment of FIG. 24, the longitudinal surface variations of the pattern 2430 are not chamfered, and are generally sharp. However, in other embodiments, these and other edges and corners of the cutting elements disclosed herein may be beveled, honed, knocked off, or rounded to minimize stress risers.

During use in drilling, the radial spoke features 2440 of the pattern 2430 may be aligned or approximately aligned at a location where the cutting element 2400 is expected to wear flat after an extended period of drilling or rock cutting. The pattern 2430 may have a width 2420 that ranges from approximately 25% to 100% of the width of a largest expected potential wear flat scar after drilling. The symmetry of the surface pattern 2430, including the number of spoke features 2440 distributed on the face of the diamond table 2410, may function as a position guide for the number of rotations or reuses the cutting element 2400.

The pattern 2430 of spoke features 2440 may be formed by laser oblation, use of a pattern formed refractory can in the HP/HT sintering press, use of a pre-formed or stamped refractory coin inserted in the can in the HP/HT sintering press, use of an expendable ceramic mold within the refractory can, wire EDM, plunge EDM, use of a waterjet, or diamond grinding.

In some embodiments, the relatively small longitudinal surface variations of the pattern 2430 provides localized load concentrations that promote rock fracturing while providing an overall volume shearing action across the entire face of the diamond table 2410, such as during deeper depths of cut. In some embodiments, the relatively small longitudinal surface variations of the pattern 2430 provide preferential fracturing of high compressive strength rock while being able to accommodate lower compressive strength rock by allowing relatively large volumes of rock to be removed with deep depths of cut.

Figure 25:
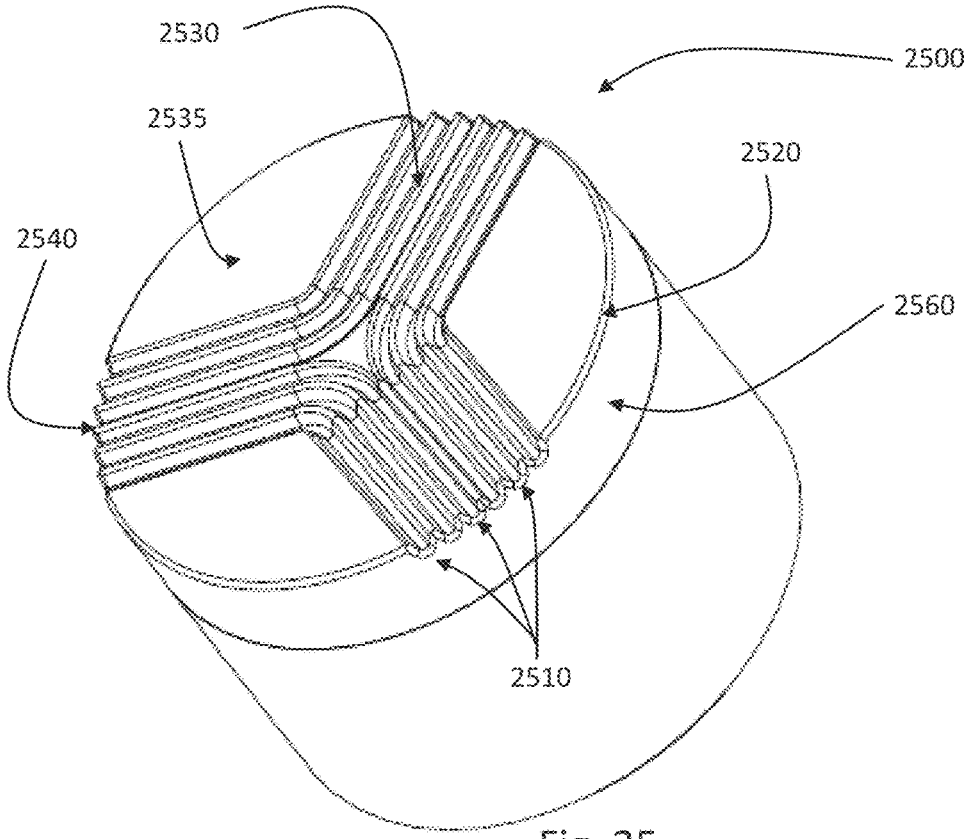
FIG. 25 is an isometric view of a PDC insert cutting element in accordance with the present disclosure, including rounded edges and small longitudinal step features patterned symmetrically on the diamond table face.

FIG. 25 depicts PDC cutting element 2500, which is similar to the cutting element 2400 shown in FIG. 24. Cutting element 2500 includes upper cutting surfaces 2535. In cutting element 2500, the pattern 2530 includes spoke features 2540 that have rounded edges and relatively small longitudinal step features that are patterned symmetrically on the face of the diamond table 2560. Relative to the spoke features shown in FIG. 24, the small longitudinal surface variations of the pattern 2530 in FIG. 25 have a wider spacing between adjacent spoke features 2540 and the edges are beveled, including beveling at the intersection 2510 where the longitudinal extension of the spoke features 2540 intersects with the circumferential edge 2520 of the diamond table 2560 for increased durability.

Figure 26:
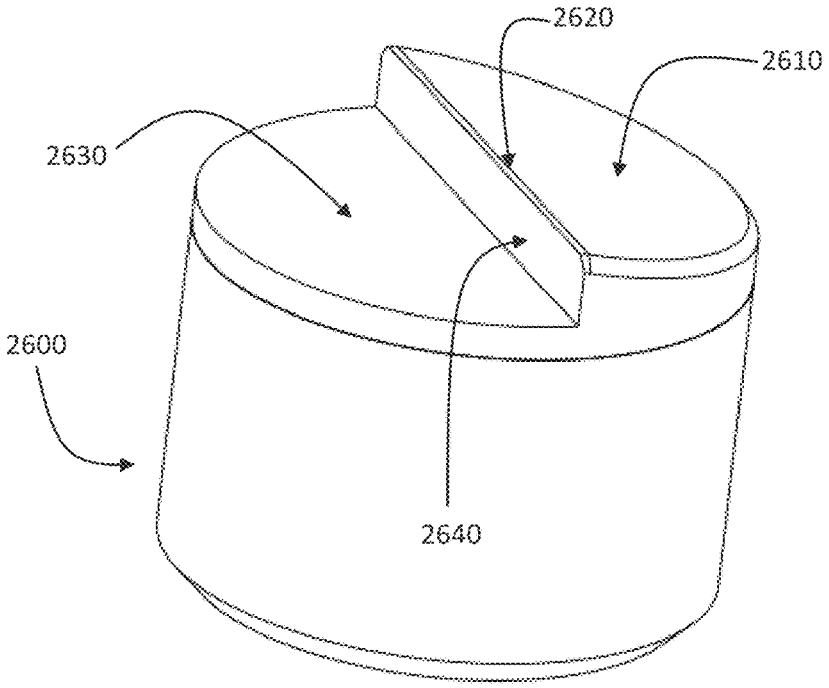
FIG. 26 is an isometric view of a cutter with a generally wedge-shaped geometry and a neutral rake step feature.

FIG. 26 depicts cutting element 2600 having a generally wedge-shaped geometry with a neutral rake step feature. The generally wedge-shaped geometry may be used to fracture and break rock. Cutting element 2600 includes top ridge 2610. Top ridge 2610 serves as a blunt point loading region to crush rock. Cutting element 2600 includes step edge 2620, which serves as a shearing edge to provide a load differential or more specifically a stress differential to fracture rock. Cutting element 2600 includes step feature sidewall 2640, which may be angled to create a negative rake, a neutral rake or positive rake. Cutting element 2600 includes flat surface 2630. Flat surface 2630 provides a shearing edge and flat surface area to increase rock volume removal, such as when softer rock formations are encountered during drilling.

The step edge 2620 is incorporated into the cutting element 2600 to promote three modes of rock destruction (i.e., three rock cutting modes: crushing, fracturing and shearing) for increased drilling performance adaptability, such as in formations that include regular transitions form layers of hard rock to layers of soft rock, or unpredictable stringers, or during higher ROPs in which larger volumes of cuttings need to be removed more efficiently. During use in drilling, the step edge 2620 may be generally aligned in a position where the cutting element 2600 is expected to wear flat at one of the tips or corners of the top ridge after an extended period of drilling or rock cutting.

Figure 27:
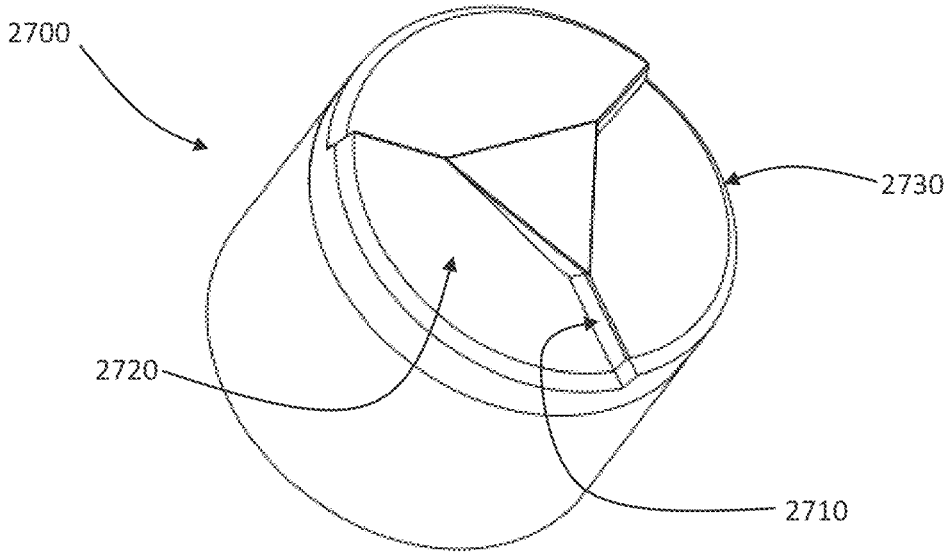
FIG. 27 is an isometric view of a non-planar surface type cutter with a generally faceted geometry and a neutral rake step feature with a radially variable thickness diamond table transition from the step.

FIG. 27 depicts cutting element 2700 having a generally faceted geometry and including a neutral rake step feature with a radially variable thickness diamond table transition from the step, Cutting element 2700 is generally cylindrical and includes a diamond table 2730 with a faceted surface.

The step feature sidewall 2710 in the diamond table 2730 provides additional rock cutting modes to the cutting element 2700. The step feature sidewall 2710 serves as a shearing edge to provide a load differential or stress differential to promote fracturing in hard rock.

The flat surface 2720 of the diamond table 2730 provides a predominantly shearing edge and flat surface area that increases rock volume removal efficiency of the cutting element 2700, such as in applications where softer rock formations are encountered.

During use in drilling, the step feature sidewall 2710 may be aligned or approximately aligned in a position where the cutting element 2700 is expected to wear flat after an extended period of drilling or rock cutting.

Figure 28:
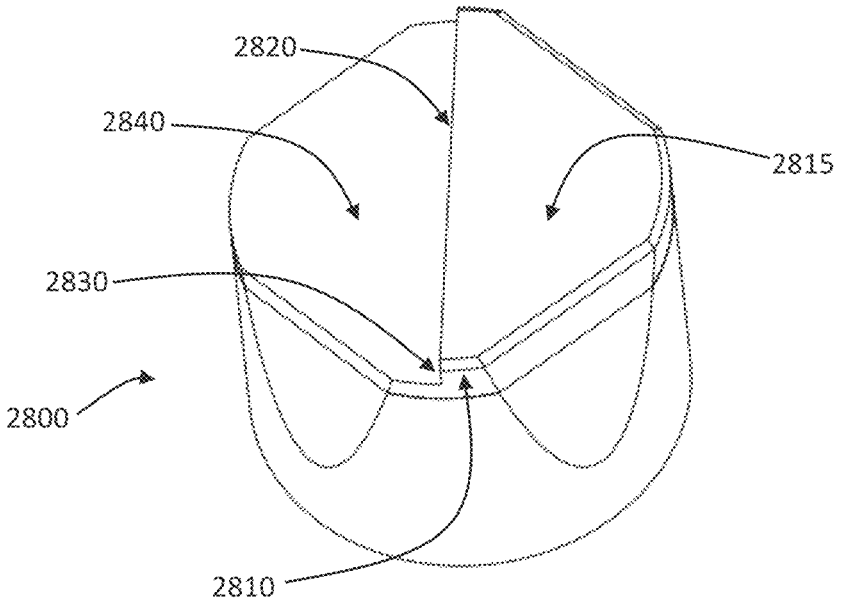
FIG. 28 is an isometric view of a scribe or scoring cutter including a neutral rake step feature.

FIG. 28 depicts a scribe or scoring cutting element 2800, including a neutral rake step feature. Cutting element 2800 may be, generally, used to scribe or score rock to promote fracturing of a rock formation. In one exemplary application, cutting element 2800 may be radially positioned, on a drill bit, in front of a cylindrical PDC cutter. For example, the cutting element 2800 may be used to initiate the fracture of a rock formation, after which the cylinder PDC cutter may be used to, primarily, shear and remove cuttings.

Cutting element 2800 includes upper surface 2815, tip 2810, step edge 2820, sidewall 2830, and lower surface 2840. In some embodiments, tip 2810 provides a scoring or scribing function to weaken rock formation being drilled, and step edge 2820 provides an additional localized stress differential on the face of the cutting element 2800 to more efficiently fracture the rock. Additionally, the step edge 2820 may also provide lateral stability or a steering tendency, depending on the bit design, the drilling application, and the rock formation type.

The shape and profile of the step feature of cutting element 2800 may be varied, such as by varying the height of the step edge 2820 (e.g., relative to the lower surface 2840), varying the angle of the sidewall 2830 (e.g., relative to the plane of the surface of the tip 2810), or combinations thereof. For example, the angle of the step edge sidewall may have a negative, neutral, or positive rake in reference to the predominant interface plane of the tip 2810.

During use in drilling, the step edge 2820 may be aligned or approximately aligned at a position where the cutting element 2800 is expected to wear flat after an extended period of drilling or rock cutting.

FIGS. 29A-29G depict cutting element 2900, including diamond table 2995 supported on support 2985. The diamond table 2995 includes upper cutting surface 2910 and lower cutting surface 2920. Upper cutting surface 2910 is in the form of a cross, with the points of the cross extending to the circumferential edge 2930 of the diamond table 2995. Upper cutting surface 2910 includes edges 2960 and corners 2940, which may be beveled.

Figure 29A:
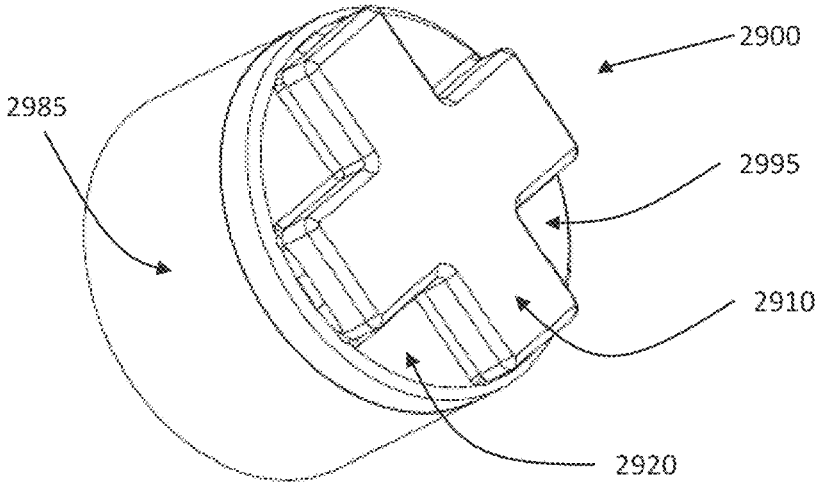
FIG. 29A is a top, perspective view of a PDC insert cutting element in accordance with the present disclosure.
Figure 29B:
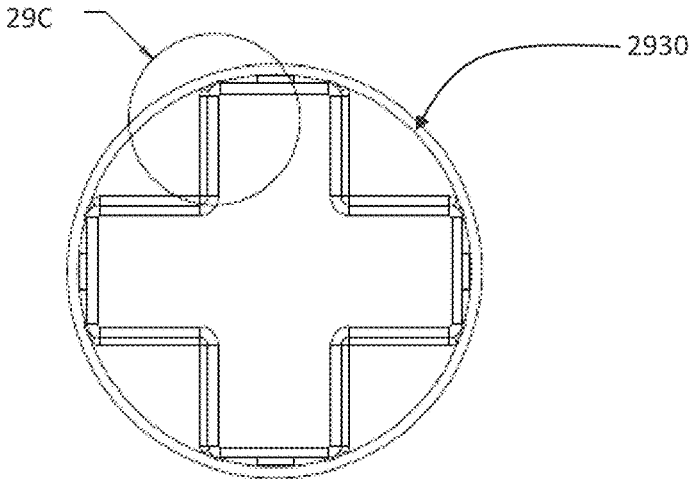
FIG. 29B is a top view of the PDC insert cutting element of FIG. 29A.
Figure 29C:
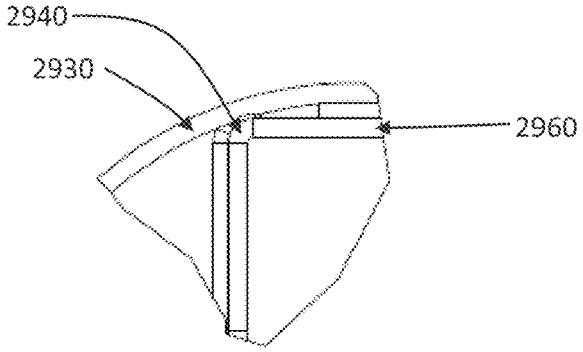
FIG. 29C is a detail, exploded view of encircled zone 29C of FIG. 29B.
Figure 29D:
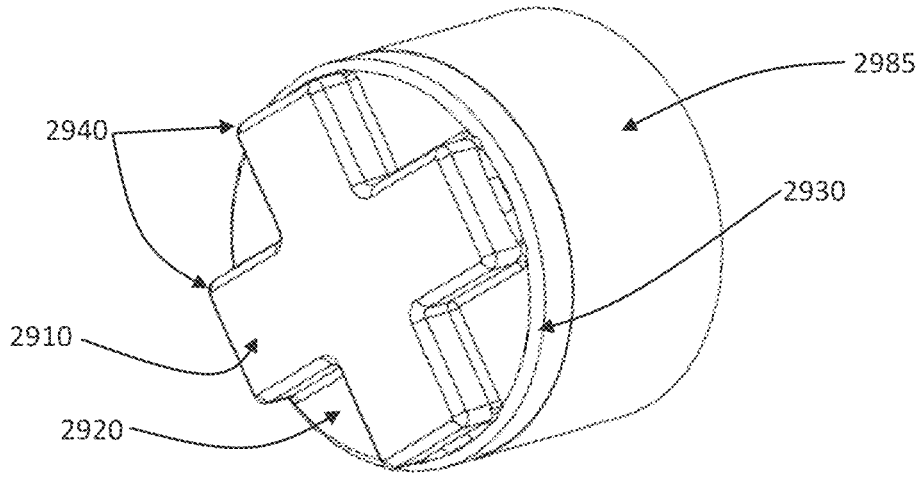
FIG. 29D is a front, perspective view of a PDC insert cutting element in accordance with the present disclosure configured such that two corners of the upper cutting surface engage formations.
Figure 29E:
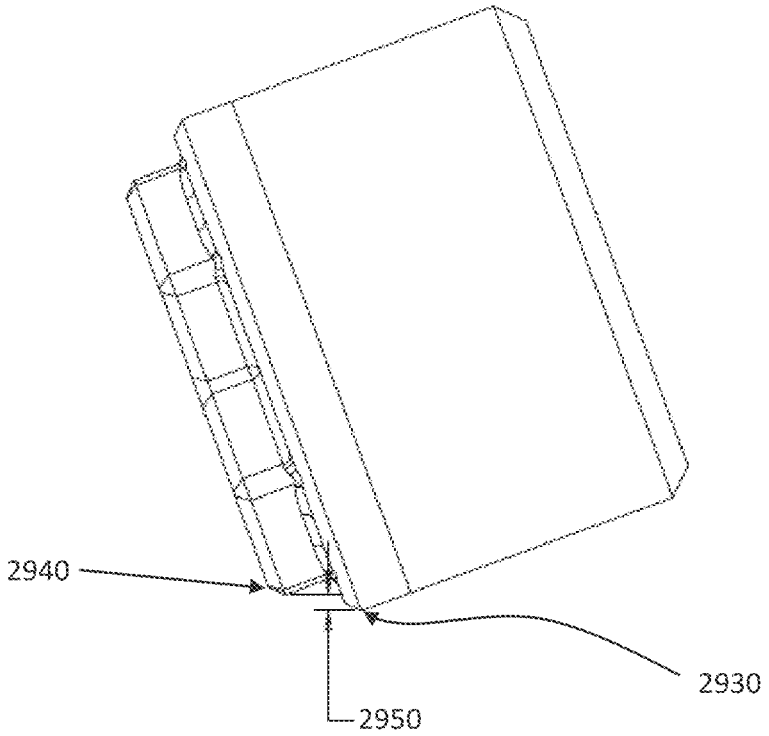
FIG. 29E is a side view of the PDC insert cutting element of FIG. 29D.
Figure 29F:
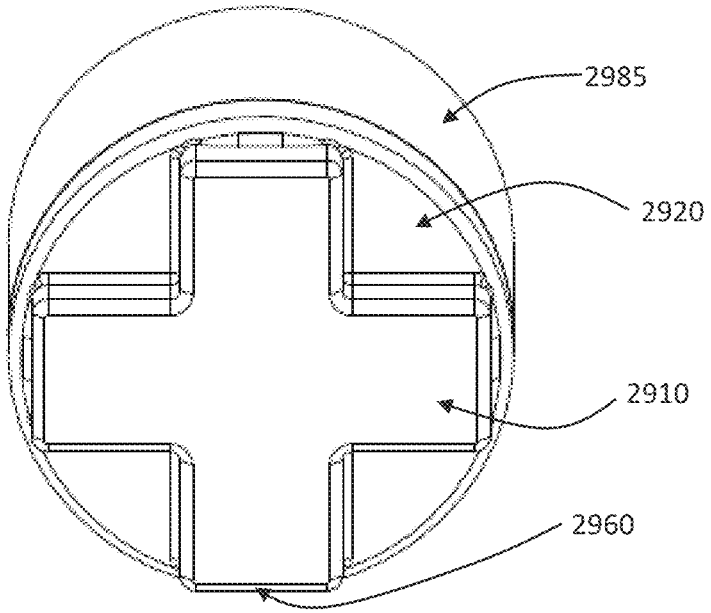
FIG. 29F is a front, perspective view of a PDC insert cutting element.
Figure 29G:
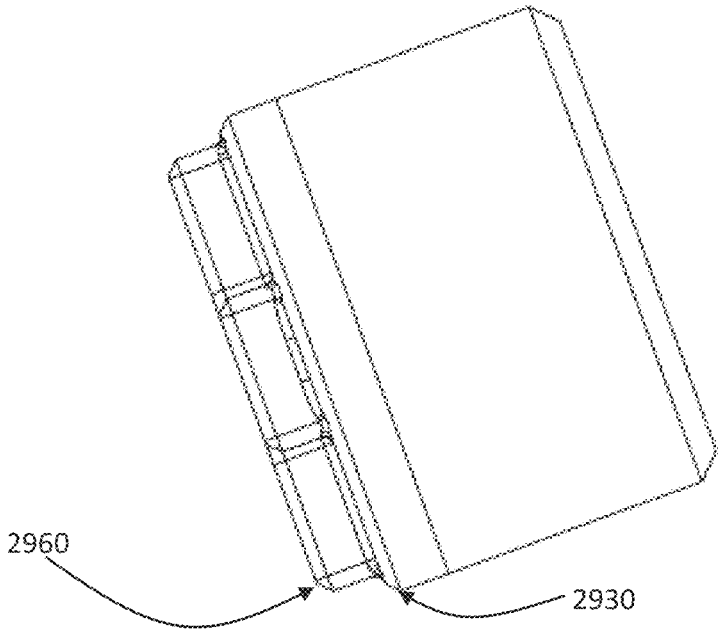
FIG. 29G is a side view of a PDC insert cutting element.

Cutting element 2900 is configured such that it engages a rock formation such that two of the corners 2940 of the upper cutting surface 2910 engage with the formation, as shown in FIGS. 29D and 29E, such that the top cutting edges score the formation prior to the primary cutting edge. FIG. 29E shows the space 2950 between the corner 2940 of the upper cutting surface 2910 and the circumferential edge 2930 of the lower surface 2920. FIGS. 29F and 29G illustrate that cutter 2900 may also be used in an alternative alignment to engage rock. The cutter 2900 can be placed in a bit pocket on a bit such that the full distal end leg of the cross-shaped cutting feature can engage the rock directly instead of only the end corners of the cross-shaped feature engaging the rock. In other words, the wear flat will form, approximately, in the center of the distal end of the cross-shaped feature after an extended period of drilling or rock cutting. This allows for one or two edges to engage and shear the rock depending on the depth of cut and back rake of the cutter. Additionally, the end corners can also act as scribe points depending on the depth of cut and back rake of the cutter.

Figure 30A:
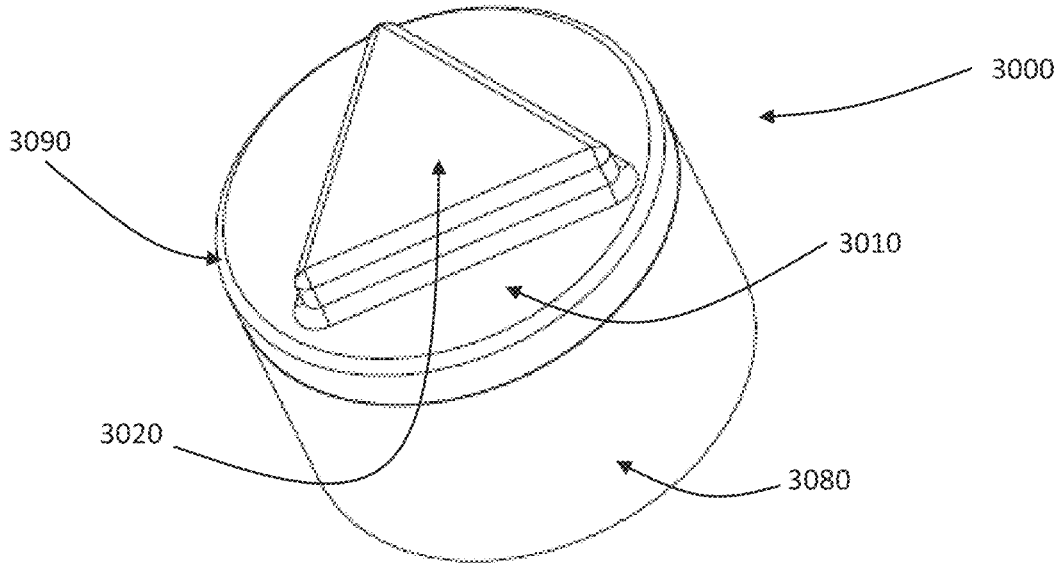
FIG. 30A is a front, perspective view of a PDC insert cutting element in accordance with the present disclosure.
Figure 30B:
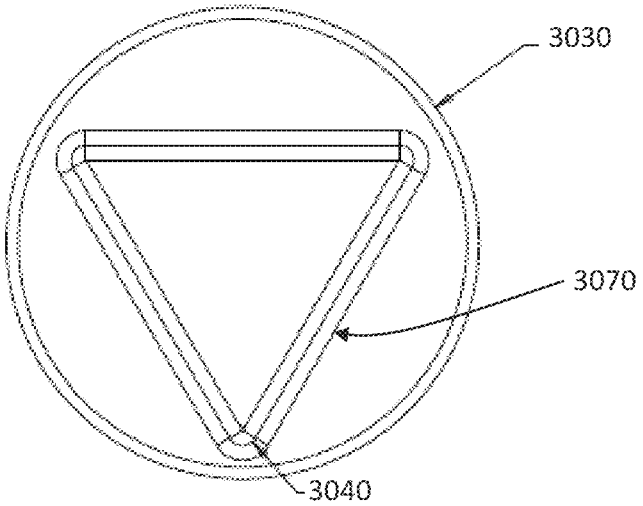
FIG. 30B is a top view of the PDC insert cutting element of FIG. 30A.
Figure 30C:
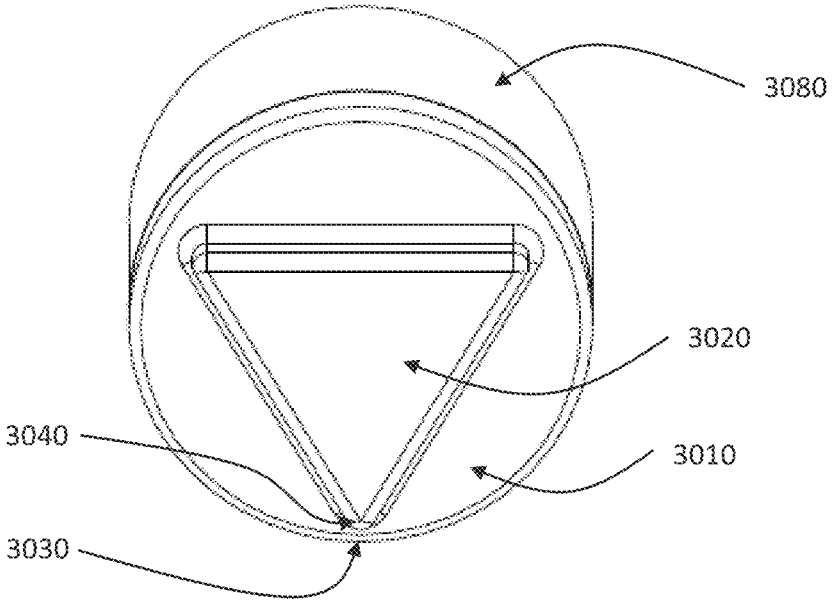
FIG. 30C is a front, perspective view of a PDC insert cutting element in accordance with the present disclosure configured such that one corner of the upper cutting surface engages with formations.
Figure 30D:
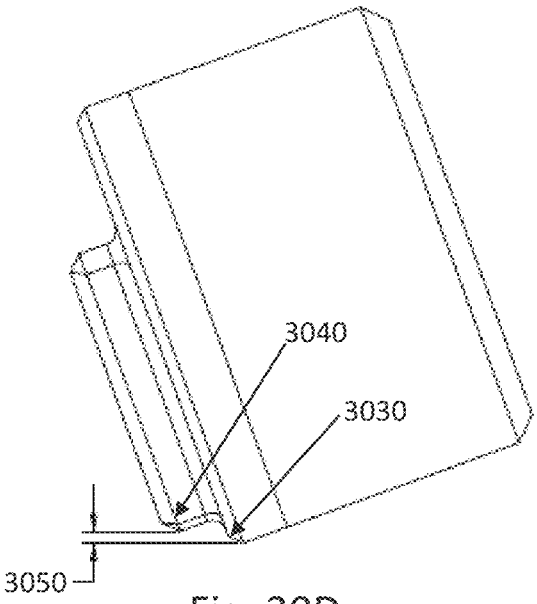
FIG. 30D is a side view of the PDC insert cutting element of FIG. 30C.

FIGS. 30A-30D depicts cutting element 3000, including diamond table 3090 supported on support 3080. Diamond table 3090 includes upper cutting surface 3020 and lower cutting surface 3010. Upper cutting surface 3020 is in the shape of a triangle extending above lower cutting surface 3010. The upper cutting surface 3020 includes edges 3070 and corners 3040. The lower cutting surface 3010 includes circumferential edge 3030 of diamond table 3090. The cutting element 3000 is configured such that the one of the corners 3040 of the upper cutting surface 3020 engages with formation, as shown in FIGS. 30C and 30D, where the space 3050 between corner 3040 and edge 3030 is shown. The cutting element 3000 may be used with the top cutting edge or tip 3040 to score the formation prior to the primary cutting edge 3030, FIGS. 31A-31D depict a cutting element 3100 having three different levels of diamond surfaces. Cutting element 3100 includes diamond table 3190 supported on support 3180. The diamond table includes upper cutting surface 3110, lower cutting surface 3130, and intermediate cutting surface 3120. Upper cutting surface 3110 is bound by edge 3160, intermediate cutting surface 3120 is bound by edge 3150, and lower cutting surface 3130 is bound by edge 3140.

Figure 31A:
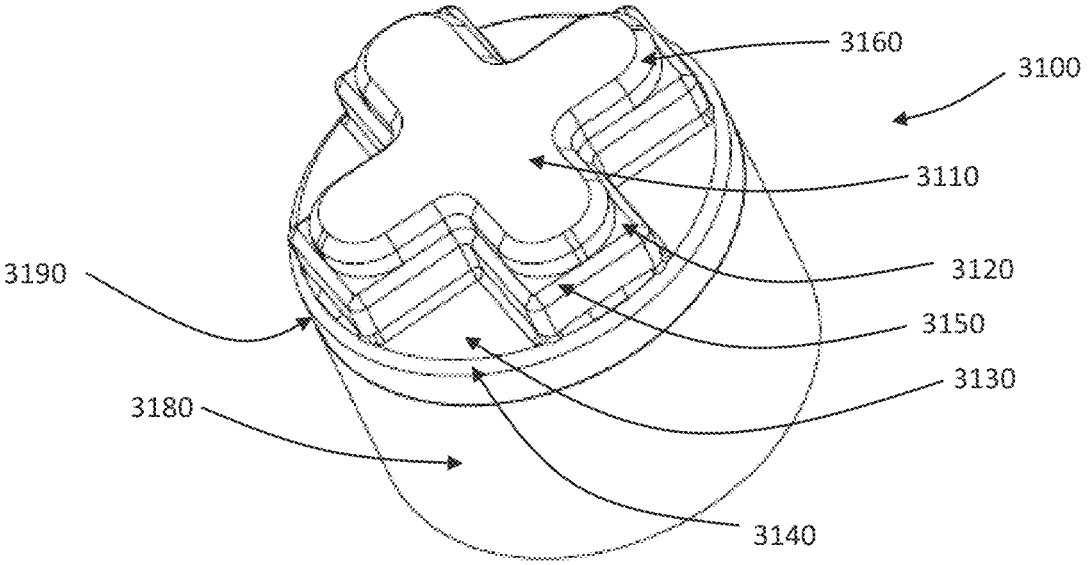
FIG. 31A is a front, perspective view of a PDC insert cutting element in accordance with the present disclosure.
Figure 31B:
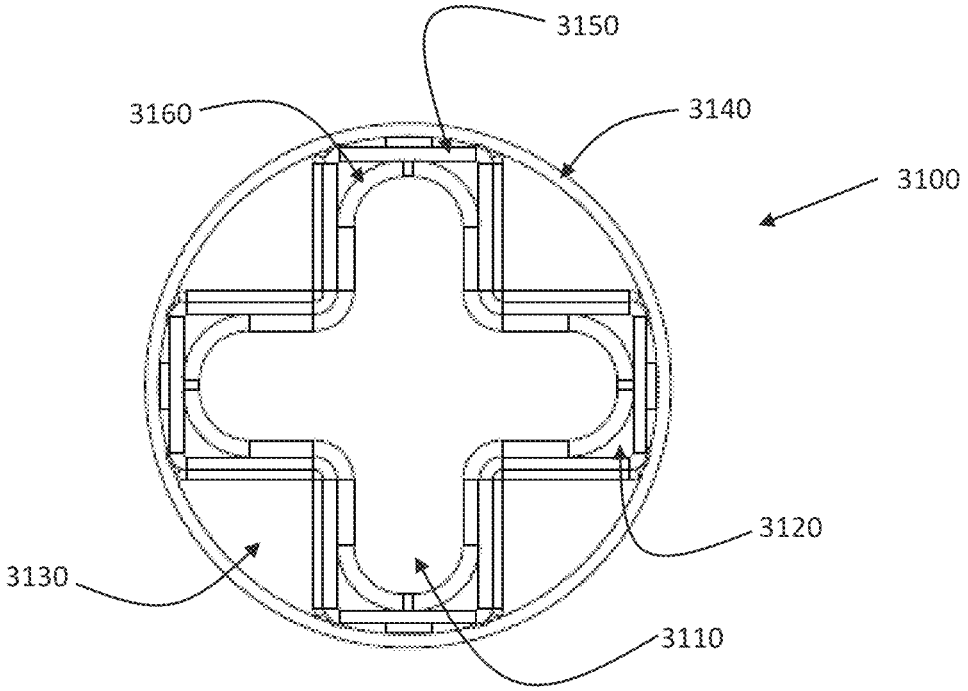
FIG. 31B is a top view of the PDC insert cutting element of FIG. 31A.
Figure 31C:
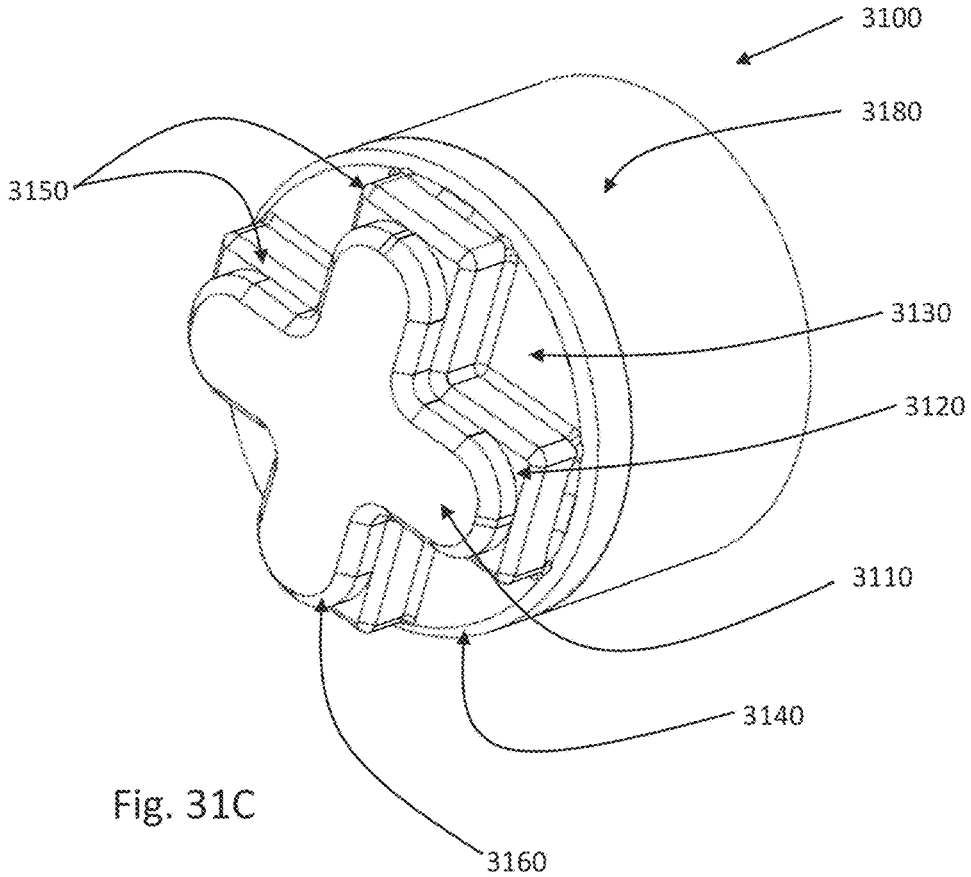
FIG. 31C is a front, perspective view of a PDC insert cutting element in accordance with the present disclosure having three levels of diamond surfaces configured such the tertiary and secondary cutting edges engage formations before a primary cutting edge engaged formations.
Figure 31D:
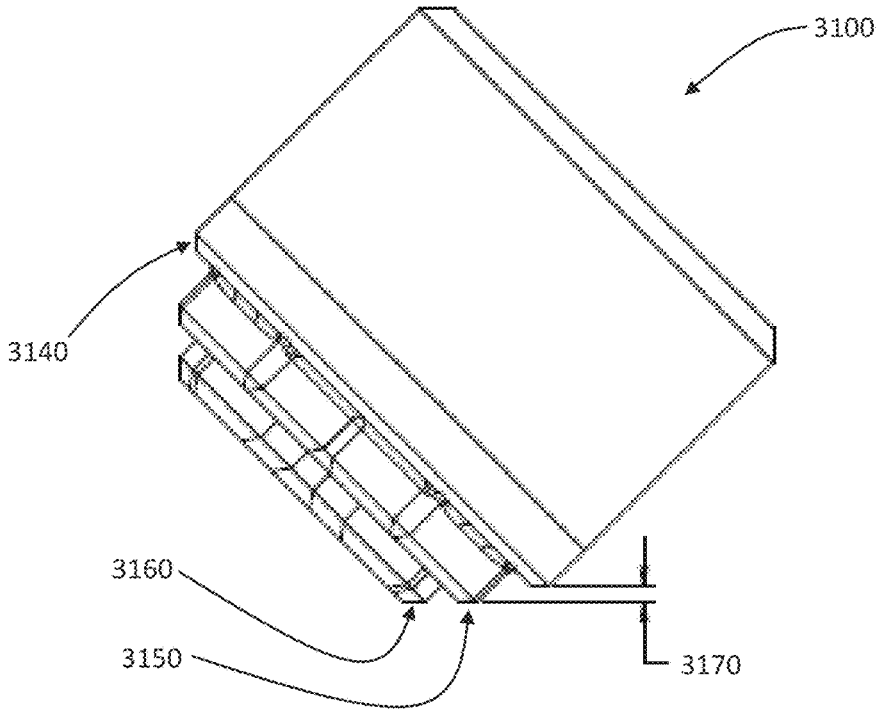
FIG. 31D is a side view of the PDC insert cutting element of FIG. 31C.

During use in drilling, the cutting element 3100 is configured such that the tertiary cutting edge 3160 and secondary cutting edge 3150 engage the formation before the primary cutting edge 3140, as illustrated in FIG. 31D, where the spacing 3170 between edges 3140 and 3150 is depicted. The cutting element 3100 may utilize cutting edges 3160 and 3150 to score and break the formation prior to using the cutting edge 3140 to shear the rock. Cutting element 3100 can be aligned to cut in two preferential configurations. In the first configuration, the wear flat will generally form between the two legs of the cross-shaped cutting feature, such that the corners of the cross-shaped feature will score the rock on each side of the wear flat. In the second configuration, the wear flat will generally form in direct alignment with one of the legs of the cross-shaped feature, such that the distal end of cross-shaped feature will engage the rock directly.

Figure 32A:
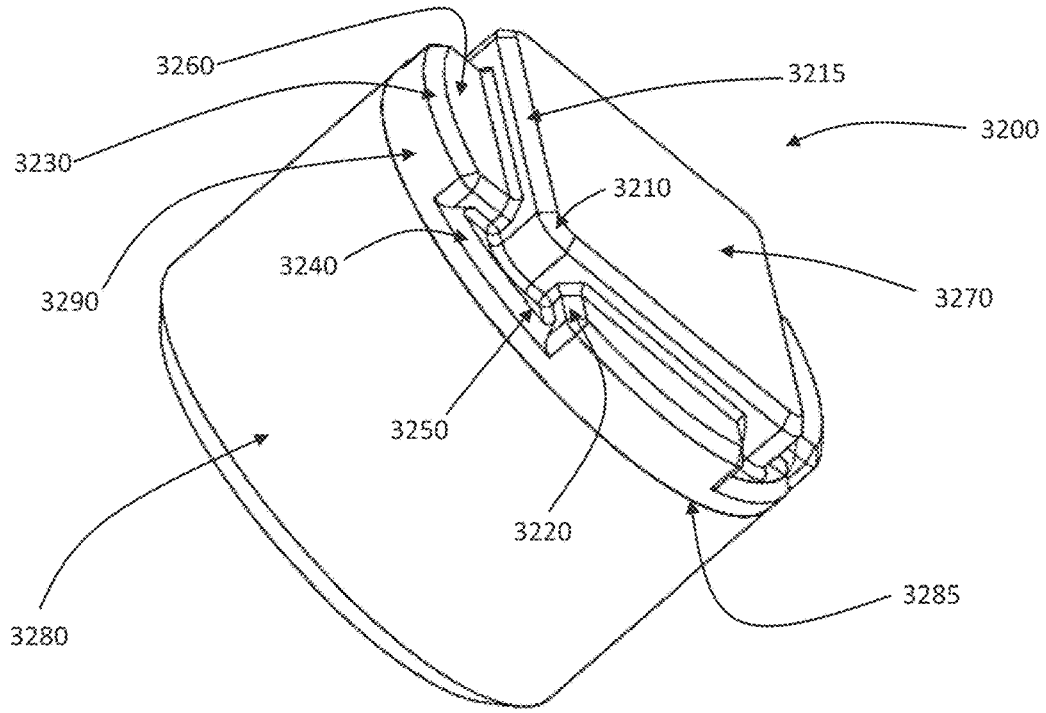
FIGS. 32A and 32B are perspective views of a PDC insert cutting element in accordance with the present disclosure.
Figure 32B:
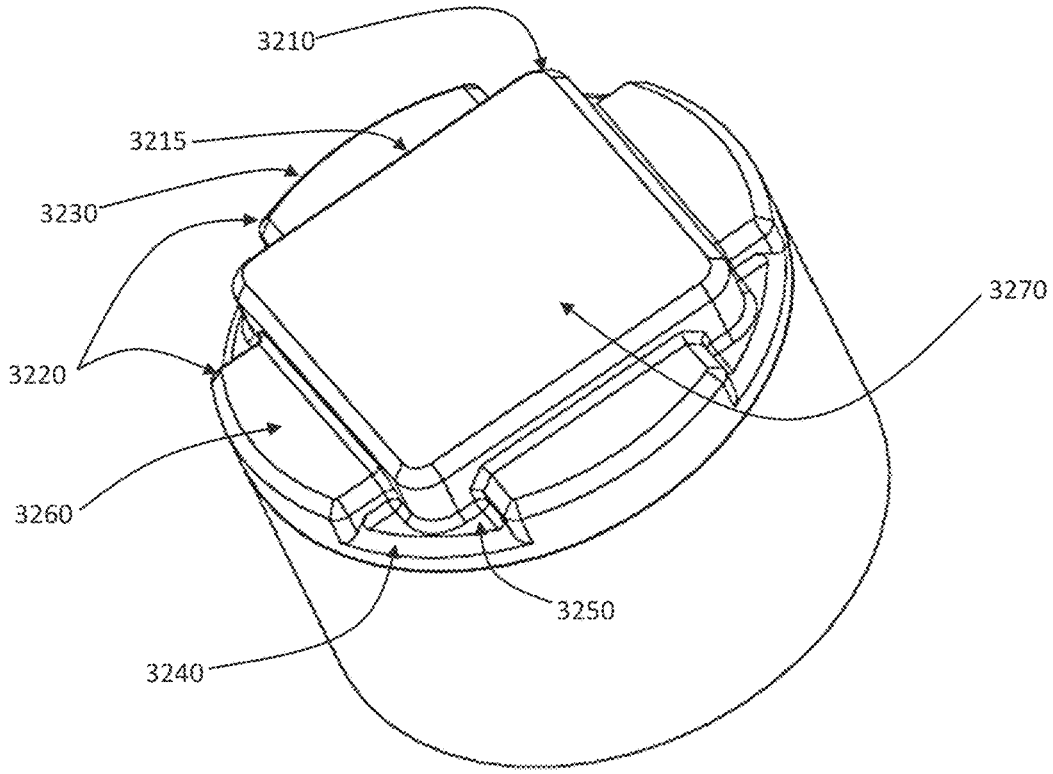

FIGS. 32A and 32B depict cutting element 3200. Cutting element 3200 includes diamond table 3290 supported on support 3280. The diamond table 3290 includes three cutting surfaces 3270, 3260, and 3250, which are each at different elevations relative to the interface 3285 between the diamond table 3290 and the support 3280. Uppermost cutting surface 3270 includes beveled edges 3215 and beveled corners 3210, intermediate cutting surface 3260 includes beveled edges 3230 and beveled corners 3220, and lower cutting surface 3250 includes beveled edges 3240. Cutting element 3200 has a preferred alignment such that a generated wear flat will generally be located and centralized at cutting tip 3210 while drilling or cutting rock.

Figure 33A:
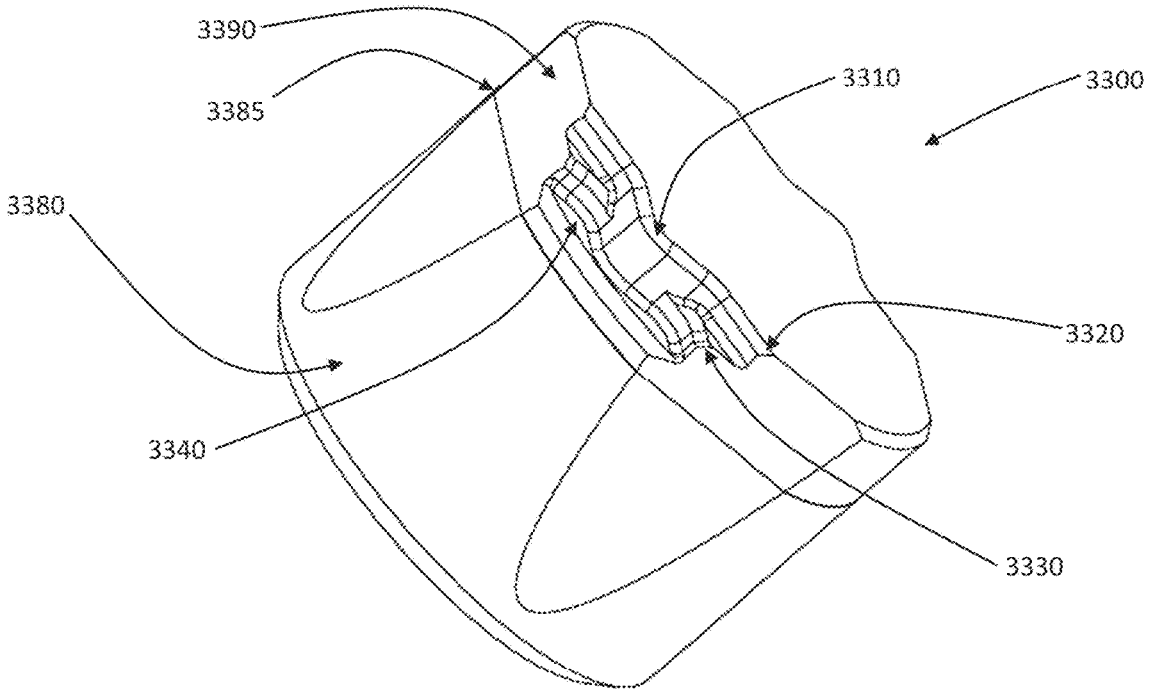
FIGS. 33A and 33B are perspective views of a PDC insert cutting element in accordance with the present disclosure.
Figure 33B:
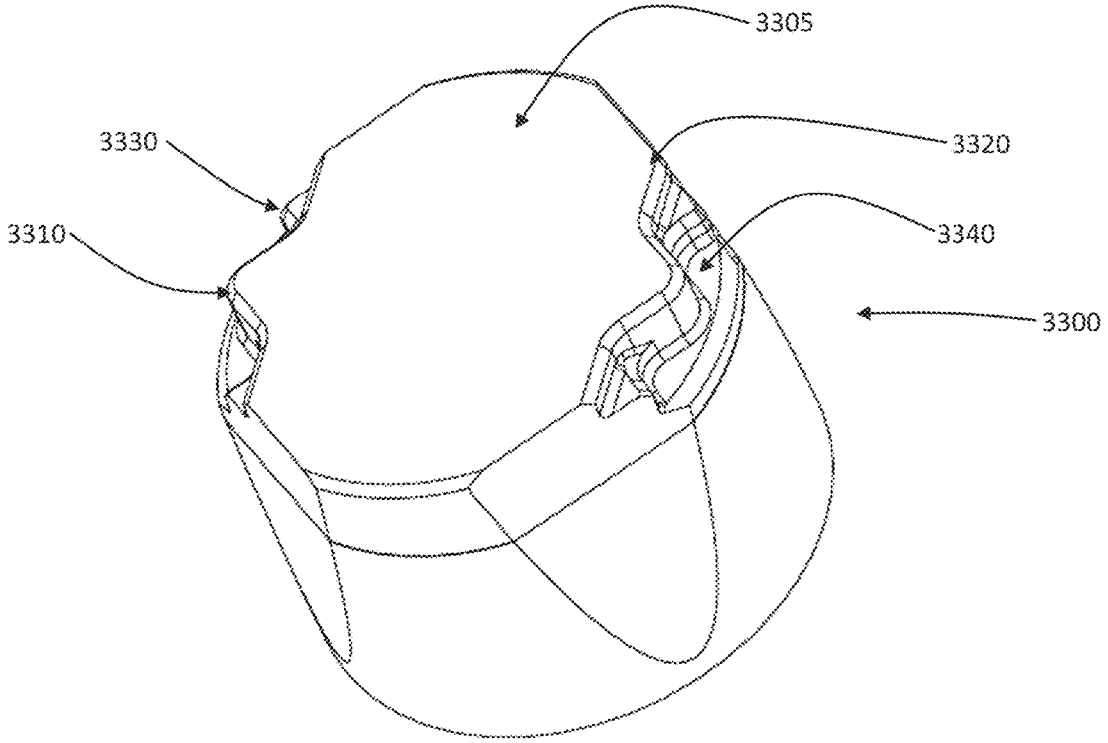

FIGS. 33A and 33B depict cutting element 3300. Cutting element 3300 includes diamond table 3390 supported on support 3380. The diamond table 3390 includes uppermost cutting surface 3305. Uppermost cutting surface 3305 includes edge 3320 and protruding portions 3310 that extend out past edge 3320. The diamond table 3390 also includes intermediate cutting surface 3330 and lower cutting surface 3340. Each of cutting surfaces 3305, 3330, and 3340 are at different elevations relative to the interface 3385 between the diamond table 3390 and the support 3380. Cutting element 3300 has a flank grind feature on each side of the cutting tip area to provide further relief to facilitate a rock scoring or scribing effect. Cutting element 3300 has a preferred alignment such that a generated wear flat will generally be located and centralized at cutting tip 3210 while drilling or cutting rock.

Figure 34A:
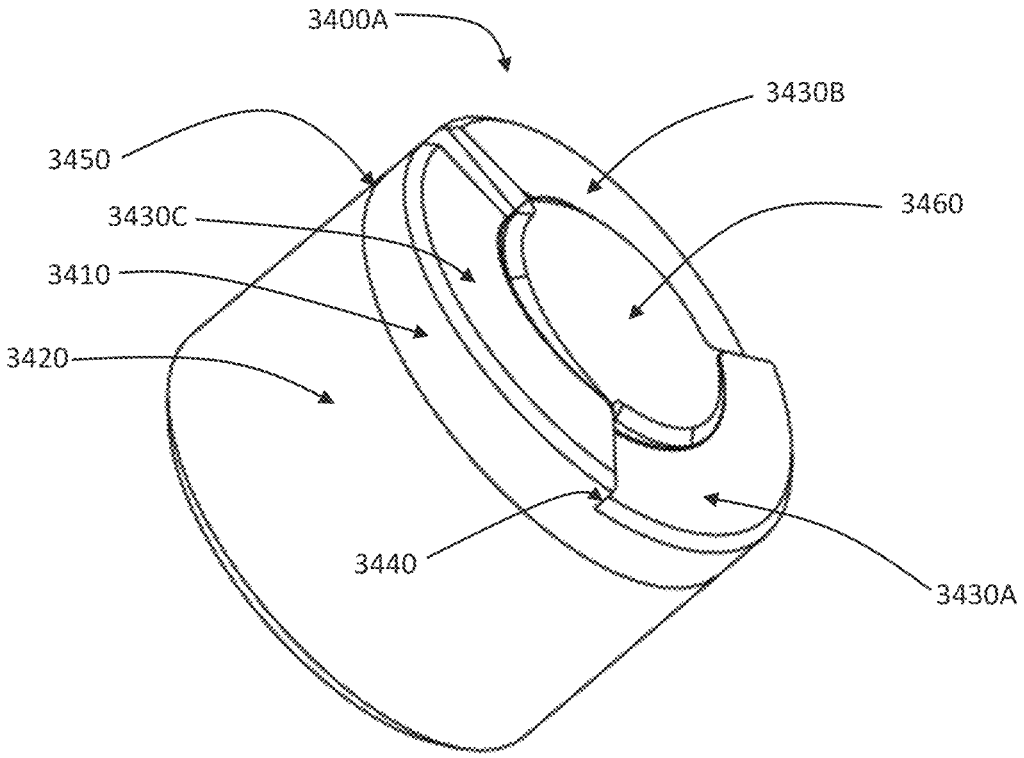
FIG. 34A is a perspective view of a PDC cutting element have multiple steps and cutting surfaces extending radially about the cutting element.

FIG. 34A depicts cutting element 3400*a*. Cutting element 3400*a* includes diamond table 3410 supported on support 3420. Diamond table 3410 includes a generally centrally positioned cutting surface 3460. Cutting surface 3460 is generally circular and flat. Surrounding cutting surface 3460 are three sloped cutting surfaces 3430*a*-3430*c*. Diamond table 3410 also includes a step transition including sidewalls 3440 between adjacent cutting surfaces 3430*a*-3430*c*. The angles of the cutting surfaces 3430*a*-3430*c* and the step sidewalls can be varied, such as relative to the plane of the cutting surface 3460 or the imaginary plane of the interface 3450. A step that is at an angle approximately 90° relative to the plane of the interface 3450 or the cutting surface 3460 can provide a greater facture differential relative to a step that is at an angle of more than 90° or more parallel relative to the plane of the interface 3450 or the cutting surface 3460. A step that is at an angle of more than 90°, in other words more parallel relative to the plane of the interface 3450 or the cutting surface 3460 is generally stronger than a step that is approximately 90° relative to the plane of the interface 3450 or the cutting surface 3460. When cutting soft rock, the cutting element 3400*a* can provide relatively high volume cutting. When cutting hard rock, the cutting element 3400*a* exhibits a stress differential such that cutting element 3400*a* is capable of fracturing the hard rock. The cutting element 3400*a* also exhibits a radial angular shear with the spiraled edge that reduces torque spikes.

Figure 34B:
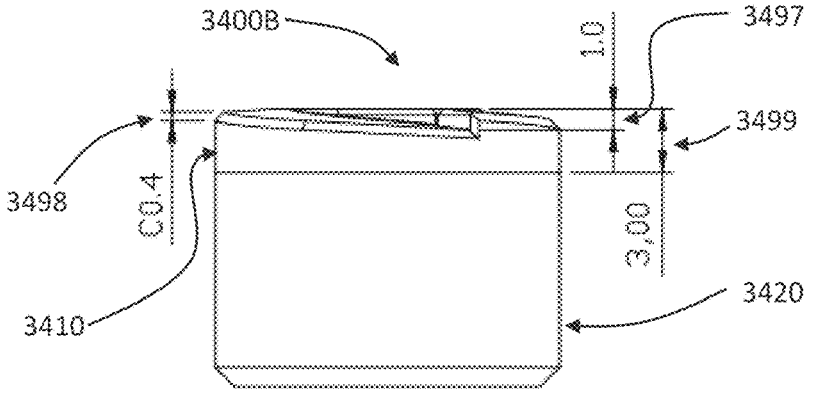
FIGS. 34B and 34C are side views of PDC cutting elements the same or similar to that shown in FIG. 34A, and at different step heights.
Figure 34C:
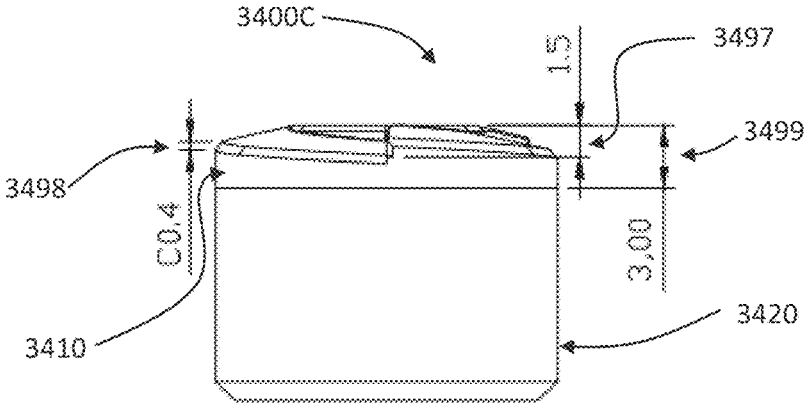
Figure 34D:
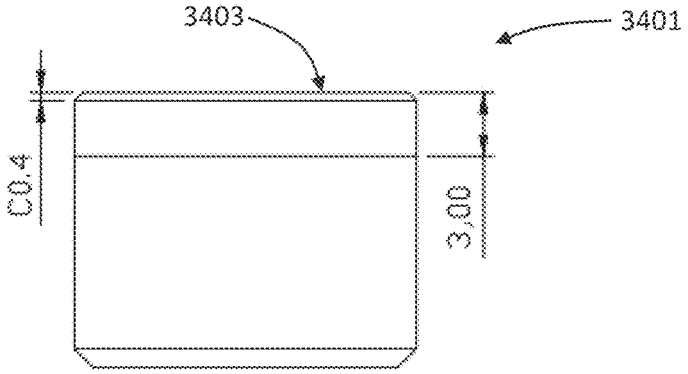
FIG. 34D is a PDC cutting element without a step.

FIGS. 34B and 34C depict side views of cutting elements 3400*b* and 3400*c*, respectively, which are both identical to or substantially similar to cutting element 3400*a*. FIGS. 34B and 34C show the height 3499 of the diamond table 3410, the height 3498 of one of the step features at the thinnest portion of the step feature, and the height 3497 of one of the step features at the thickest portion of the step feature. As shown, the diamond tables in both FIGS. 34B and 34C have the same overall cutter height; however, the height 3497 of the step feature at the thickest portion is greater for cutting element 3400*c* than for cutting element 3400*b*. FIG. 34D depicts a traditional cutting element 3401 for comparison with cutting elements 3400*b* and 3400*c*. As shown, cutting element 3401 includes only a single, fiat planar cutting surface 3403 and lacks any step features.

Figure 35A:
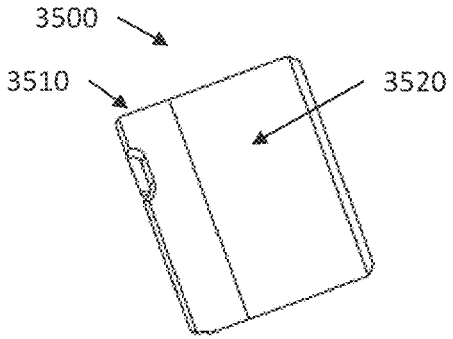
FIGS. 35A-35J depict a PDC cutting element at different stages of wear.
Figure 35B:
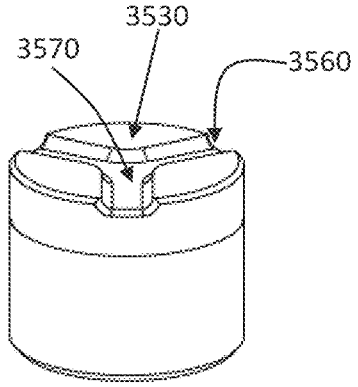
Figure 35C:
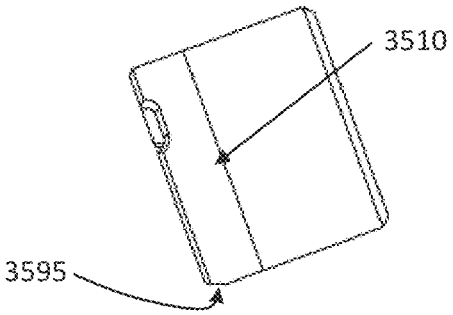
Figure 35D:
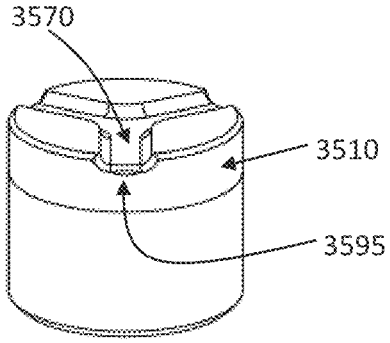
Figure 35E:
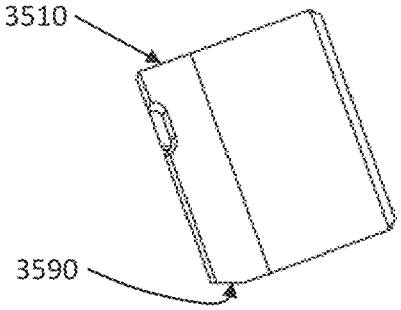
Figure 35F:
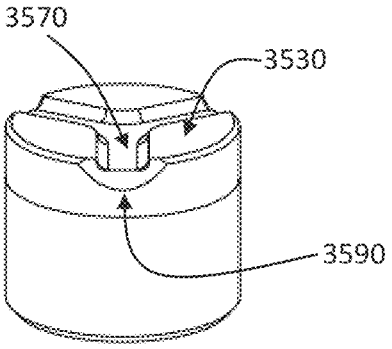
Figure 35G:
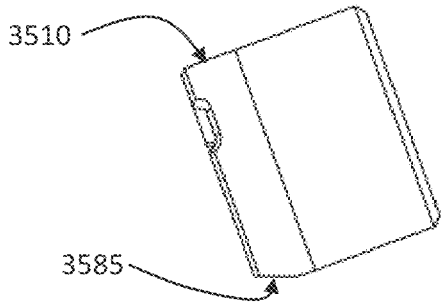
Figure 35H:
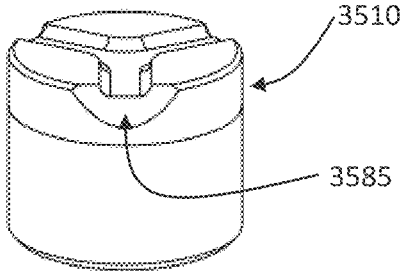
Figure 35I:
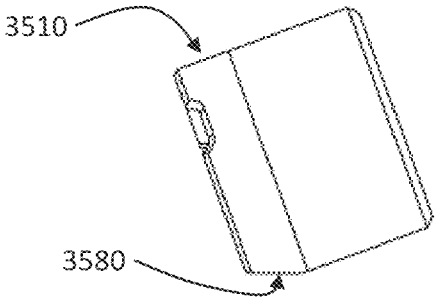
Figure 35J:
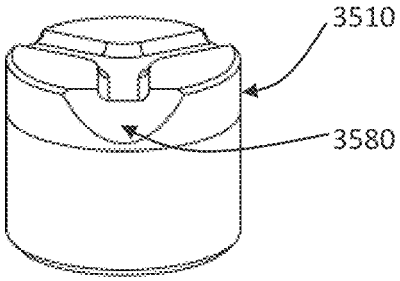

FIGS. 35A-35J depict cutting element 3500 trough design at various stages of wear. With reference to FIGS. 35A and 35B, cutting element includes diamond table 3510 supported on substrate 3520. Diamond table 3510 includes upper cutting surfaces 3530. Diamond table 3510 also includes trough 3560 formed therein, including lower cutting surface 3570. FIGS. 35C and 35D depict the cutting element after the formation of a degree of wear 3595 in the diamond table 3510, particularly at the peripheral edge of the trough and lower cutting surface 3570. FIGS. 35E and 35F depict the cutting element after a further degree of wear, such that wear 3590 is larger than wear 3595. Wear 3590 is formed into the lower cutting surface 3570 and a portion of the upper cutting surfaces 3530 (e.g., at the corners of surfaces 3530). FIGS. 35G and 35H depict the cutting element after a further degree of wear, such that wear 3585 is larger than wear 3590. FIGS. 35I and 35J depict the cutting element after a further degree of wear, such that wear 3580 is larger than wear 3585. As is evidence from FIGS. 35A-35J, the PDC cutting elements disclosed herein can be more effectively used to continue to cutting rock after formation of wear in the cutting surface of the diamond table planes. For example the surface of the diamond table can be shaped such that a non-ovoid shaped wear flat (e.g., wear 3580) forms, and contains relatively thick and relatively thin portions of the diamond table. A non-ovoid shaped wear flat minimizes the potential for a bearing effect while cutting allowing the edge to more effectively "bite" or engage the rock. Additionally, the upper and lower edges, including transitions and corners, provide additional leached cutting edges to engage the rock at different times, or more specifically at different points of cutter wear, thus potentially increasing the overall thermal performance and cutter life while drilling. An additional benefit of this design is that, by not having an ovoid shaped wear flat form that is typical of a standard cylinder-shaped cutter, the cutting edge is less prone to the formation of a non-leached "donut hole." More specifically, as a standard cylinder cutter with a planar diamond table becomes more worn from cutting rock, the leached layer in the center of the wear flat is worn away. This results in a wear flat with a center portion that is not leached while surrounded by a leached ring. This center region in the wear flat is not as thermally resistant as the leached outer ring in the wear flat. It is often observed on bits with worn leached cutters, that a crack forms in this non-leached center. These cracks in the non-leached center can increase the risk of catastrophic cutter failure and, in some cases, can render the bit unrepairable.

Arrangement of Blades and Cutting Elements

In some embodiments the blades and/or cutting elements are arranged on a drill bit to provide an effect, such as a stabilization or a directional tendency. With reference to FIGS. 36-46, some exemplary embodiments of arrangements of blades and cutting elements are described.

Figure 36:
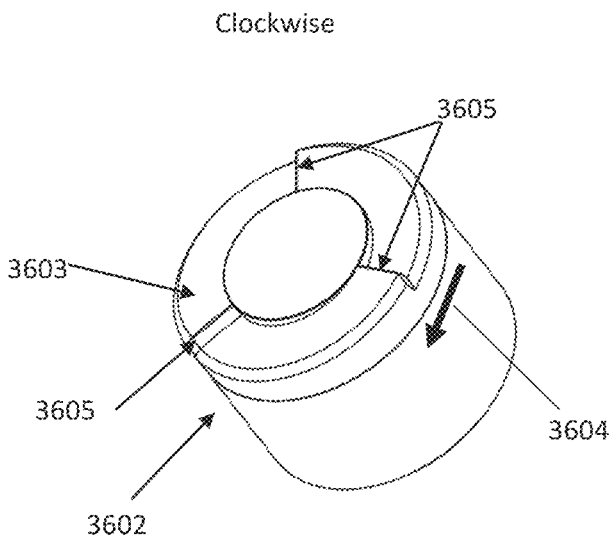
FIG. 36 depicts a cutter with a shaped diamond table that is directionally shaped with step features that contour downward in a clockwise direction.

FIG. 36 depicts cutting element 3602. Cutting element 3602 includes shaped diamond table 3603. Shaped diamond table 3603 is directionally shaped with step features, step surfaces 3605, that contour downward in a clockwise 3604 direction.

Figure 37:
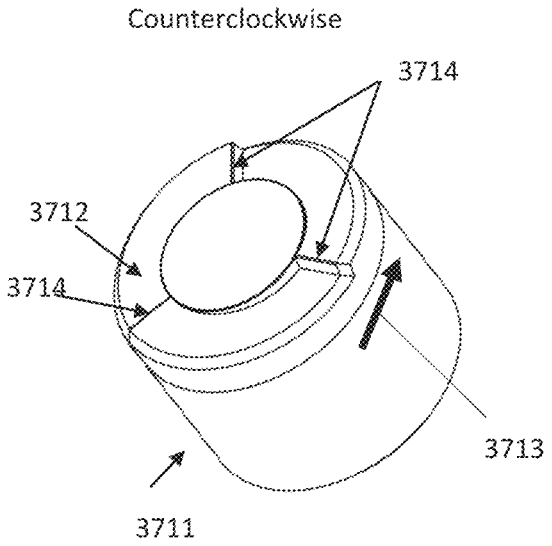
FIG. 37 depicts a cutter with a shaped diamond table that is directionally shaped with step features that contour downward in a counterclockwise direction.

FIG. 37 depicts cutting element 3711. Cutting element 3711 includes shaped diamond table 3712. Shaped diamond table 3712 is directionally shaped with step features, step surfaces 3714, that contour downward in a counterclockwise 3713 direction, Thus, the cutting element 3711 is substantially similar to the cutting element 3602, but with the steps contouring in opposite rotational directions.

Figure 38:
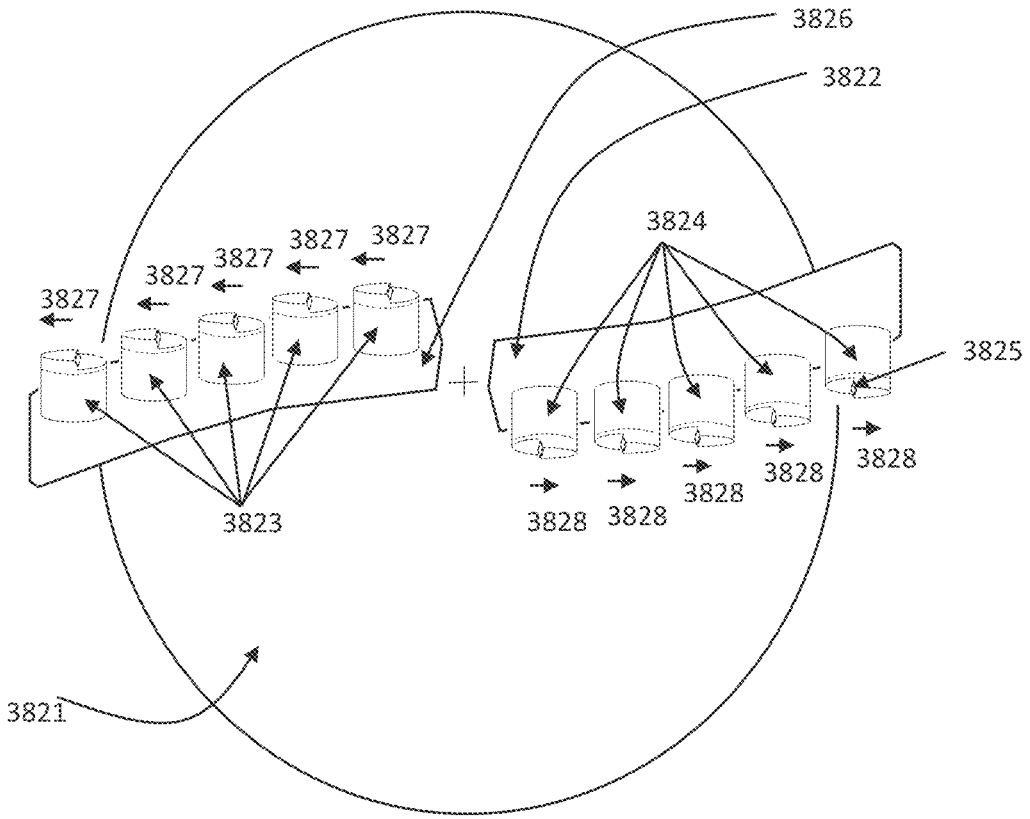
FIG. 38 is a simplified depiction of a polycrystalline diamond cutter drill bit having cutters positioned to provide counteracting outward forces.

FIG. 38 is a simplified depiction of a polycrystalline diamond cutter drill bit (PDC drill bit) 3821. For simplicity and clarity, only two blades 3822 and 3826 of the drill bit 3821 are shown. However, the drill bit may have more or less than two blades. Blade 3826 includes cutting elements 3823, and blade 3822 includes cutting elements 3824. Cutting elements 3823 and 3824 each have a step design feature, step surface 3825, that is positioned or aligned, generally, to make maximum contact with rock formation while drilling. That is, step surfaces 3825 are aligned, generally, in the center of where a wear flat is expected to be generated on the diamond table edge after an extended period of drilling. The cutting elements 3823 are all aligned on blade 3826 with the step surfaces 3825 facing in the same direction to provide a cumulative lateral force outward 3827 or away from the center of the bit 3821. Conversely, the cutting elements 3824 are all aligned on opposing blade 3822 with the step surfaces 3825 having a similar orientation to provide an opposing cumulative lateral force 3828 outward or away from the center of the bit 3821. More specifically, the radial outward forces 3827 of the cutting elements 3823 oppose or counteract the radial outward forces 3828 generated by the cutting elements 3824. The counteracting threes creates a stabilizing or centering effect on the bit 3821 to reduce lateral vibration while, at the same time, providing step surfaces 3825 that can facilitate fracturing harder rock. The formation of such counteracting forces, and the associated effects, can be utilized on two or more opposing blades in a bit.

Figure 39:
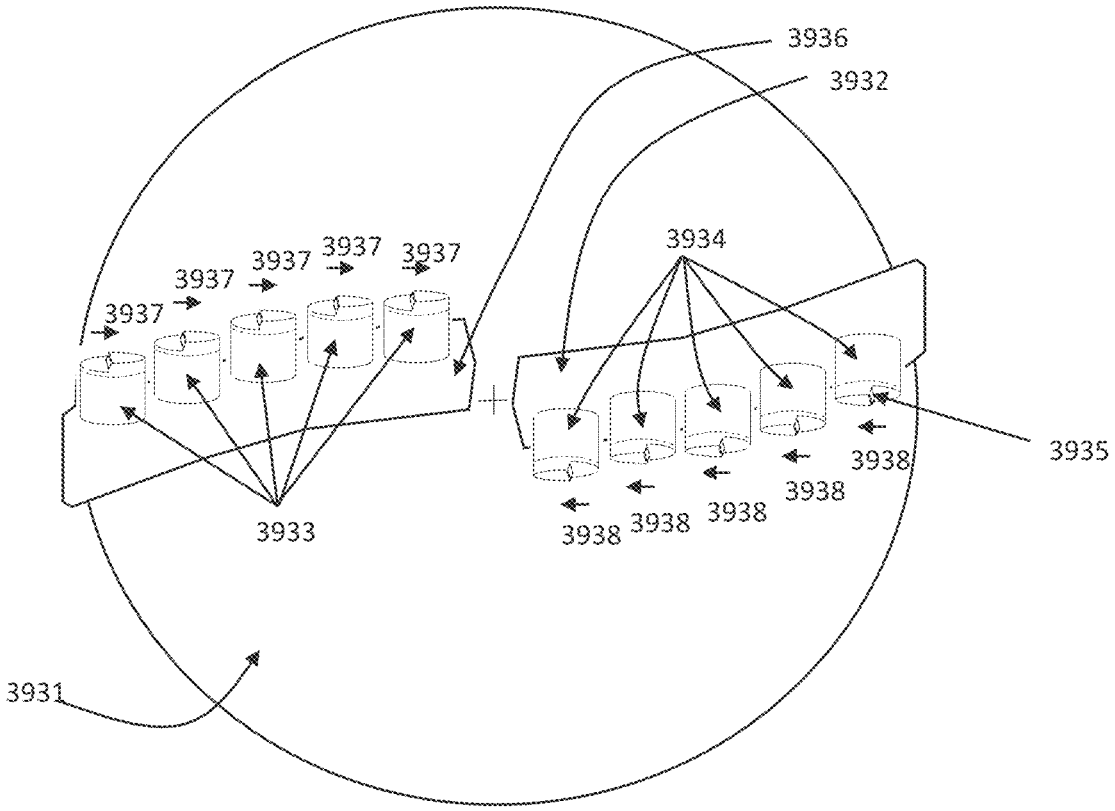
FIG. 39 is a simplified depiction of a polycrystalline diamond cutter drill bit having cutters positioned to provide counteracting inward forces.

FIG. 39 is a simplified depiction of a polycrystalline diamond cutter drill bit (PDC drill bit) 3931. For simplicity and clarity only two blades 3932 and 3936 are shown. Blade 3936 includes cutting elements 3933, and blade 3932 includes cutting elements 3934. Cutting elements 3933 and 3934 each have a step design feature, step surface 3935, which is positioned or aligned, generally, to make maximum contact with the rock formation while drilling. That is, the step surfaces 3935 are aligned, generally, in the center of where a wear flat is expected to be generated on the diamond table edge after an extended period of drilling. Cutting elements 3933 are all aligned on blade 3936 with the step surfaces 3935 arranged in the same direction to provide a cumulative lateral force inward 3937 or toward the center of the bit 3931. Conversely, cutting elements 3934 are all aligned on opposing blade 3932 with the step surfaces 3935 arranged with a similar orientation to provide an opposing cumulative lateral force 3938 inward or toward the center of the bit 3931. The radial inward forces 3937 of cutting elements 3933 oppose or counteract the radial inward forces 3938 generated by cutting elements 3934. These counteracting forces create a stabilizing or centering effect to reduce lateral vibration while, at the same time, providing step surfaces 3935 that can facilitate fracturing harder rock. The formation of such counteracting forces, and the associated effects, can be utilized on two or more opposing blades in a bit.

Figure 40:
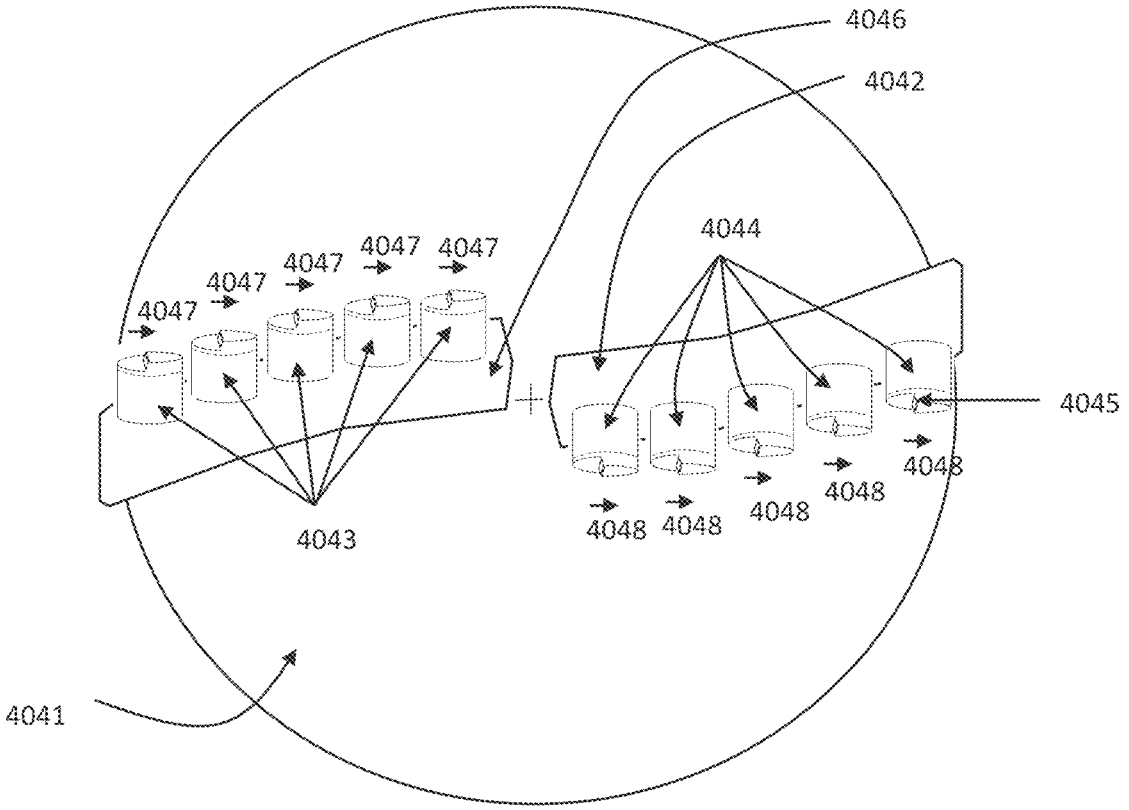
FIG. 40 is a simplified depiction of a polycrystalline diamond cutter drill bit having cutters positioned to provide cumulative forces.

FIG. 40 is a simplified depiction of a polycrystalline diamond cutter drill bit (PDC drill bit) 4041. For clarity and simplicity only two blades 4042 and 4046 are shown. Blade 4046 includes cutting element 4043, and blade 4042 includes cutting elements 4044. Each cutting element 4043 and 4044 has a step design feature, step surface 4045, which is positioned or aligned generally to make maximum contact with the rock formation while drilling. That is, the step surfaces 4045 are aligned, generally, in the center of where a wear fiat is expected to be generated on the diamond table edge after an extended period of drilling. Cutting elements 4043 are all aligned on blade 4046 with the step surfaces 4045 arranged in the same direction to provide a cumulative lateral three 4047 directed inward or toward the center of the bit 4041. Conversely, cutting elements 4044 are all aligned on opposing blade 4042 with the step surfaces 4045 arranged in the opposite direction to provide an additive cumulative lateral force 4048. That is, the cutting elements 4043 provide a radially inward force 4047 toward the center of the bit 4041 and the cutting elements 4044 provide a radially outward force 4048 away from the center of the bit 4041 to provide an additive cumulative lateral force or lateral force tendency on the bit 4041. This lateral force can be utilized as an advantageous steering tendency or boost for a steerable mud motor or rotary steerable systems. The formation of such forces, and the associated effects, can be utilized on two or more opposing blades in a bit.

Figure 41:
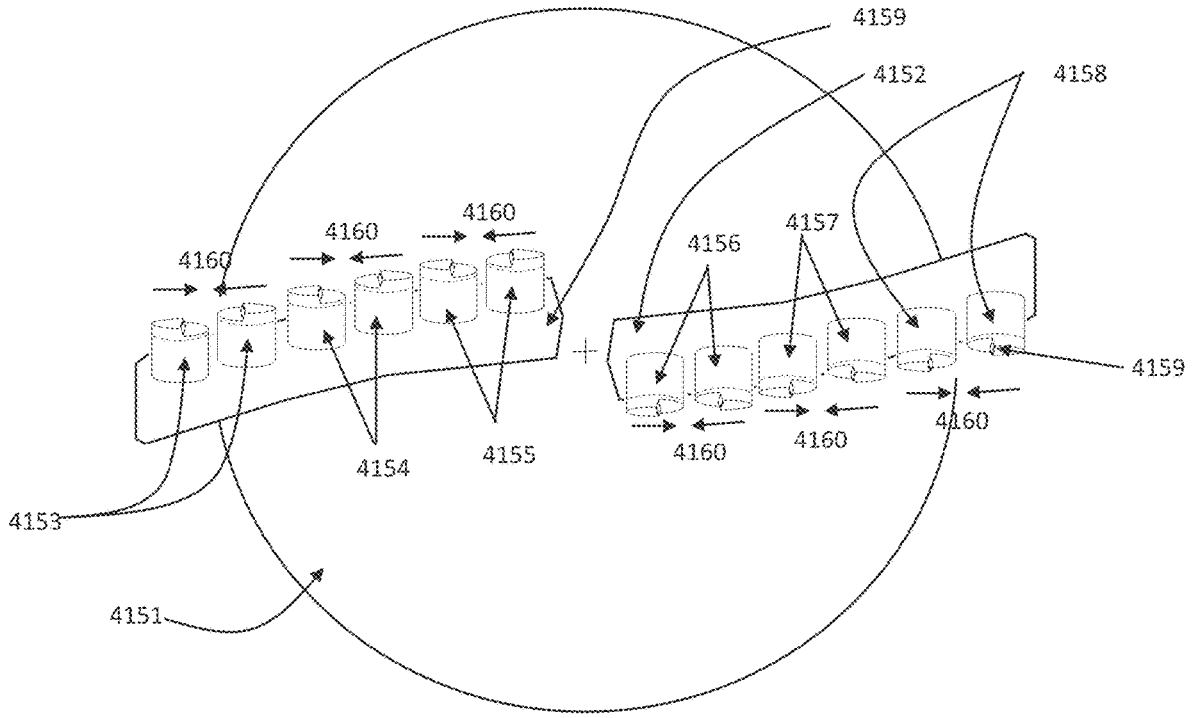
FIG. 41 is a simplified depiction of another polycrystalline diamond cutter drill bit having cutters positioned to provide an aggregate stabilizing effect.

FIG. 41 is a simplified depiction of a polycrystalline diamond cutter drill bit (PDC drill bit) 4151. For simplicity and clarity only two blades 4152 and 4159 are shown. Blade 4152 includes cutting elements 4156, 4157, and 4158. Blade 4159 includes cutting elements 4153, 4154, and 4155. Cutting elements 4153, 4154, 4155, 4156, 4157, 4158 all have a step design feature, step surfaces 4159, which are positioned or aligned generally to make maximum contact with the rock formation while drilling. More specifically, the step surfaces 4159 are aligned, generally, in the center of where a wear flat will be generated on the diamond table edge after an extended period of drilling. Each cutting element 4153, 4154, 4155, 4156, 4157 and 4158 is arranged in a pair of two inserts with opposing step surfaces 4159, such that the step surfaces 4159 face opposing directions and generate opposing lateral forces 4160 between said pairs; thereby, creating a localized stabilizing effect between the pairs of cutting elements. In some embodiments, each blade on a bit may contain multiple pairs of cutters with opposing step patterns to create such an aggregate stabilizing effect.

Figure 42:
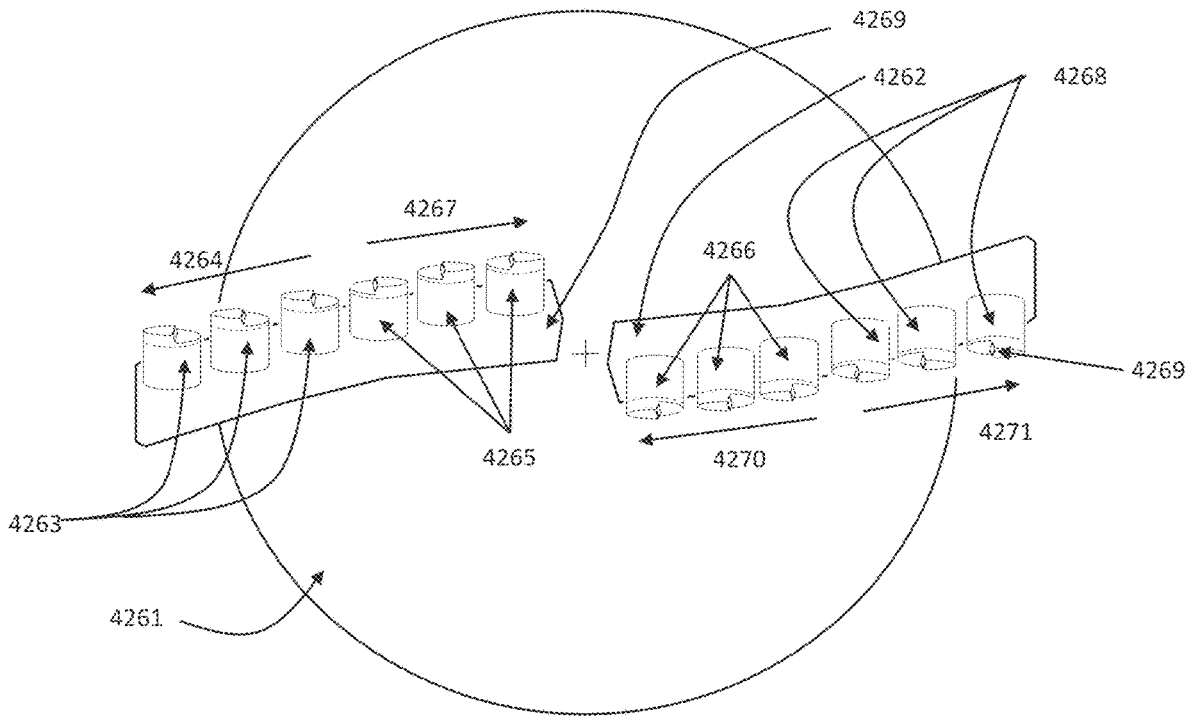
FIG. 42 is a simplified depiction of a polycrystalline diamond cutter drill bit having cutters positioned to provide an aggregate stabilizing effect.

FIG. 42 is a simplified depiction of a polycrystalline diamond cutter drill bit (PDC drill bit)) 4261. For simplicity and clarity only two blades 4262 and 4269 are shown. Blade 4269 includes cutting elements 4263 and cutting elements 4265. Blade 4262 includes cutting elements 4266 and cutting elements 4268. Cutting elements 4263, 4265, 4266, and 4268 each have a step design feature, step surface 4269, which is positioned or aligned generally to make maximum contact with the rock formation while drilling. The step surfaces 4269 are aligned, generally, in the center of where a wear flat is expected to be generated on the diamond table edge after an extended period of drilling. The three cutting elements 4263 include diamond tables with step surfaces 4269 that are aligned with one another to create lateral force 4264. The three cutting elements 4265 include diamond tables with step surfaces 4269 that are aligned with one another to create lateral force 4267. The cutting elements 4263 are aligned in an opposite direction than the cutting elements 4265 such that the lateral three 4264 is directed opposite the lateral force 4267. The opposing lateral forces 4264 and 4267 between the two groups of cutting elements creates a stabilizing effect between the cutting elements. The three cutting elements 4266 include diamond tables with step surfaces 4269 that are aligned with one another to create lateral force 4270. The three cutting elements 4268 include diamond tables with step surfaces 4269 that are aligned with one another to create lateral force 4271. The cutting elements 4266 are aligned in an opposite direction than the cutting elements 4268 such that the lateral force 4270 is directed opposite the lateral force 4271. The opposing lateral forces 4270 and 4271 between the two groups of cutting elements creates a stabilizing effect between the cutting elements. With blades 4269 and 4262 both being individually stabilized by the opposing lateral forces; the opposing stabilized blades create an additional aggregate stabilizing effect to the bit 4261 while rotating. This stabilizing effect can be multiplied by the number of blades.

Figure 43:
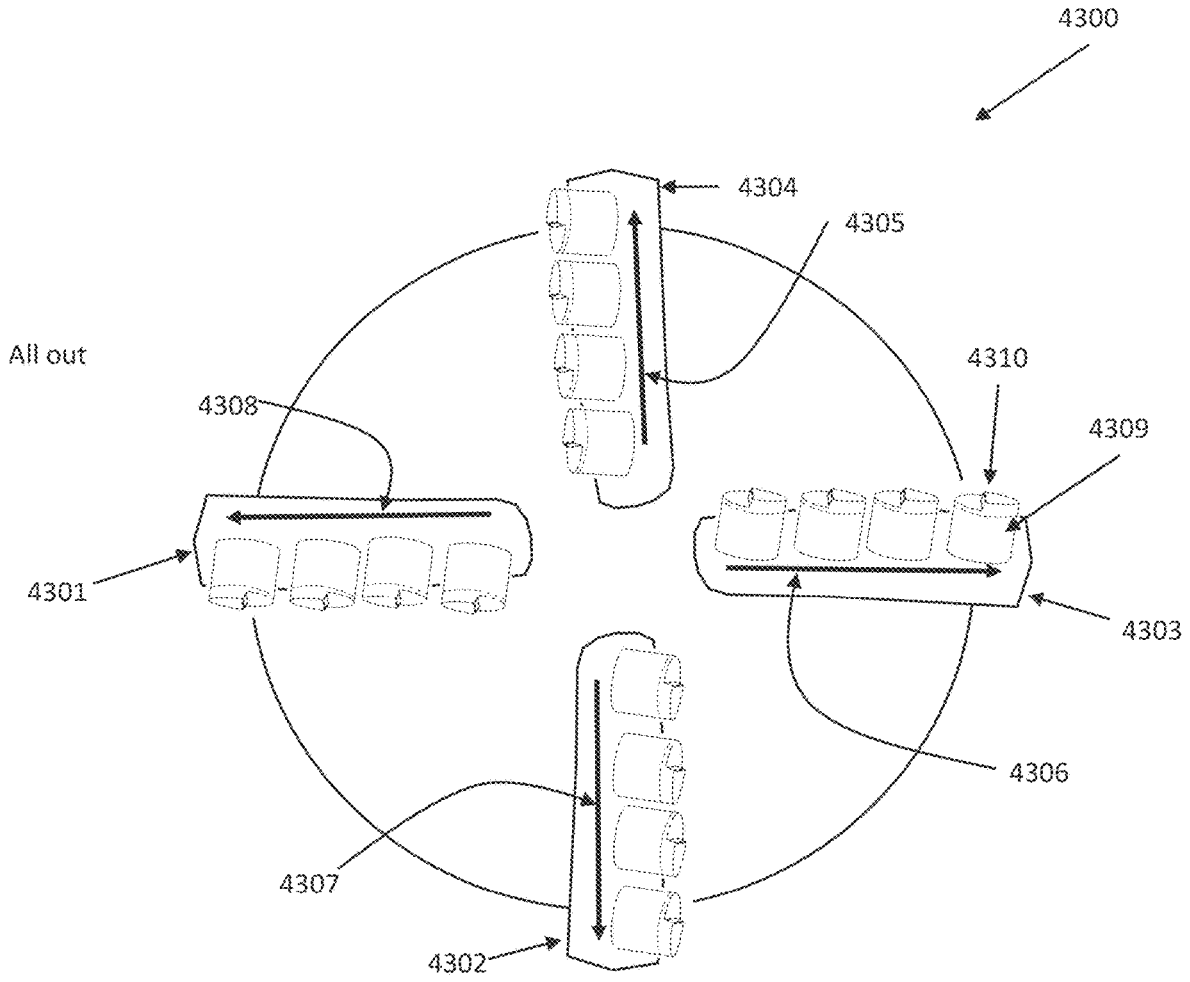
FIG. 43 depicts a PDC drill bit with cutters on each blade aligned in the same direction to promote a directional force tendency while the bit rotates.

FIG. 43 is a depiction of a PDC drill bit 4300. Bit 4300 includes blades 4301, 4302, 4303 and 4304, which are positioned on the bit 4300 and configured hold a plurality of cutting elements 4309, each having a step surface 4310. The cutting elements 4309 on each blade 4301-4304 are aligned in the same direction to promote a directional force tendency while the bit 4300 rotates. This directional force tendency for blades 4301-4304 is denoted by arrows 4308, 4307, 4306 and 4305, respectively. Each blade 4301-4304 contains cutting elements 4309 that are configured and aligned to create a cumulative radial directional force tendency outward resulting in an overall balancing of the bit 4300 to reduce lateral vibration while rotating. That is, the pair of blades 4301 and 4303 have counteracting outward radial force tendencies denoted by arrows 4308 and 4306, while at the same time the pair of blades 4302 and 4304 also have counteracting outward radial force tendencies denoted by arrows 4307 and 4305. The aligned step surfaces 4310 on each of the cutting elements 4309 on each of the corresponding blades 4301-4304 provide an outward force or force tendency from the center of the bit 4300, which, as a whole, creates a bit rotation stabilizing effect when utilizing multiple counteracting blades to minimize drilling disfunction.

Figure 44:
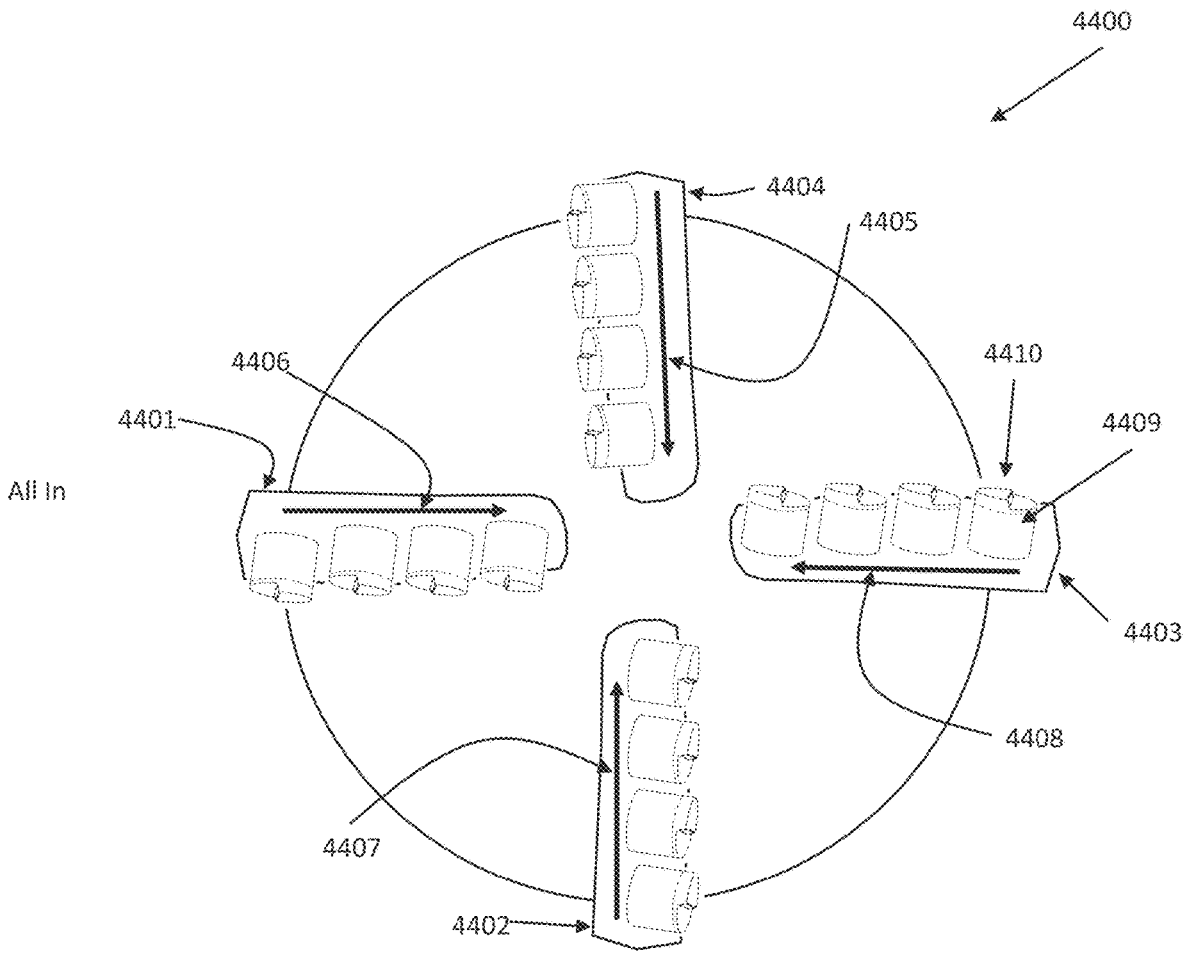
FIG. 44 depicts another PDC drill bit with cutters on each blade aligned in the same direction.

FIG. 44 is a depiction of a PDC drill bit 4400. Bit 4400 includes blades 4401, 4402, 4403 and 4404, which are positioned on the bit 4400 and configured hold a plurality of cutting elements 4409, each having a step surface 4410. The cutting elements 4409 on each blade 4401-4404 are aligned in the same direction to promote a directional force tendency while the bit 4400 rotates. This directional force tendency for blades 4401-4404 is denoted by arrows 4406, 4407, 4408 and 4405, respectively. Each blade 4401-4404 contains cutting elements 4409 that are configured and aligned to create a cumulative radial directional force tendency inward resulting in an overall balancing effect of the bit 4400 to reduce lateral vibration while rotating. That is, the pair of blades 4401 and 4403 have counteracting inward radial force tendencies denoted by arrows 4406 and 4408, while at the same time the pair of blades 4402 and 4404 have counteracting inward radial force tendencies denoted by arrows 4407 and 4405. The aligned step surfaces 4410 on each of the cutting elements 4409 on each of the corresponding blades 4401-4404 provide an inward force or force tendency to the center of the bit 4400, which, as a whole, creates a bit rotation stabilizing effect when utilizing multiple counteracting blades to minimize drilling disfunction.

Figure 45:
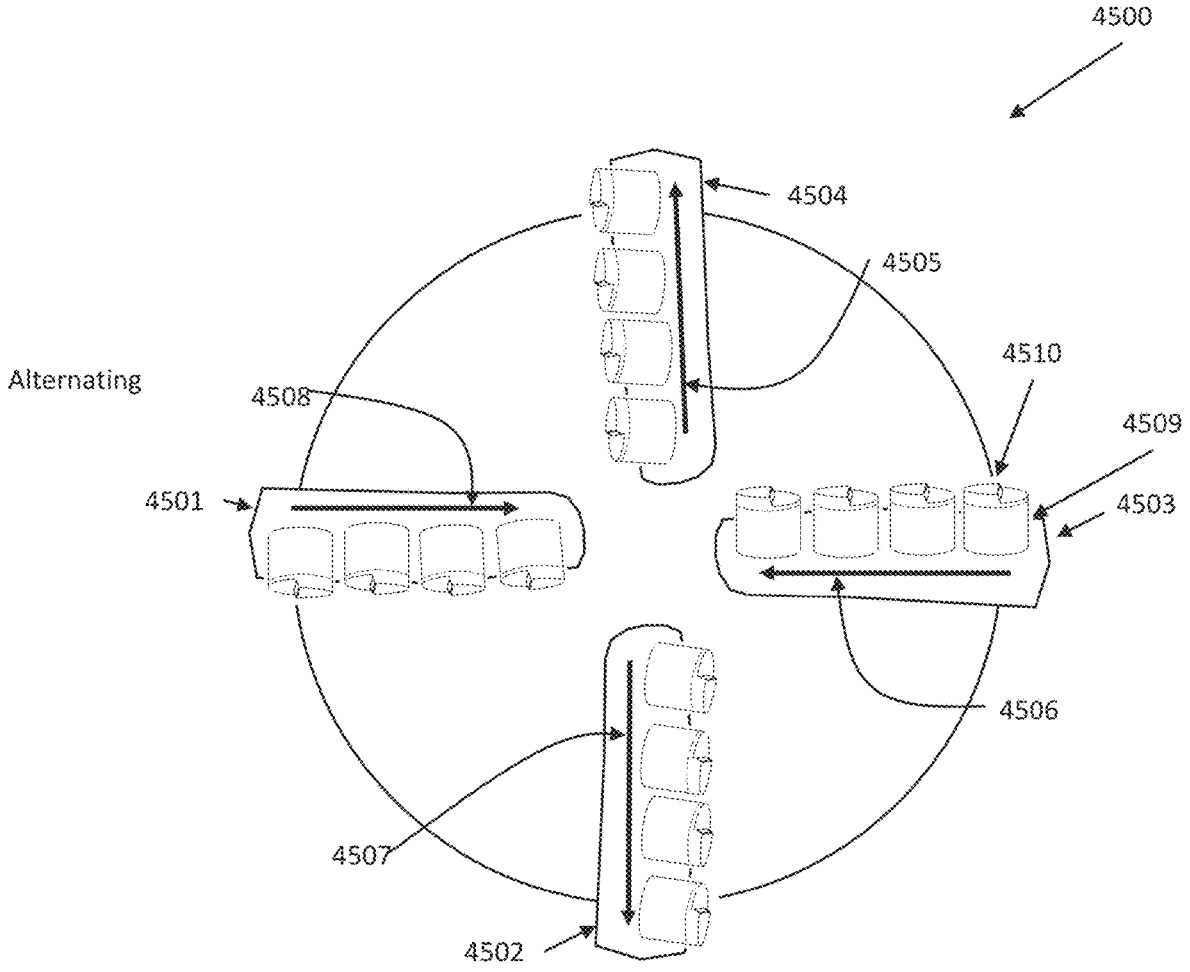
FIG. 45 depicts another PDC drill bit with cutters on each blade are aligned in the given direction.

FIG. 45 is a depiction of a PDC drill bit 4500. Bit 4500 includes blades 4501, 4502, 4503 and 4504, which are positioned on the bit 4500 and configured hold a plurality of cutting elements 4509, each having a step surface 4510. The cutting elements 4509 on each blade 4501-4504 are aligned in the same direction to promote a directional force tendency while the bit 4500 rotates. This directional force tendency for blades 4501-4504 is denoted by arrows 4508, 4507, 4506 and 4505, respectively. Each blade 4501-4504 contains cutting elements 4509 that are configured and aligned to create a cumulative radial directional force tendency either inward or outward resulting in an overall balancing of the bit 4500 to reduce lateral vibration while rotating. That is, the pair of blades 4501 and 4503 have counteracting inward radial force tendencies denoted by arrows 4508 and 4506, while the pair of blades 4502 and 4504 have counteracting outward radial force tendencies denoted by arrows 4507 and 4505. The aligned step surfaces 4510 on each of the cutting elements 4509 on each of the corresponding blades 4501-4504 provide a force or force tendency to or away from the center of the bit 4500, which, as a whole, creates a bit rotation stabilizing effect when utilizing multiple counteracting blades to minimize drilling disfunction.

Figure 46:
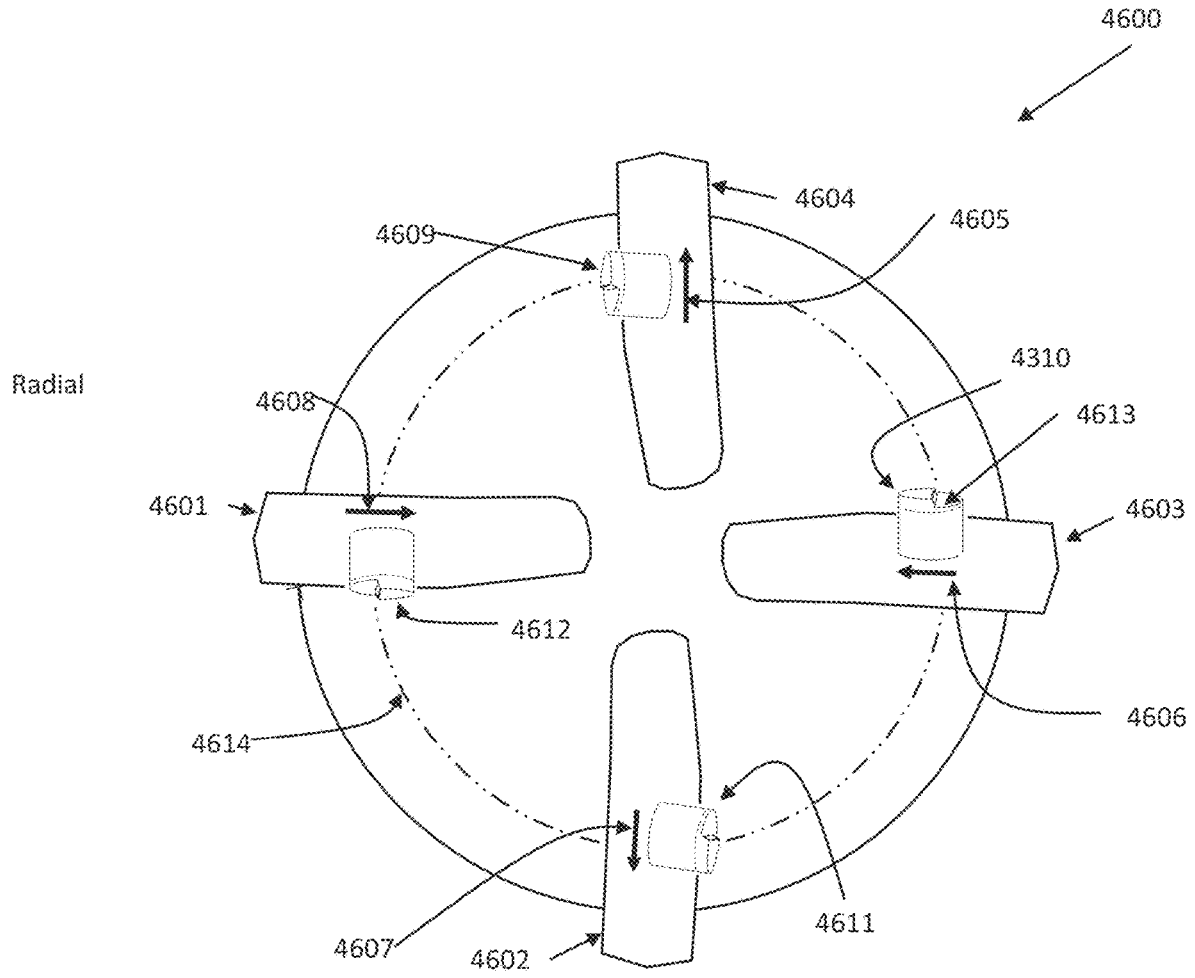
FIG. 46 depicts a PDC drill bit with cutters on each blade aligned in a given direction or alignment.

FIG. 46 is a depiction of a PDC drill bit 4600. Bit includes blades 4601, 4602, 4603 and 4604, which are positioned on the bit 4600 and configured to hold a plurality of cutting elements. For clarity and simplicity only one cutting element per bit blade is depicted. Blade 4601 includes cutting element 4612, blade 4602 includes cutting element 4611, blade 4606 includes cutting element 4610, and blade 4604 includes cutting element 4609. Cutting elements 4609-4612 are aligned in a given direction or alignment to promote a lateral directional force tendency. Broken line 4614 is a reference line denoting a specific radial position on the bit 4600. Each cutting element 4609-4612 has a step surface 4613. In this embodiment, the step surfaces 4613 on each cutting element is alternated as a function of radial position on the bit 4600. That is, the step surface 4613 of cutting element 4612 on blade 4601 is aligned to provide an inward force tendency denoted by arrow 4608, the step surface 4613 of cutting element 4611 on blade 4602 is aligned to provide an outward force tendency denoted by arrow 4607, the step surface 4613 of cutting element 4610 on blade 4603 is aligned to provide an inward force tendency denoted by arrow 4606, and the step surface 4613 of cutting element 4609 on blade 4604 is aligned to provide an outward force tendency denoted by arrow 4605. The cutting elements 4609-4612 are aligned as a function of radial position on the bit 4600 to provide counteracting forces to promote more stable rotation of the bit 4600 and self-centering tendencies. Other radial design priority arrangements and alignments of blades, bits, and step surfaces can be used to provide the desired force profile, such as radial arrangements with all cutting elements aligned with an outward tendency, arrangements with all cutting elements aligned with an inward tendency, or other combinations configured to provide for a specific desired drilling effect or steering tendency during a drilling application. The pattern of the alignment of the cutting elements can alternate as a function of radial position between 0 and 360 degrees around the bit, or as a function of discrete radial positions or circles from the center to the outermost diameter of the bit or as a function of spiral patterns on the bit.

Forming the Diamond Table

The present disclosure includes methods of making PDC cutting elements. The method can include selecting a polycrystalline diamond, shaping the polycrystalline diamond into a diamond table having a multi-tiered surface, leaching the diamond table, optionally polishing one or more surfaces of the diamond table, and optionally treating the edges and/or corners of the diamond table.

Selecting the polycrystalline diamond can include selecting polycrystalline diamond of a desired grain size. The grain size of the microstructure of the polycrystalline diamond can be varied (e.g., increased or decreased) to affect the impact durability or wear life of the cutting elements. In some embodiments, the polycrystalline diamond is made using a high pressure/high temperature (HP/HT) sintering process, such as with a pressure greater than 4.5 GPa and temperature greater than 1000° C.

The mechanical and thermal properties of polycrystalline diamond make it a suitable material for rock formation drilling. Similar to many other hard materials, diamond is relatively brittle and relatively weak under tensile loading. To address this, in some embodiments, the PDC cutting elements disclosed herein include diamond tables that are configured to minimize tensile stress and maximize compressive stress to improve durability of the diamond tables.

The PDC cutting elements disclosed herein can be configured to exhibit improved residual stress properties by having a diamond table with relatively thicker regions and relatively thinner regions, which can be achieved by shaping the diamond table.

The diamond table can be shaped to have a multi-tiered cutting surface by providing the diamond table with geometric features (e.g., the steps and/or troughs). In some embodiments, the steps and/or troughs are formed into the diamond table in situ during the formation of the diamond table. The steps and/or troughs may be formed into the diamond table during an HP/HT sintering process within the press. For example, the press can be shaped such that the HP/HT sintering process forms the diamond table as a diamond table having one or more step features. Thus, steps and/or troughs can be molded or "as pressed" into the surface of the polycrystalline diamond table during the HP/HT sintering process that is used to form the diamond.

In other embodiments, the geometric features (e.g., the steps and/or trough) are formed in the diamond table after the diamond table is formed (e.g., after the HP/HT sintering process). For example, a diamond table without steps or troughs can be subjected to a subsequent shaping process to add steps or troughs thereto. The subsequent shaping process can include laser ablation, wire electrical discharge machining (EDM), plunge EDM, water jet cutting, grinding, or other machining techniques that facilitate the removal and/or shaping of polycrystalline diamond.

Figure 1:
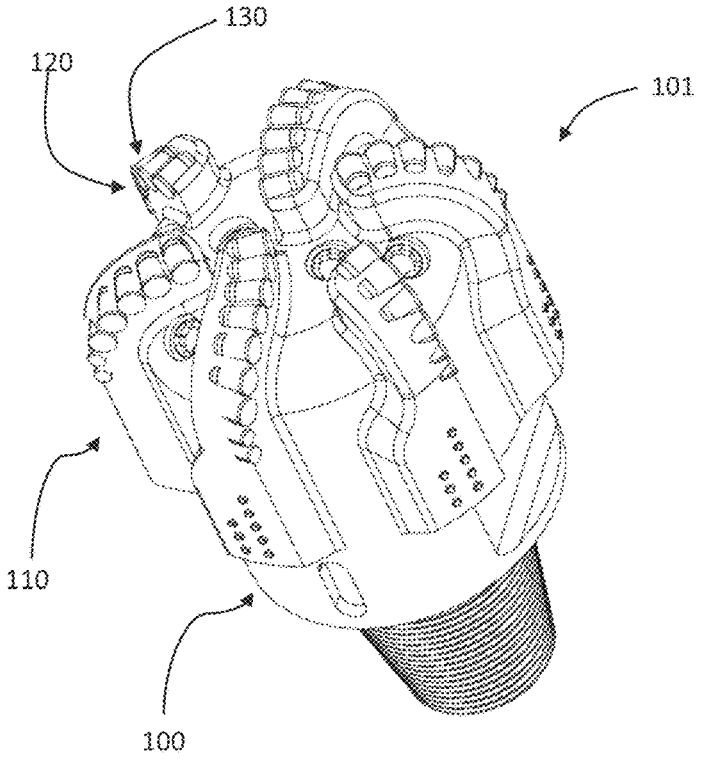
PRIOR ART Fig. 1
FIG. 1 depicts a traditional PDC drill bit with traditional PDC insert cutting elements.
Figure 2:
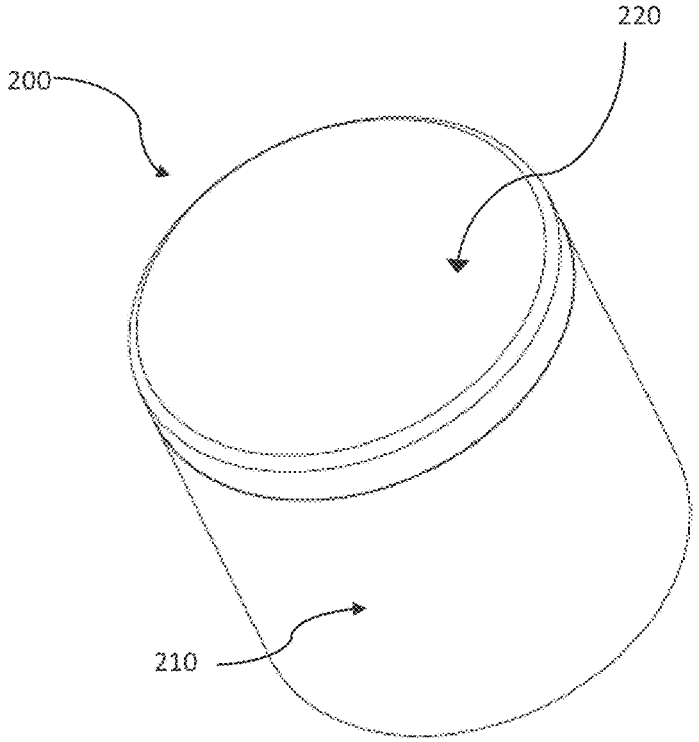
PRIOR ART Fig. 2
FIG. 2 depicts a traditional PDC insert cutting element.
Figure 3:
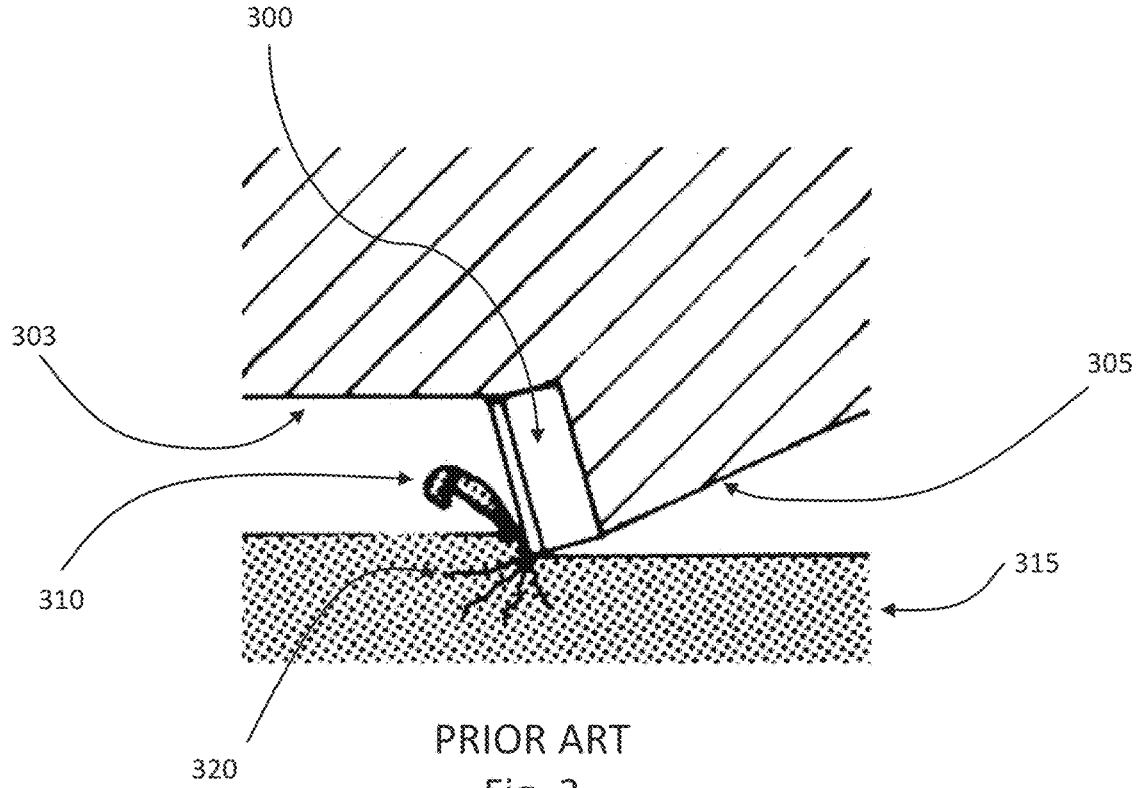
PRIOR ART Fig. 3
FIG. 3 depicts a traditional PDC insert cutting element shearing a rock formation.
Figure 4:
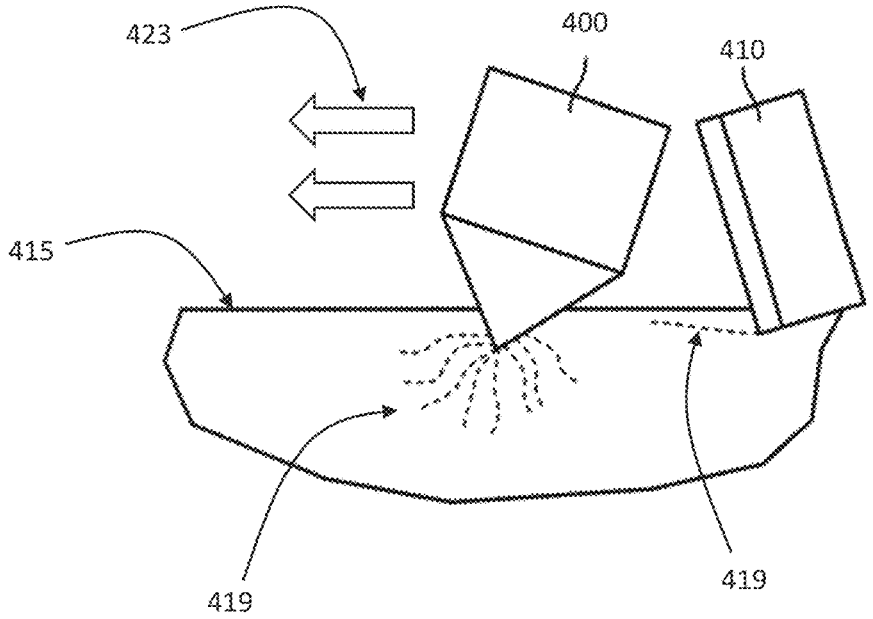
PRIOR ART Fig. 4
FIG. 4 depicts a leading scribe or pick used to shear or pre-fracture a rock formation used in conjunction with a trailing traditional PDC insert cutting element used to shear the rock formation.

In some embodiments, prior to shaping the surface of the diamond table, the diamond table includes only a single, flat planar surface (e.g., such as is shown in FIGS. 2 and 34D). After shaping, the diamond table has at least two regions of that have different thicknesses of diamond material, and has at least two surfaces that are at different relative elevations.

The shaping step can include providing at least one step in the cutting surface of the diamond table, or providing a plurality of steps. In some embodiments, each step includes an edge that, generally, radially extends from a center of the diamond table to an outer perimeter of the diamond table. The edge of a step can extend across an entire face of the diamond table or can extend only partially across the face of the diamond table. The angle and/or height of a step can be varied. For example, referenced from a plane (real or imaginary), such as an uppermost planar surface of the diamond table, the angle of a step may be 90 degrees (e.g., perpendicular to the diamond table uppermost planar surface—a neutral rake), less than 90 degrees (i.e., a positive rake), or greater than 90 degrees (i.e., a negative rake). The cutting elements can be shaped to include a step that is positioned to make primary contact with rock and is, generally, located where a wear flat is expected to form during drilling. For example, a step can be, generally, positioned at an apex of the cutting element when the cutting element is mounted on a drill bit, such that the step is positioned to make a first or primary contact with the rock formation during drilling. During drilling, a root of a step (e.g., bottom edge of the step) can direct fractures (cracks) in the diamond table to extend along the root, preventing or reducing the spread of fractures throughout other portions of the diamond table.

In some embodiments, the shaping step includes providing at least two or more steps in the diamond table. The multiple steps may be arranged randomly or in a pattern, such as in a radially symmetric pattern or an asymmetrical arrangement. In embodiments having multiple steps, the steps can have left-handed or right-handed rotation. For example, FIG. 34A depicts a cutting element with multiple steps having a left-handed or counter clockwise rotation of steps (i.e., the height of each step increases along the counter clockwise direction). In other embodiments, a cutting element with multiple steps can have a right-handed or clockwise rotation of steps (i.e., the height of each step increases along the clockwise direction). In cutting elements where all of the steps on the diamond table are either right- or left-handed, the bit can tend to be pulled in a particular direction. In cutting elements that include steps on the diamond table that are right-handed and steps that are left-handed, then the opposing forces exerted by the different steps can balance, such that the stability of the bit direction is increased. The steps may be a negative displacement (i.e., not a protuberance), or a positive displacement feature (i.e., a protuberance).

The shaping step can include providing multiples steps in the diamond table surface that are arranged relative to one another such that the multiple steps, together, form a trough or groove within the diamond table. A bottom surface of a trough is at a lower elevation than the cutting surfaces of the diamond table that are on either side of the trough in at least one direction along the diamond table. The trough can be provided with a radius contour, an angular contour, or a square contour. The trough can be aligned with an apex of the diamond table (as positioned in a cutter pocket of a bit). For example, the trough can be positioned in a cutter pocket to make a first or most direct contact with the formation. Some embodiments of the cutting elements disclosed herein are configured to engage a rock formation with a first shearing edge at a bottom of a trough located at a periphery of the diamond table, and a secondary shearing edge at top edge corners of the primary surface of the diamond table face.

In some embodiments, the steps can form lateral channels or troughs that provide for additional mud flow across the cutting face of the cutting element, enhancing the hydrodynamic properties of the cutting element. Such embodiments can be advantageous, such as on a drill bit including one bearing ring that has traditional round cutting elements and another ring has the stepped surface cutting elements disclosed herein. The angle of the edges and sidewalls of the channel or trough can be varied to vary the degree of mud movement across the diamond table. The flow of mud across the diamond table can function to cool the diamond table. In some embodiments, relatively fine grooves can be formed in the diamond table to provide for additional cooling due to the increased surface area for contact with the mud.

The shaping step can include providing a radially tapered or contoured surface (e.g., a ramp-like feature) in the diamond table. For example, the diamond table may be shaped such that sequent steps in the diamond table are positioned symmetrically or asymmetrically in a radial arrangement about the diamond table. The cutting elements may include at least two discrete radial steps.

Surface Finish of the Diamond Table

One or more surfaces of the diamond table can be polished, lapped, non-polished, or combinations thereof. For example, the cutting elements can include a polished diamond top surface with polished or non-polished secondary, tertiary, and/or quaternary lower surfaces of the diamond table. Cutting surfaces of the diamond table can have a mirror polish surface finish, a lapped surface finish, or a matte surface finish. In some embodiments, polished diamond surfaces are suitable for applications where the formation includes soft rock with a tendency to create ribbons, long cuttings, or adhere to cutting surfaces. Cutting surfaces of the diamond table can have a roughened or textured surface.

Edge and Corner Treatment

The method can include shaping the corners and/or edges on the diamond table. For example, the corners and/or edges on the diamond table can be beveled, shaped as a chamfer, radius, or sharp edged depending on the application. In some embodiments, the PDC cutting elements are provided with an angled, round, shear cutting edge that provides for increased cutting efficiency without requiring the cutting element to be positioned to have a side rake. For example, a radially contoured diamond table can be shaped to progressively increase in thickness in stepped quadrants of the diamond table. Each of the edges and corners present on the diamond table may be subjected to the edge-treatments disclosed herein. For example, the edges and corners suitable for treatment include, but are not limited to, the peripheral edges of the diamond table cutting surfaces and troughs, the top and side edges of the sidewalls of the step features, and the corners of the step features and troughs.

Leaching the Diamond Table

In some embodiments, the diamond table is leached. The multi-tiered surface of the diamond table exposes an increased amount of surface area to leaching in comparison to an otherwise identical diamond table that has a single, flat planar surface. The diamond tables disclosed herein can be leached to greater depths than a diamond table that has a single, flat planar surface. The leaching solution can penetrate the diamond table at the top surface, periphery, and along edges and sidewalls of the step features. Thus, the multi-tiered diamond surfaces provide for three-dimensional leaching and potential for deeper penetration of leaching solution into the working region of the diamond table. The increased surface area of the diamond table, as well as the variations in directional angles of contact for the leaching solution (e.g., acid solution), provides for a more efficient leaching of interstitial, second phase cobalt alloy that is present within the microstructure of the polycrystalline diamond table.

During drilling, once the upper cutting surface is worn away, the lower cutting surface is still available to cut the formation. For example, the lower cutting surfaces of the multi-tiered diamond tables may have an additional depth (e.g., 1000 microns) of leached diamond to function as a cutting surface after the upper cutting surface is worn away. Thus, the PDC cutting elements increase (e.g., double) the volume of leached diamond material available for drilling.

Applications

The cutting elements can be used as cutting structures on Earth boring or drilling devices, such as those used in oil and gas exploration, drilling, mining, and excavating applications. The cutting elements disclosed herein can be used on drag bits or other bits. In some applications, the cutting elements are positioned on a bit that is coupled with a directional mud motor or rotary steerable drilling bottom hole assembly for drilling operations. Embodiments of the cutting elements disclosed herein can be configured to be used on a traditional drill bit, without requiring the bit to be retrofitted or modified for receipt of the cutting elements.

For directional drilling applications, a PDC drill bit, including the cutting elements disclosed herein, can be mounted to a drive shaft of a motor assembly of a bottom hole assembly. The drive shaft can then be rotated using a positive displacement motor, sometimes referred to as a Moineau type system. Mud can be pumped through the positive displacement motor causing the bit to rotate and drill the subterranean formation. To steer the bit, a portion of the motor assembly can be slightly bent (e.g., between 2 and 4 degrees). To steer the bit in a given direction, the bit can be rotated without rotating the drill string, allowing the bent section to point the bit in a designated direction to change the trajectory. The drill string can drill substantially linear or straight when both the bit and the drill string are rotated simultaneously, which may cancel the tendency imposed by the bend while creating a slightly larger hole. The ability to determine or control the direction of the drill string is referred to as "tool face control" which may be monitored while the bit rotates (the drill string may not be rotating). Other directional drilling methodologies that the cutting elements may be used with include those that employ non-rotating bottom hole assemblies having lateral thrust pads (e.g., push the bit steering technology) or internal mechanisms that change the angle of only the bit (e.g., point the bit steering technology).

In directional drilling, the face configuration of the PDC cutting elements may be a significant feature related to the performance of the bit. The configuration of the cutting element may determine, or at least affect, how a bit responds to variations of weight on bit, steering tendencies, and formation hardness. These variables can influence the torque seen by the bit, the ability to hold tool face for steering accuracy, and the penetration rate. When the bit exhibits excessive torque variation, tool face orientation may be lost, resulting in lost borehole quality and increased tortuosity. In some such embodiments, to reestablish tool face orientation, the driller may stop drilling and pull the bit off bottom, which is a time consuming and costly process, resulting in loss of productivity and reduction in rate of penetration (ROP).

Methods to reduce torque while drilling include increasing the back rake (negative rake) of the cutting element, increasing the number of cutting elements on a bit, increasing the size of the chamfer on individual cutting elements, and using bit designs that reduce the ability of the cutting elements to over engage the formation, such as positioning hard material protuberances behind the cutting elements to act as depth limiters.

The PDC cutting elements disclosed herein can be designed to accommodate a wide spectrum of formation conditions, and can be used to drill such formations without compromising drilling efficiency or ROP. Some embodiments of the PDC cutting elements disclosed herein are capable of fracturing hard rock and efficiently shearing large volumes of soft rock. The PDC cutting elements disclosed herein can accommodate the drilling of both soft and hard rock without requiring the use of multiple, different bit designs. Thus, the number of times that bits need to be switched out during the drilling of a well can be reduced by use of the cutting elements disclosed herein. The PDC cutting elements can serve the function of both a pick and a cylinder cutter.

Embodiments of the PDC cutting elements disclosed herein may minimize the occurrence of torque spikes during drilling, which can provide increased tool face control and a reduced occurrence of tortuous well bores. By minimizing tortuosity, the cutting elements disclosed herein reduce the occurrence of undesirable sumps (i.e., low spots in a horizontal section of a well). Reducing the occurrence of undesirable sumps reduces the need to perform follow-up reaming operations in the well to clean up the well bore, which can be costly and time consuming.

The cutting elements can be configured, arranged, and positioned in various ways to adjust the performance of a bit. For example, the cutting elements can be mounted on the bit at various angles to control aggressiveness of the engagement between the cutting elements and rock. The shape of the cutting elements can be configured to promote rock shearing, rock fracturing, rock scoring, or combinations thereof. The cutting elements can be shaped to promote stable rotation of a drill bit, accommodate variations of weight on bit (WOB), or improve tool face control for more accurate steering to hit a specific drilling target.

The cutting elements disclosed herein may also be used in mining. For example, a split plan or radially angled step in the diamond table of the cutting element can provide for increased penetration rates into coal or rock. Each half-moon portion of the cutting element can have a step edge thereon.

The cutting elements disclosed herein can be used as a road pick for removal of stripes on asphalt. For example, a generally round cutting element insert can include a step edge or radial step that facilitates smoother cuts and less vibration during stripe removal. Such cutting elements can also facilitate the removal of concrete due to the concentrated stress point of the step edge, and can also facilitate the subsequent shearing of the pre-fractured concrete. Alternatively, a stepped cutting element having two quadrants, including one high quadrant and one low quadrant, can be mounted on a drum such that the fa edge of high quadrant can engage the road surface. The edge of high quadrant can be shaped with a negative, neutral, or positive rake.

Design Features and Variations of the Diamond Cutting Elements

The cutting elements disclosed herein can be configured for drilling only hard rock formations, drilling only soft rock formations, or drilling both hard and soft rock formations. For example, some embodiments of the cutting elements are configured to have sufficient durability to fracture, crush, and/or score hard rock. Some embodiments of the cutting elements are configured to be capable of shearing and removing large volumes of soft rock. Some embodiments of the cutting elements are configured to have both sufficient durability to fracture, crush, and/or score hard rock, and be capable of shearing and removing large volumes of soft rock. PDC cutting elements that are sufficiently durable to cut hard rock and are capable of shearing high volumes of soft rock at deep depths of cut provides for enhanced ability to drill subterranean formations to extract hydrocarbons. The cutting elements can be configured and customized to provide varying degrees of rock fracturing ability without significantly compromising the shearing efficiency or rock volume removal. The cutting elements can shear rock with one cutting edge of the diamond table while simultaneously scoring and/or fracturing rock with two or more side corners or edge points of the diamond table.

Embodiments of the cutting elements can be designed and configured to have different levels of cutting performance that varies depending on how the cutting element is radially positioned in the cutter pocket. For example, a first radial position of the cutting element can provide high fracturing potential, a second radial position can provide moderate fracturing potential, and a third radial position can provide minor fracturing potential. The fracturing potentials of the cutting elements can be varied without substantially changing the shearing characteristics of the cutting element or volume of rock that can be removed by the cutting element. The PDC cutting elements can be configured for drilling hard rock formations using angular point loading that generates rock fractures, while also being configured to drill soft formations for efficient removal of high volumes of rock.

The cutting elements disclosed herein can be configured to induce a lateral force vector or direction tendency for improved steering potential when used on a steerable motor or rotary steerable drilling system. This is to be accomplished without the necessity of positioning the cutters at an angle to create a side rake. Embodiments of the cutting elements can be rotated to provide varying degrees of lateral force vector. For example, at a first radial position a cutting element can provide a high lateral force vector, at a second radial position the cutting element can pray ide a moderate lateral force vector, and at a third radial position the cutting element can provide a minimal lateral force vector. The cutting elements disclosed herein may be rotated to vary rock fracturing performance. For example, at a first radial position a cutting element can provide a high rock fracturing performance, at a second radial position the cutting element can provide a moderate rock fracturing performance, and at a third radial position the cutting element can provide a minimal rock fracturing performance. ion. The ability to vary the performance (e.g., lateral force vector and/or rock fracturing) provides for customized performance options for an individual cutting element, which can reduce the need to maintain inventories of separate cutting elements for different lateral force vectors.

The stepped edges of the cutting elements function as locking edges that prevent lateral movement against the edge. In embodiments with two adjacent cutting elements with opposing edge heights, the cutting elements passively prevent lateral movement in bath lateral directions. Additionally, if the step has an angled edge, the step creates an active lateral force vector in a similar fashion to a cutter intentionally positioned on a bit with a side rake to create a lateral force.

Embodiments of the PDC cutting elements can be configured to reduce lateral bit vibration by creating lateral opposing counter forces, either within the same cutting element or between two discrete cutting elements on the bit, without requiring the positioning of the cutting elements at angles to create a side rake. The reduction in lateral bit vibration can be used in steerable motor applications during rotate mode drilling where the bent housing and associated angle can impose lateral forces on the bit that cause the bit to vibrate laterally. The steps can create a lateral force that facilitates directional drilling on a steerable motor or RSS system, without requiring a redesign of the bit or realignment of the cutter pockets.

Embodiments of the cutting elements disclosed herein can be configured to perform as chip breakers, such as when used in soft rock formations under high confining pressure drilling conditions. This can be achieved, for example, by shaping the diamond table to have a chip breaking feature on the surface thereof.

Embodiments of the cutting elements disclosed herein include step or corner geometry that is flush or recessed relative to a primary diamond surface. In such embodiments, the corner can be stronger in comparison to a point in a traditional cutting element that stands proud relative to the diamond surface, such that the cutting elements disclosed herein can withstand higher frontal and lateral forces. Due to the height differentials of the diamond table surface provide by the steps, the diamond table engages rock with an uneven contact force, causing hard rock to fracture more easily. Additionally, the step can be positioned perpendicular to the direction of shear, such that the cutting element shears the rock.

Although the present embodiments and advantages have been described in detail, it should be understood that various changes, substitutions and alterations can be made herein without departing from the spirit and scope of the disclosure. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A drill bit, the drill bit comprising:

a drill bit body;

a first plurality of cutting elements positioned on the drill bit body, wherein each of the first plurality of cutting elements is aligned in a first fixed orientation relative to the drill bit body and is non-rotatably fixed to the drill bit body, the first plurality of cutting elements comprising cutting elements having stepped polycrystalline diamond tables with radially tapered cutting surfaces directed in a clockwise direction, wherein each radially tapered cutting surface of the first plurality of cutting elements has a first fixed radial orientation relative to the drill bit body;

a second plurality of cutting elements positioned on the drill bit body, wherein each of the second plurality of cutting elements is aligned in a second fixed orientation relative to the drill bit body and is non-rotatably fixed to the drill bit body, the second plurality of cutting elements comprising cutting elements having stepped polycrystalline diamond tables with radially tapered cutting surfaces directed in a counterclockwise direction, wherein each radially tapered cutting surface of the second plurality of cutting elements has a second fixed radial orientation relative to the drill bit body;

wherein each radially tapered cutting surface is a surface having an elevation in the stepped polycrystalline diamond table that tapers in a radial direction, the stepped polycrystalline diamond table having stepped surfaces between adjacent radially tapered cutting surfaces; and wherein the first plurality of cutting elements are positioned on the drill bit body and aligned in the first fixed orientation relative to the drill bit body to provide a first force on the drill bit body that is directed in a first direction, wherein the second plurality of cutting elements are positioned on the drill bit body and aligned in the second fixed orientation relative to the drill bit body to provide a second force on the drill body that is directed in a second direction, and wherein the first and second directions are different;

wherein each radially tapered cutting surface of the first plurality of cutting elements extends helically around a central axis of the respective cutting element and has a first angle of tapering relative to a circumferential direction about the central axis, the first angle of tapering defining a direction of radial tapering that is clockwise when viewed from above along the central axis of the respective cutting element; and wherein each radially tapered cutting surface of the second plurality of cutting elements extends helically around a central axis of the respective cutting element and has a second angle of tapering relative to a circumferential direction about the central axis, the second angle of tapering defining a direction of radial tapering that is counterclockwise when viewed from above along the central axis of the respective cutting element.

2. The drill bit of claim 1, wherein each stepped surface comprises a top edge, a sidewall, and a bottom edge, wherein the top edge is a boundary between the sidewall and one of the adjacent radially tapered cutting surfaces, wherein the bottom edge is a boundary between the sidewall and another of the adjacent radially tapered cutting surfaces, and wherein the sidewall is a surface extending between the adjacent radially tapered cutting surfaces.

3. The drill bit of claim 2, wherein each sidewall extends at an acute angle relative to the adjacent radially tapered cutting surfaces.

4. The drill bit of claim 2, wherein each sidewall extends at an obtuse angle relative to the adjacent radially tapered cutting surfaces.

5. The drill bit of claim 2, wherein each sidewall extends perpendicular relative to the adjacent radially tapered cutting surfaces.

6. The drill bit of claim 2, wherein an angle of each sidewall relative to the adjacent radially tapered cutting surfaces or a height of each sidewall extending between the adjacent radially tapered cutting surfaces varies as a function of radial position relative to a periphery the stepped polycrystalline diamond table.

7. The drill bit of claim 1, wherein a width of the radially tapered cutting surfaces varies as a function of radial position relative to a periphery of the stepped polycrystalline diamond table.

8. The drill bit of claim 1, wherein each radially tapered cutting surface tapers from a first height to a second height such that a thickness of each of the stepped polycrystalline diamond tables varies from a first thickness at the first height to a second thickness at the second height, and wherein the first thickness is greater than the second thickness.

9. The drill bit of claim 1, wherein each stepped polycrystalline diamond table comprises a concavity or a protuberance positioned at a center thereof.

10. The drill bit of claim 1, wherein the stepped polycrystalline diamond tables each comprises a plurality of the stepped surfaces and a plurality of the radially tapered cutting surfaces, and wherein each radially tapered cutting surface is positioned between a pair of adjacent stepped surfaces.

11. The drill bit of claim 10, wherein the adjacent radially tapered cutting surfaces and the stepped surfaces form wedges in the stepped polycrystalline diamond tables.

12. The drill bit of claim 1, wherein the first force directed in the first direction is a lateral force on the drill bit body that is directed towards a center of the drill bit.

13. The drill bit of claim 12, wherein the second force directed in the second direction is a lateral force on the drill bit body that is directed away from the center of the drill bit.

14. The drill bit of claim 1, wherein each cutting element is non-rotatably mounted on the drill bit body.

15. The drill bit of claim 1, wherein:

the drill bit comprises a first blade, wherein the first plurality of cutting elements are positioned on the first blade;

wherein the drill bit comprises a second blade, wherein the second plurality of cutting elements are positioned on the second blade; and wherein the first plurality of cutting elements on the first blade have radially tapered cutting surfaces that are directed in the clockwise direction, and wherein the second plurality of cutting elements on the second blade have radially tapered cutting surfaces that are directed in the counterclockwise direction.

16. The drill bit of claim 1, wherein the cutting elements are arranged on the drill bit body in pairs such that each pair of cutting elements includes one of the first plurality of cutting elements and one of the second plurality of cutting elements, wherein the first plurality of cutting elements are oriented such that the radially tapered cutting surfaces are directed in the clockwise direction, and wherein the second plurality of cutting elements are oriented such that the radially tapered cutting surfaces are directed in the counterclockwise direction.

17. The drill bit of claim 1, wherein the first and second forces are directed in opposite directions.

18. The drill bit of claim 1, wherein each cutting element is aligned relative to the drill bit body to provide a lateral force on the drill bit body during drilling that enhances lateral stability of the drill bit.

19. A method of making a drill bit having polycrystalline diamond cutting elements, the method comprising:

forming a first plurality of cutting elements, the first plurality of cutting elements comprising cutting elements having stepped polycrystalline diamond tables with radially tapered cutting surfaces directed in a clockwise direction;

forming a second plurality of cutting elements, the second plurality of cutting elements comprising cutting elements having stepped polycrystalline diamond tables with radially tapered cutting surfaces directed in a counterclockwise direction;

wherein each radially tapered cutting surface is a surface having an elevation in the stepped polycrystalline diamond table that tapers in a radial direction, the stepped polycrystalline diamond table having stepped surfaces between adjacent radially tapered cutting surfaces;

attaching the first and second plurality of cutting elements onto a drill bit body;

wherein the first plurality of cutting elements are positioned and aligned in a first fixed orientation relative to the drill bit body and are non-rotatably fixed to the drill bit body, wherein each radially tapered cutting surface of the first plurality of cutting elements has a first fixed radial orientation relative to the drill bit body;

wherein the second plurality of cutting elements are positioned and aligned in a second fixed orientation relative to the drill bit body and are non-rotatably fixed to the drill bit body, wherein each radially tapered cutting surface of the second plurality of cutting elements has a second fixed radial orientation relative to the drill bit body;

wherein the first plurality of cutting elements are positioned and aligned on the drill bit body in the first fixed orientation to provide a first force on the drill bit body that is directed in a first direction, wherein the second plurality of cutting elements are positioned and aligned on the drill bit body in the second fixed orientation to provide a second force on the drill body that is directed in a second direction, and wherein the first and second directions are different;

wherein each radially tapered cutting surface of the first plurality of cutting elements extends helically around a central axis of the respective cutting element and has a first angle of tapering relative to a circumferential direction about the central axis, the first angle of tapering defining a direction of radial tapering that is clockwise when viewed from above along the central axis of the respective cutting element; and wherein each radially tapered cutting surface of the second plurality of cutting elements extends helically around a central axis of the respective cutting element and has a second angle of tapering relative to a circumferential direction about the central axis, the second angle of tapering defining a direction of radial tapering that is counterclockwise when viewed from above along the central axis of the respective cutting element.

20. The method of claim 19, further comprising leaching the stepped polycrystalline diamond tables, wherein the leaching includes contacting the stepped polycrystalline diamond tables with a leaching solution.

* * * * *